US010226110B2

(12) United States Patent
Hayashi

(10) Patent No.: US 10,226,110 B2
(45) Date of Patent: Mar. 12, 2019

(54) STRUCTURE OF GRIP OF BAG AND METHOD FOR ATTACHMENT OF SAME

(71) Applicant: HAYASHIGO CO., LTD., Osaka (JP)

(72) Inventor: Kaoru Hayashi, Osaka (JP)

(73) Assignee: HAYASHIGO CO., LTD., Osaka-Shi, Osaka (JP)

( * ) Notice: Subject to any disclaimer, the term of this patent is extended or adjusted under 35 U.S.C. 154(b) by 161 days.

(21) Appl. No.: 15/225,815

(22) Filed: Aug. 1, 2016

(65) Prior Publication Data

US 2016/0338462 A1 Nov. 24, 2016

Related U.S. Application Data

(63) Continuation of application No. PCT/JP2015/055763, filed on Feb. 27, 2015.

(30) Foreign Application Priority Data

Jul. 22, 2014 (JP) ..... 2014-149150
Oct. 10, 2014 (JP) ..... 2014-209412

(51) Int. Cl.
*A45C 3/06* (2006.01)
*A45C 13/30* (2006.01)
(Continued)

(52) U.S. Cl.
CPC ..... *A45C 13/30* (2013.01); *A45C 3/06* (2013.01); *A45C 13/103* (2013.01); *A45C 13/1069* (2013.01); *A45C 13/26* (2013.01)

(58) Field of Classification Search
CPC ..... A45C 13/30; A45C 3/06; A45C 13/103; A45C 13/1069; A45C 13/26
See application file for complete search history.

(56) References Cited

U.S. PATENT DOCUMENTS 208,793 A * 10/1878 Chapman ..... A45C 13/26 16/114.1
733,542 A * 7/1903 Converse ..... B65D 88/1618 16/114.1
(Continued)

FOREIGN PATENT DOCUMENTS

JP S60-79320 U 6/1985
JP S-61-111321 U 7/1986
(Continued)

*Primary Examiner* — Tri Mai
(74) *Attorney, Agent, or Firm* — Rabin & Berdo, P.C.

(57) ABSTRACT

When the bag is put down, the state of the hand-carrying portion standing upward can be kept, and a bag with its bag main body hard to lose its shape can be provided. In the structure of a hand-carrying portion of a bag of the present invention, the hand-carrying member has support members intervened both longitudinal edges for raising the hand-carrying member upward from the bag main body. The support member is coupled, with the overlapping region of the support member and the overlapping region of the hand-carrying member sewed together so that a crest portion of the support member faces a crest portion of the hand-carrying member so as to be positioned oppositely thereto. The hand-carrying member is fixing to the bag main body in one and other fixing regions of the hand-carrying member.

10 Claims, 40 Drawing Sheets

End face view along VI-VI

(51) Int. Cl.
*A45C 13/26* (2006.01)
*A45C 13/10* (2006.01)

(56) References Cited

U.S. PATENT DOCUMENTS

| | | | | | |
|---|---|---|---|---|---|
| 748,012 | A | * | 12/1903 | Ritter et al. | A45C 13/26<br>16/114.1 |
| 772,616 | A | * | 10/1904 | Isidor | A45C 13/26<br>16/114.1 |
| 1,677,583 | A | * | 7/1928 | Cromwell, Jr. | B65D 29/00<br>383/119 |
| 2004/0136621 | A1 | | 7/2004 | Mogil | |

FOREIGN PATENT DOCUMENTS

| | | | |
|---|---|---|---|
| JP | H08-112128 | A | 5/1996 |
| JP | 2003-310330 | A | 11/2003 |
| JP | 2005-168900 | A | 6/2005 |
| JP | 3124667 | U | 8/2006 |
| JP | 3131476 | U | 5/2007 |
| JP | 4430734 | B1 | 3/2010 |
| JP | 3180402 | U | 12/2012 |
| WO | WO-2015/005396 | A1 | 1/2015 |

* cited by examiner

End face view along I–I

End face view along II－II

End face view along IV–IV

End face view along V−V

End face view along VI-VI

End face view along VIII — VIII

A1 : Hand-carrying region
A2 : Non-sewing region
A3 : Joining region
A4 : Non-joining region End face view along I–I End face view along II－II End face view along V−V

514

End face view along VI–VI

End face view along VII—VII

B1 : Shouldering region
B2 : Non-sewing region
B3 : Joining region
B4 : Non-joining region

STRUCTURE OF GRIP OF BAG AND METHOD FOR ATTACHMENT OF SAME

This non-provisional application for a U.S. patent is a Continuation of International Application PCT/JP2015/055763 filed on Feb. 27, 2015, which claims priority from JP 2014-149150 filed on Jul. 22, 2014 and JP 2014-209412 filed on Oct. 10, 2014, the entire contents of all of which are hereby incorporated by reference.

TECHNICAL FIELD

The present invention relates to a structure of a hand-carrying portion of a bag such as a handbag, a shoulder bag, and the like, and a method for attaching the same.

BACK GROUND TECHNOLOGY

A handle attachment structure disclosed in Japanese Patent No. 4430734 (patent document 1), for example, is proposed for the hand-carrying portion of the handbag, the shoulder bag, and the like.

According to the handle attachment structure of patent document 1, the handle is formed by joining an outer handle section and an inner handle section, a distal end portion of the outer handle section being attached to a surface of a body and a distal end portion of the inner handle section being attached while being sandwiched between the body and an upper gore section, and handle excels in durability so that the bag can be used over many years.

CITED PRIOR ART DOCUMENT

Patent Document

[Patent document 1] Japanese Patent No. 4430734

Disclosure of the Invention

Problems to be Solved by the Invention

However, since the handle is attached to the upper part of the body in the handle attachment structure of patent document 1, the body and the upper gore portion are drawn closer each time the bag is lifted up, and the body may stretch.

And, the handle tends to fall outward, thereby deforming also the body.

Therefore, an object of the present invention is to provide a structure of a hand-carrying portion that less tends to fall and is capable of keeping a predetermined shape, and a method for attaching the same.

Means for Solving the Problem

The structure of the hand-carrying portion of the bag according to claim 1 of the present invention is a structure of a hand-carrying portion which is attached to a bag main body and supports a hand-carrying member, wherein the longitudinal hand-carrying member in a band shape is formed in an arch shape with a substantially C-shaped cross section by combining both longitudinal edges together, the hand-carrying member has a support member intervened between both of the longitudinal edges to raise the hand-carrying member upward from the bag main body, the support member is a longitudinal band-shaped body, and includes an overlapping region having at least an upper portion formed in an arch shape with a substantially C-shaped cross section by combining both longitudinal edges together, a support region extending downward from the overlapping region, and a fixing region formed below the support region, the support member has both of the longitudinal edges of the overlapping region intervened between both longitudinal edges of the hand-carrying member formed in the arch shape with the substantially C-shaped cross section, the support member is coupled, with the overlapping region of the support member and an overlapping region of the hand-carrying member sewed together so that a crest portion of the support member faces a crest portion of the hand-carrying member so as to be positioned oppositely thereto, the support member has the support region formed in an arch shape with a substantially C-shaped cross section or a substantially U-shaped cross section at least near the overlapping region, and is fixed to the bag main body in the fixing region below the support region, and the hand-carrying member extends downward from the fixing region of the support member fixed to the bag main body, and is fixed to the bag main body in the fixing region of the hand-carrying member.

The structure of the hand-carrying portion of the bag according to claim 2 of the present invention is the structure of the hand-carrying portion of the bag according to claim 1, wherein the support member has a plurality of band-shaped bodies laminated, with the band-shaped bodies curved in width to form the overlapping region in the arch shape with the substantially C-shaped cross section.

The structure of the hand-carrying portion of the bag according to claim 3 of the present invention is the structure of the hand-carrying portion of the bag according to claim 1 or 2, wherein the hand-carrying member includes a curved region, each overlapping region formed continuously to both ends of the curved region, bridging regions formed continuously to the overlapping regions, and fixing regions formed continuously to the bridging regions, and the curved region, the overlapping regions, and nearby portions of the bridging regions continued to the overlapping regions are formed in an arch shape with a substantially C-shaped cross section.

The structure of the hand-carrying portion of the bag according to claim 4 of the present invention is a structure of a hand-carrying portion which is attached to a bag main body and supports a hand-carrying member, wherein the longitudinal hand-carrying member in a band shape is formed in an arch shape with a substantially C-shaped cross section by combining both longitudinal edges together, the hand-carrying member has a support member intervened between both of the longitudinal edges to raise the hand-carrying member upward from the bag main body, the support member is a longitudinal band-shaped body, and includes an overlapping region having at least an upper portion formed in an arch shape with a substantially C-shaped cross section by combining both longitudinal edges together, a support region extending downward from the overlapping region, and a fixing region formed below the support region, the support member has both of the longitudinal edges of the overlapping region intervened between both longitudinal edges of the hand-carrying member formed in the arch shape with the substantially C-shaped cross section, the support member is coupled, with the overlapping region of the support member and an overlapping region of the hand-carrying member sewed together so that a crest portion of the support member faces a crest portion of the hand-carrying member so as to be positioned oppositely thereto, the support member has the support region formed in an arch shape with a substantially C-shaped cross section or a substantially U-shaped cross section at least near the overlapping region, and is fixed to the bag main body in the fixing region below the support region, and the hand-carrying member extends downward from the overlapping region, and is fixed to the bag main body in the fixing region of the hand-carrying member of a portion extending downward.

The structure of the hand-carrying portion of the bag according to claim 5 of the present invention is the structure of the hand-carrying portion of the bag according to claim 4, wherein the support member has a plurality of band-shaped bodies laminated, with the band-shaped bodies curved in width to form the overlapping region in the arch shape with the substantially C-shaped cross section.

The structure of the hand-carrying portion of the bag according to claim 6 of the present invention is the structure of the hand-carrying portion of the bag according to claim 4 or 5, wherein the support member includes the overlapping region, the support region formed continuously to the overlapping region, and the fixing region formed continuously to the support region, and the overlapping region and nearby portion of the support region continued to the overlapping region are formed in an arch shape with a substantially C-shaped cross section.

The invention according to claim 7 of the present invention is a method of attaching a hand-carrying portion of a bag, comprising:

a hand-carrying member forming step of forming a hand-carrying member by forming a curved region, one overlapping region and other overlapping region, and nearby portions of one bridging region and other bridging region continued to the overlapping regions in an arch shape with a substantially C-shaped cross section, and forming: a closing portion by curving band-shaped bodies at center in a width direction with folded portions placed inward, closing one longitudinal edge and other longitudinal edge together, and sewing the one longitudinal edge and the other longitudinal edge together so that an inner side of the one longitudinal edge and the other longitudinal edge is curved to swell to an outer direction, that is, oppositely to the folded portions; one swelled portion continued to the one longitudinal edge and other swelled portion continued to the other longitudinal edge; and a crest portion;

a support member forming step of forming a support member by forming: a closing portion by curving band-shaped bodies at center in a width direction with the band-shaped bodies placed inward, closing one longitudinal edge and other longitudinal edge together, and sewing the one longitudinal edge and the other longitudinal edge together so that an inner side of the one longitudinal edge and the other longitudinal edge is curved to swell to an outer direction, that is, to a band-shaped bodies side; one swelled portion continued to the one longitudinal edge and other swelled portion continued to the other longitudinal edge; and a crest portion of the support region with the band-shaped bodies curved at the center in the width direction;

a support member intervening step of intervening both longitudinal edges, that is, one longitudinal edge and other longitudinal edge, of the support member in the overlapping region between both of the longitudinal edges, that is, the one longitudinal edge and the other longitudinal edge, of the band-shaped bodies of the hand-carrying member in the one bridging region and the other bridging region along the one overlapping region and the other overlapping region of the support member between the one overlapping region and the other overlapping region to raise the hand-carrying member upward from the bag main body;

a support member coupling step of coupling the support member to the hand-carrying member by sewing the overlapping region of the support member and the one overlapping region and the other overlapping region of the hand-carrying member together so that the crest portion of the support member faces the crest portion of the hand-carrying member so as to be positioned oppositely thereto;

a support member fixing step of forming the support member having the support region formed in an arch shape with a substantially C-shaped cross section or a substantially U-shaped cross section at least near the over lapping region, and fixing the support member to the bag main body in a fixing region below the support region; and a hand-carrying member fixing step of extending the hand-carrying member downward from the fixing region of the support member fixed to the bag main body, and fixing the hand-carrying member to the bag main body in one fixing region and other fixing region of the hand-carrying member.

The structure of the hand-carrying portion of the bag according to claim 8 of the present invention is a structure of a hand-carrying portion which is attached to a bag main body and supports hand-carrying members, wherein the hand-carrying members are respectively attached to a front body portion and a back body portion configuring the bag main body, the hand-carrying members are longitudinal band-shaped bodies, each including a curved region, an overlapping region formed continuously to both ends of the curved region, a bridging region formed continuously to the overlapping region, and a fixing region formed continuously to the bridging region, the longitudinal hand-carrying members each in a band shape are each formed in an arch shape with a substantially C-shaped cross section by combining both longitudinal edges together in the curved region, a magnet piece is internally provided in the curved region of one hand-carrying member of the hand-carrying members attached to the front body portion and the back body portion, and a magnetic substance piece and/or magnet piece is internally provided in the curved region of the other hand-carrying member, and at least a top of the one hand-carrying member and at least a top of the other hand-carrying member, which are overlapped each other, are formed so as to be attracted and affixed to each other.

The structure of the hand-carrying portion of the bag according to claim 9 of the present invention is the structure of the hand-carrying portion of the bag according to claim 8, wherein the longitudinal hand-carrying member in a band shape is formed in an arch shape with a substantially C-shaped cross section by combining both longitudinal edges together, the hand-carrying member has a support member intervened between both of the longitudinal edges to raise the hand-carrying member upward from the bag main body, the support member is a longitudinal band-shaped body, and includes an overlapping region having at least an upper portion formed in an arch shape with a substantially C-shaped cross section by combining both longitudinal edges together, a support region extending downward from the overlapping region, and a fixing region formed below the support region, the support member has both of the longitudinal edges of the overlapping region intervened between both longitudinal edges of the hand-carrying member formed in the arch shape with the substantially C-shaped cross section, the support member is coupled, with the overlapping region of the support member and an overlapping region of the hand-carrying member sewed together so that a crest portion of the support member faces a crest portion of the hand-carrying member so as to be positioned oppositely thereto, the support member has the support region formed in an arch shape with a substantially C-shaped cross section or a substantially U-shaped cross section at least near the overlapping region, and is fixed to the bag main body in the fixing region below the support region, and the hand-carrying member extends downward from the fixing region of the support member fixed to the bag main body, and is fixed to the bag main body in the fixing region of the hand-carrying member.

The structure of the hand-carrying portion of the bag according to claim 10 of the present invention is the structure of the hand-carrying portion of the bag according to claim 8 or 9, wherein the longitudinal hand-carrying members each in a band shape are each formed by curving the band-shaped body at center in a width direction with folded portions placed inward, and closing the one longitudinal edge and the other longitudinal edge together, so that, between a curved region and a closed region, a flat surface of the magnet piece of the one hand-carrying member and a flat surface of the magnetic substance piece or magnet piece of the other hand-carrying member are internally provided so as to spread and the flat surface of the magnet piece of the one hand-carrying member and the flat surface of the magnetic substance piece or magnet piece, which are overlapped each other, are substantially parallel with each other.

Effects of the Invention

According to the structure of the hand-carrying portion of the bag of the present invention, when the bag is put down, the state of the hand-carrying portion standing upward can be kept, and a bag with its bag main body hard to lose its shape can be provided.

According to the invention of claim 2, the support member has a plurality of band-shaped bodies laminated, with the laminated band-shaped bodies curved in their width to form the overlapping region in an arch shape with a substantially C-shaped cross section. Therefore, the hand-carrying member can be raised upward.

According to the invention of claim 3, the hand-carrying member includes a curved region, each overlapping region formed continuously to both ends of the curved region, bridging regions formed continuously to the overlapping regions, and fixing regions formed continuously to the bridging regions, and the curved region, the overlapping regions, and nearby portions of the bridging regions continued to the overlapping regions are formed in an arch shape with a substantially C-shaped cross section. Therefore, the hand-carrying member is raised upward.

According to the invention of claim 4, when the bag is put down, the state of the hand-carrying portion standing upward can be kept, and a bag with its bag main body hard to lose its shape can be provided.

According to the invention of claim 5, the support member has a plurality of band-shaped bodies laminated, with the laminated band-shaped bodies curved in their width to form the overlapping region in an arch shape with a substantially C-shaped cross section. Therefore, the hand-carrying member can be raised upward.

According to the invention of claim 6, the support member includes an overlapping region, a support region formed continuously to the overlapping region, and a fixing region formed continuously to the support region, and the overlapping region and a nearby portion of the support region continued to the overlapping region are formed in an arch shape with a substantially C-shaped cross section. Therefore, the hand-carrying member is raised upward.

According to the invention of claim 7, when the bag is put down, the state of the hand-carrying portion standing upward can be kept, and a bag with its bag main body hard to lose its shape can be provided.

According to the invention of claim 8, the hand-carrying portions of the bag are hooked as being overlapped each other on the shoulder, and the bag is less prone to be slipped from the shoulder.

According to the invention of claim 9, when the bag is put down, the state of the hand-carrying portion standing upward can be kept, and a bag with its bag main body hard to lose its shape can be provided.

According to the invention of claim 10, the one hand-carrying member and the other hand-carrying member are affixed to each other as being overlapped each other and, with both being hooked on the shoulder, the one hand-carrying member is less prone to be slipped from the shoulder The above-described object and other objects, characteristics, and advantages of this invention will become more apparent from the following description of best mode for carrying out the invention with reference to the drawings.

BEST MODE FOR CARRYING OUT THE INVENTION

In the following, the structure of a hand-carrying portion of a bag of the present invention is described based on one embodiment.

Figure 1:
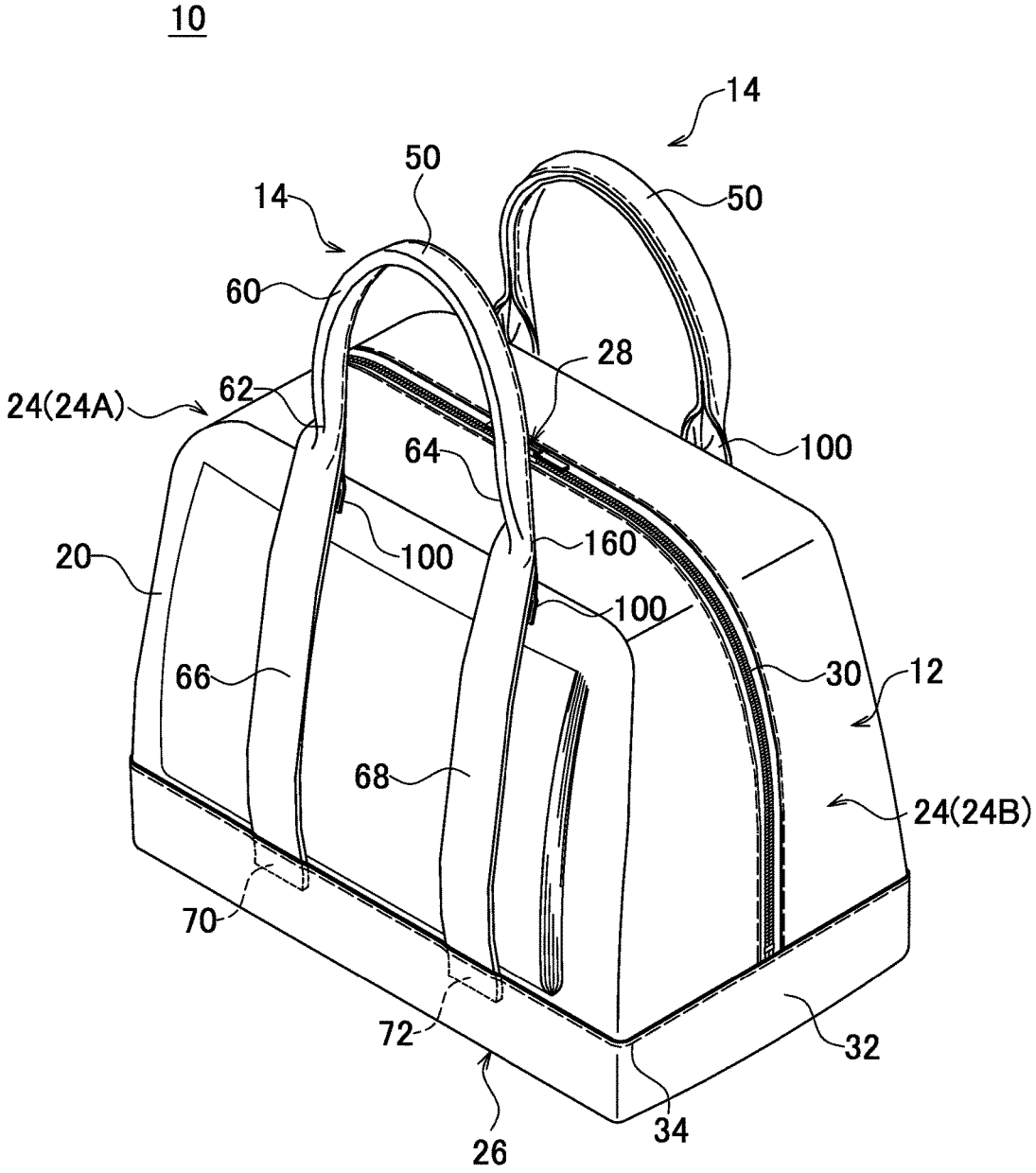
FIG. 1 is a perspective view of a bag using a structure of a hand-carrying portion of a bag according to one embodiment of the present invention.
Figure 2:
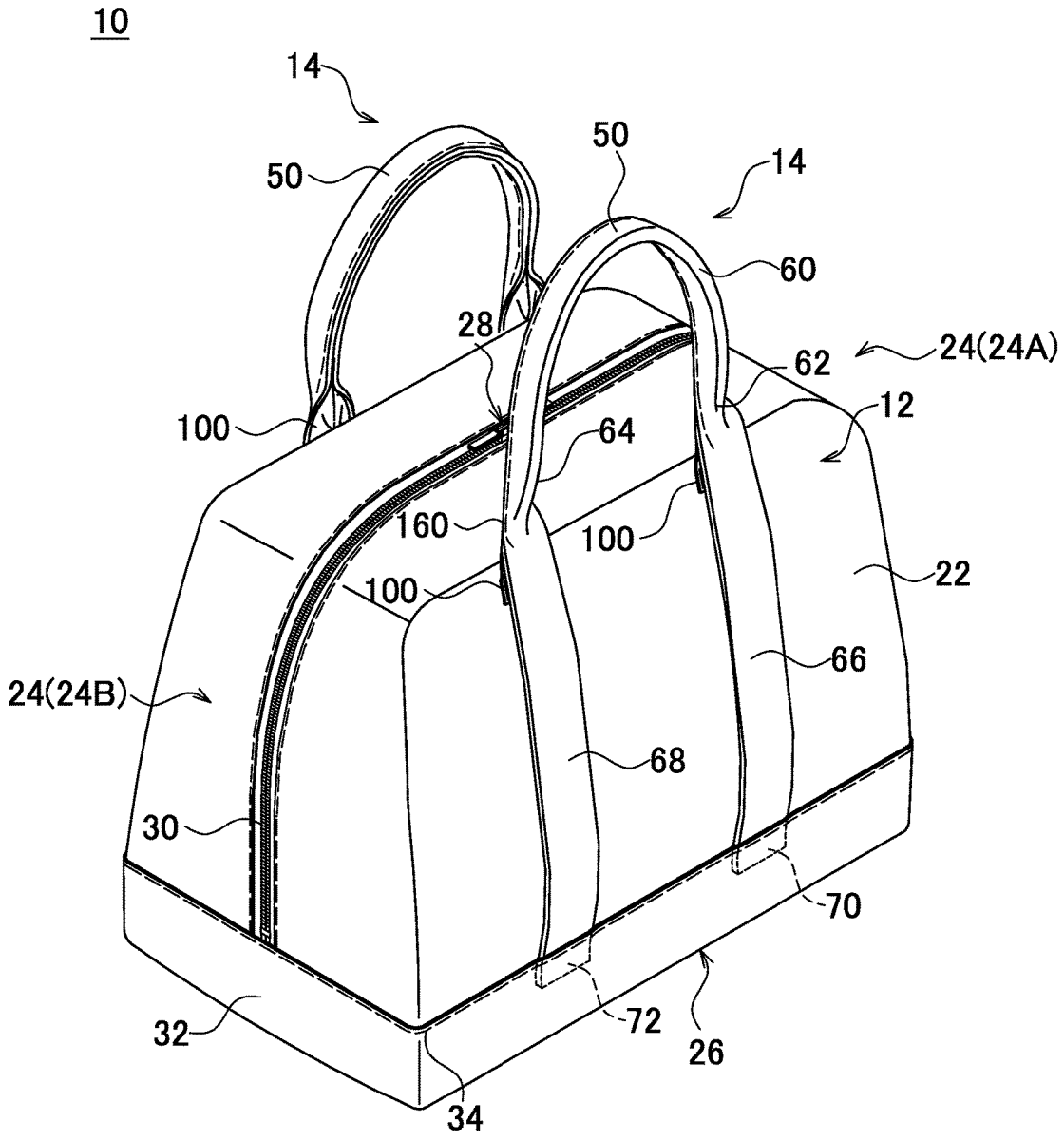
FIG. 2 is a perspective view of a rear side of the bag of FIG. 1.
Figure 3:
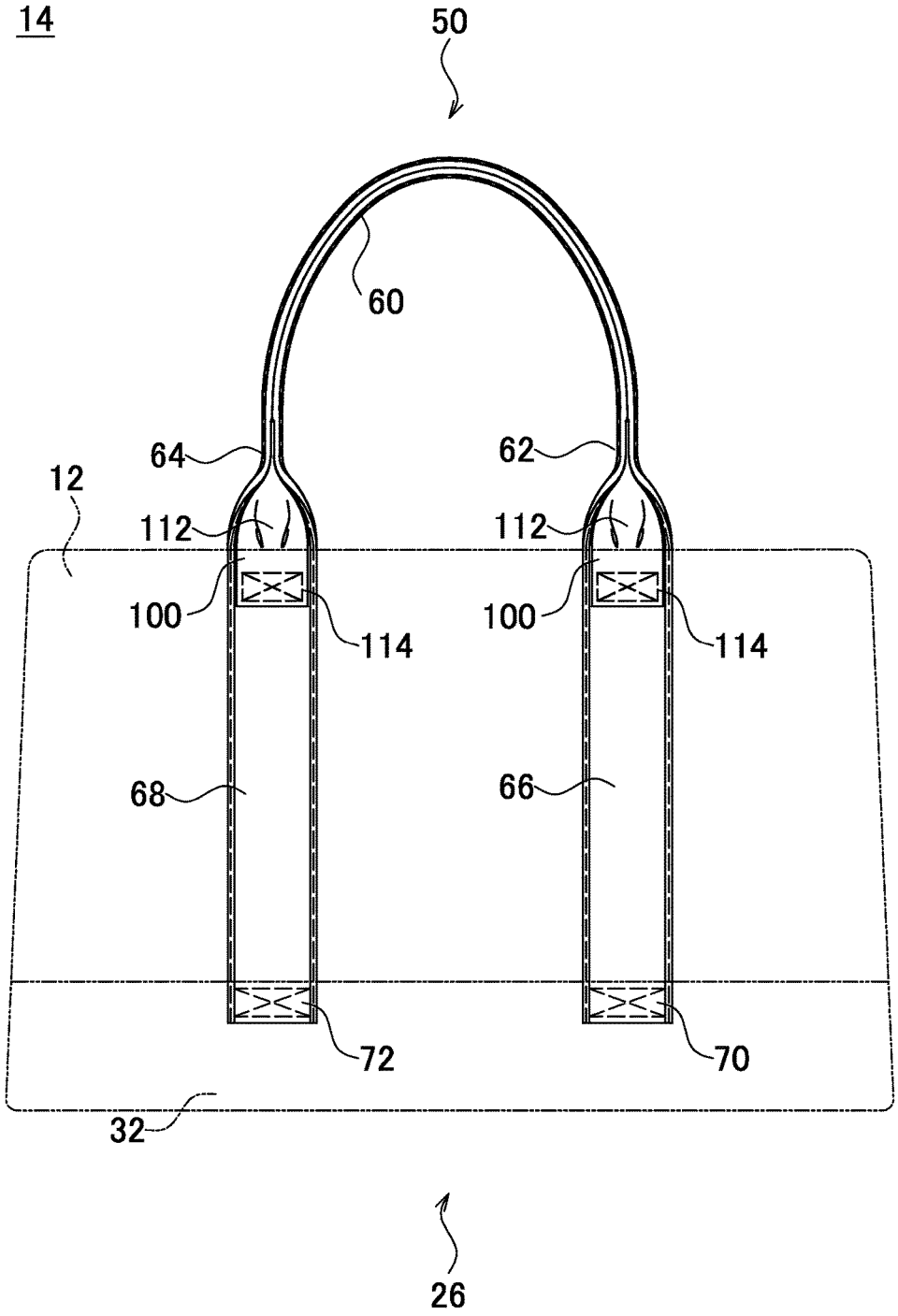
FIG. 3 is an opposite side view showing the structure of the hand-carrying portion of the bag of FIG. 1.
Figure 4:
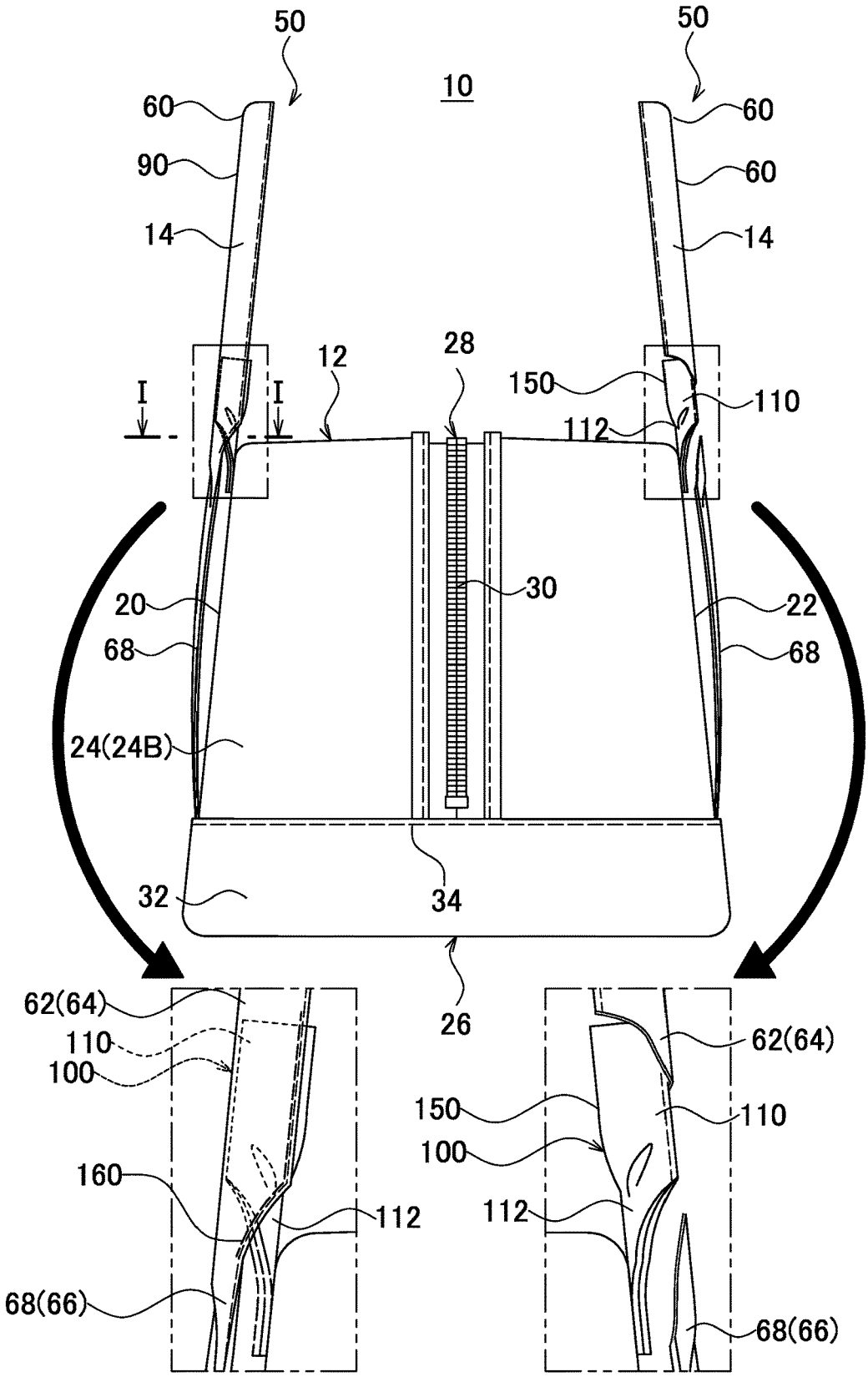
FIG. 4 is a side view showing the structure of the hand-carrying portion of the bag of FIG. 1.
Figure 5:
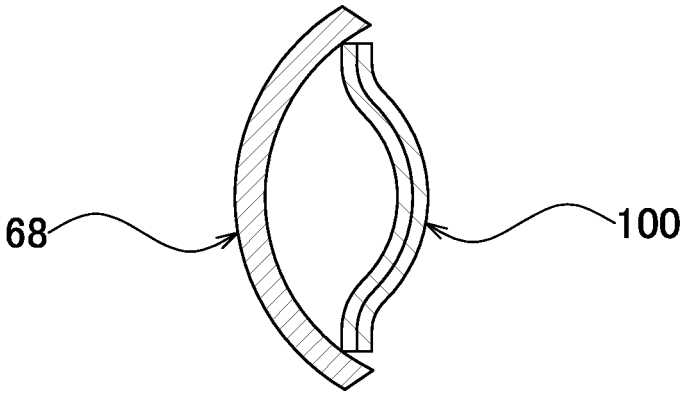
FIG. 5 is an end face view along I-I of FIG. 4.
Figure 6:
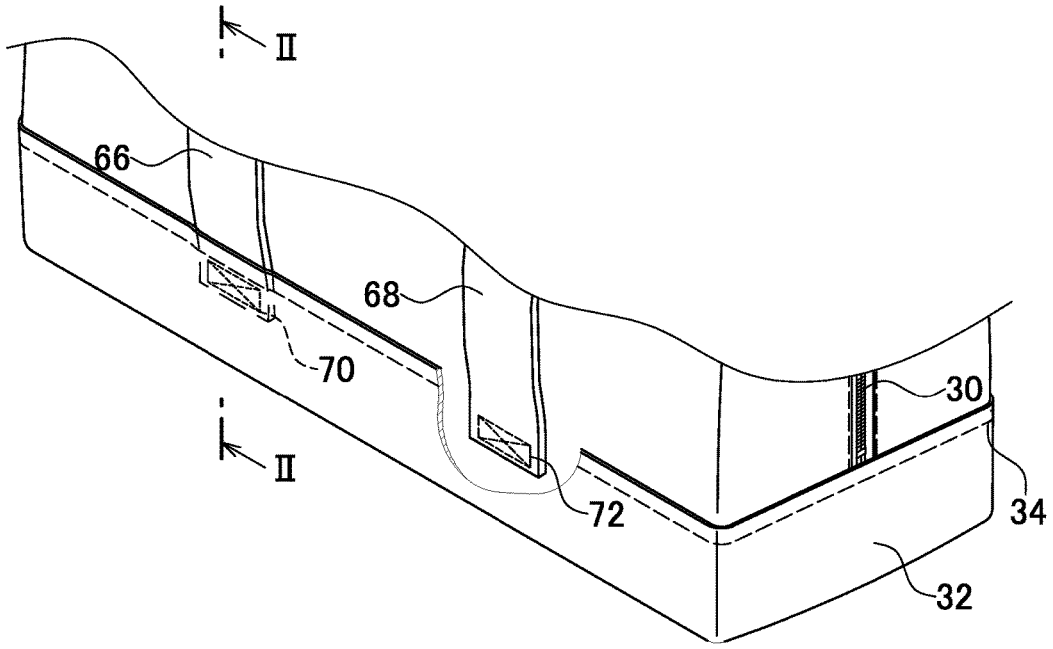
FIG. 6 is a perspective view showing the structure of the hand-carrying portion of the bag of FIG. 1.
Figure 7:
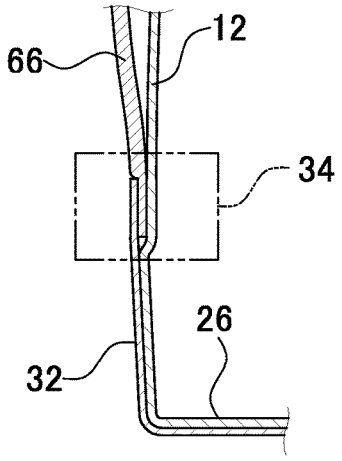
FIG. 7 is a cross-sectional view showing the structure of the hand-carrying portion of the bag of FIG. 1.
Figure 8:
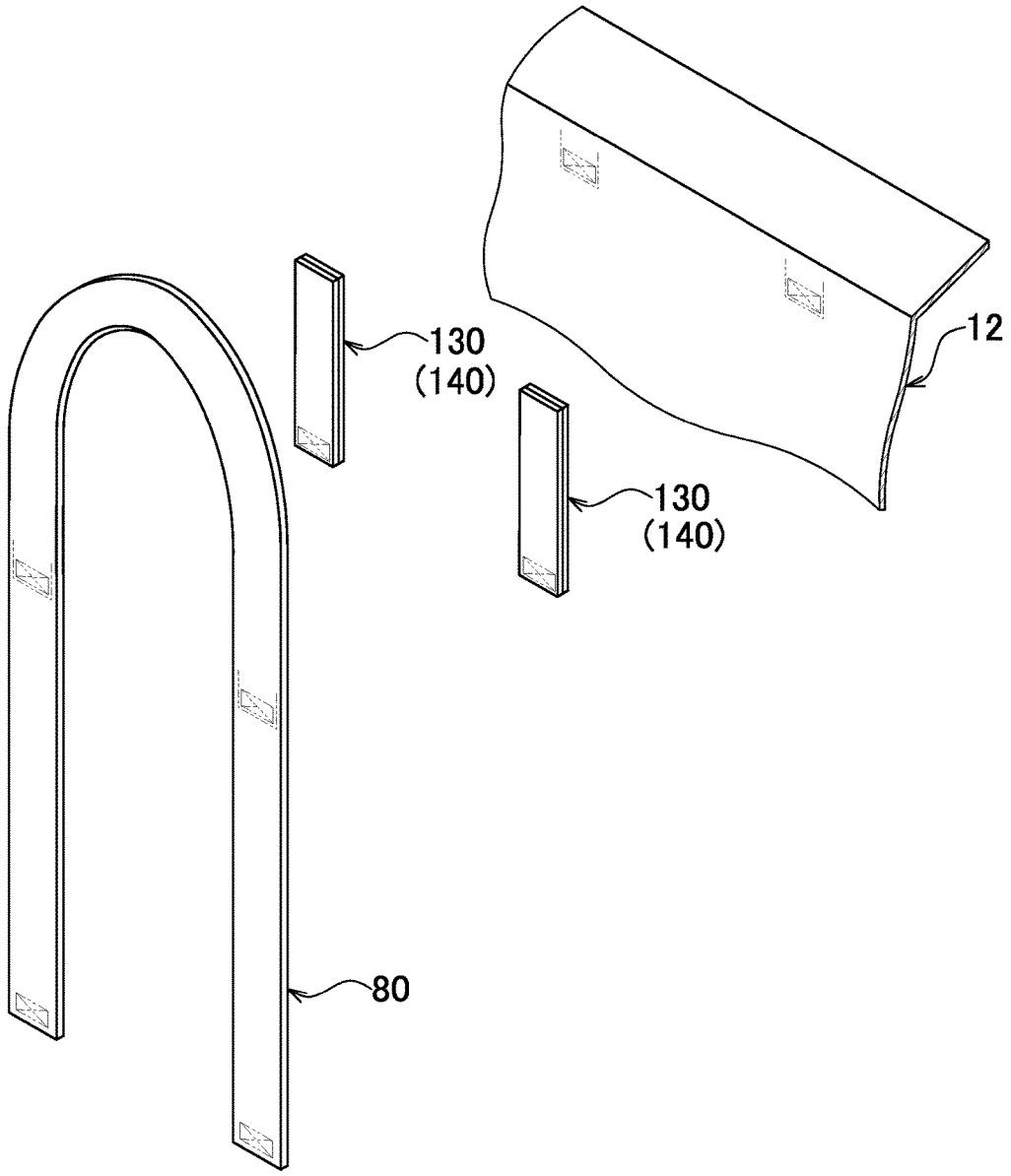
FIG. 8 is a perspective view showing a manufacturing process of the hand-carrying portion of the bag of FIG. 1.
Figure 9A:
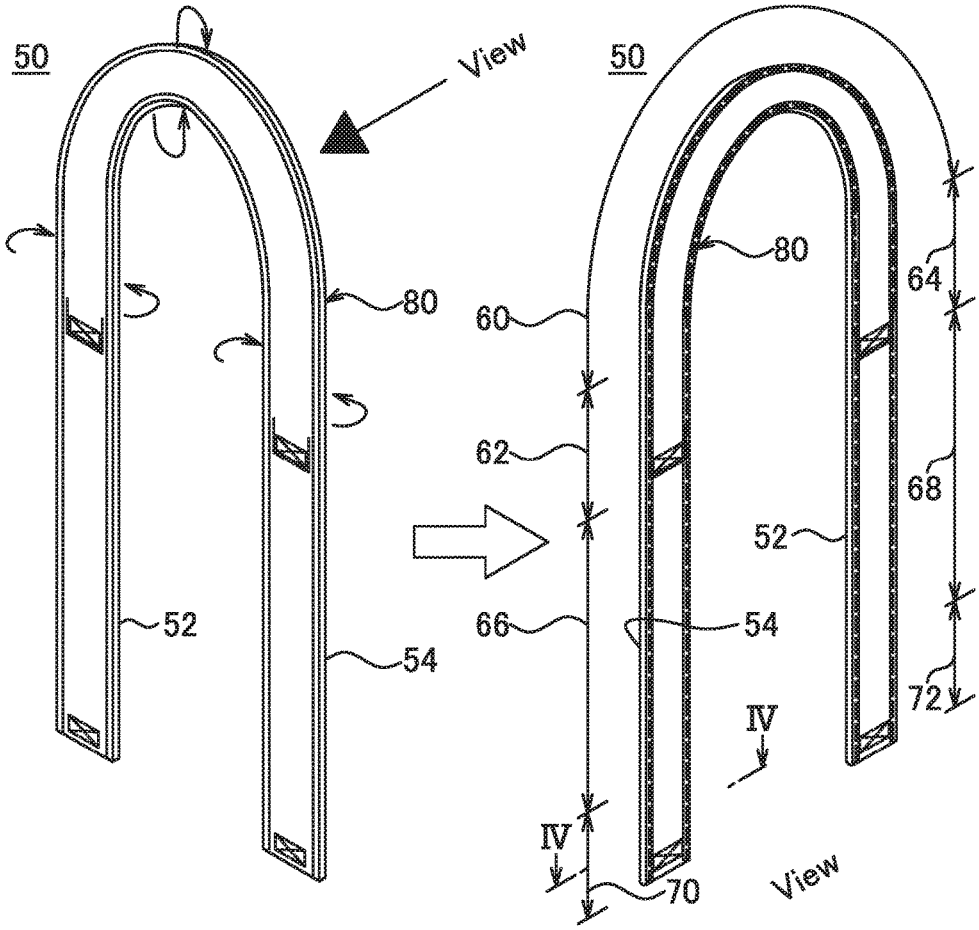
FIGS. 9*a* and 9*b* are views showing a process of manufacturing the hand-carrying portion of the bag of FIG. 1, in which 9*a* is a perspective view and 9*b* is a cross-sectional view.
Figure 9B:
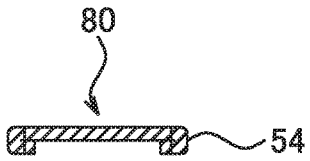
Figure 10A:
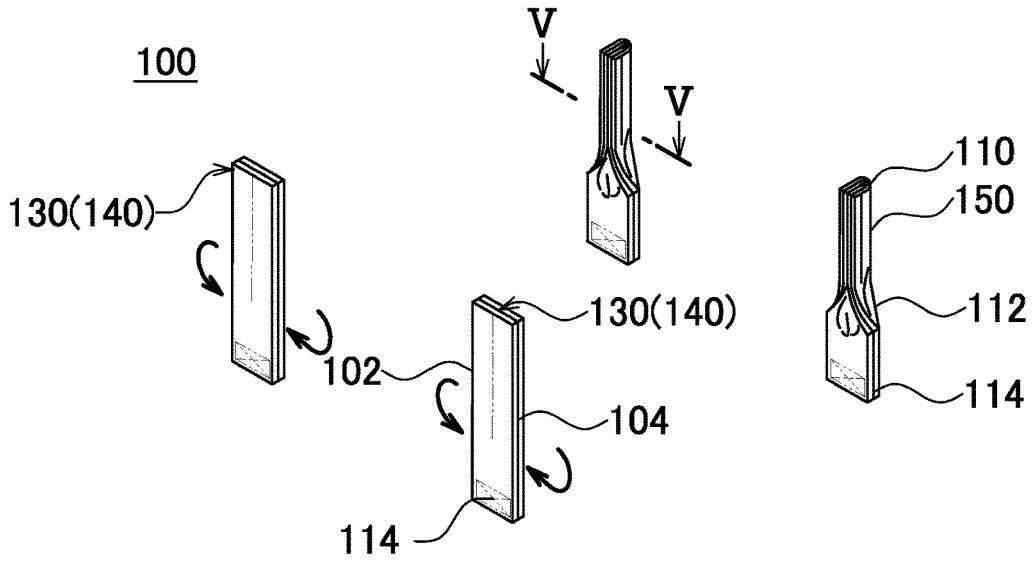
FIGS. 10*a* and 10*b* are views showing a process of manufacturing the hand-carrying portion of the bag of FIG. 1, in which 10*a* is a perspective view and 10*b* is a cross-sectional view.
Figure 10B:
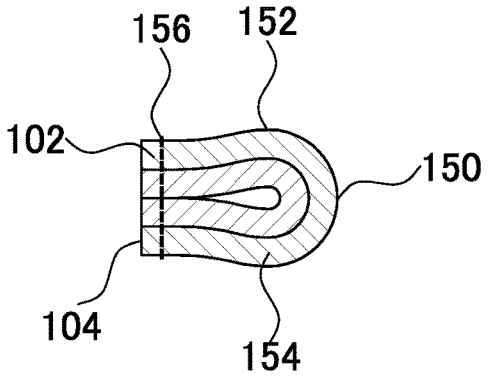
Figure 11:
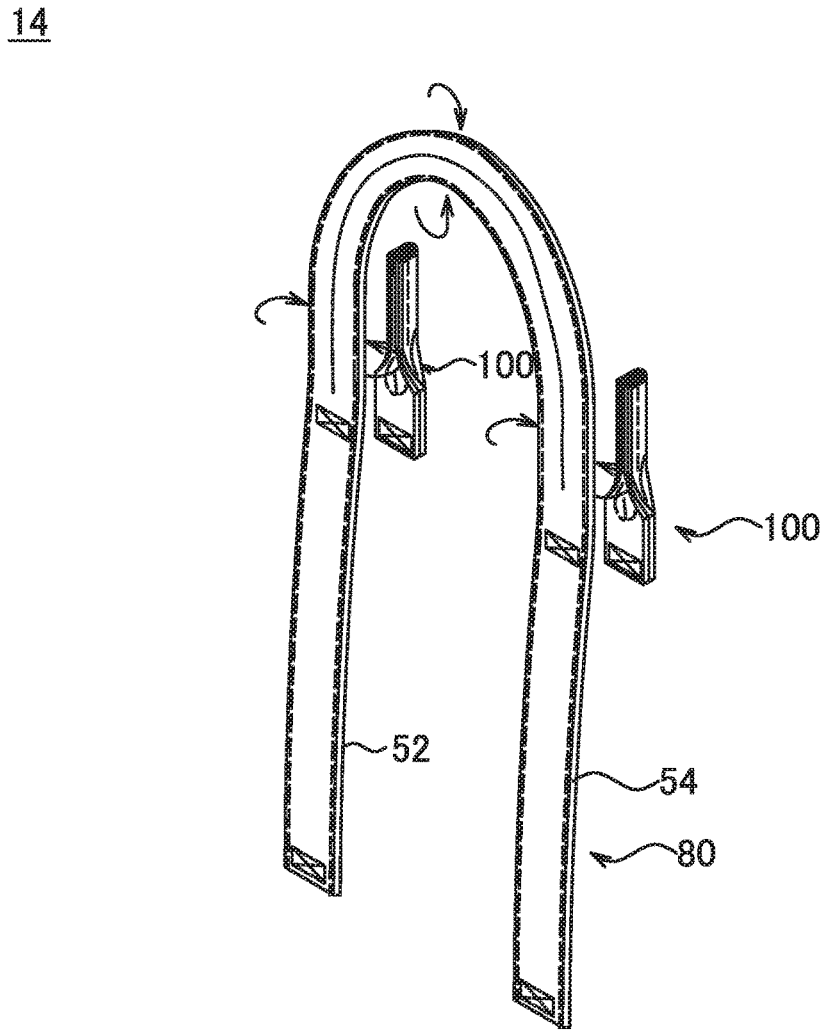
FIG. 11 is a perspective view showing a manufacturing process of the hand-carrying portion of the bag of FIG. 1.
Figure 12A:
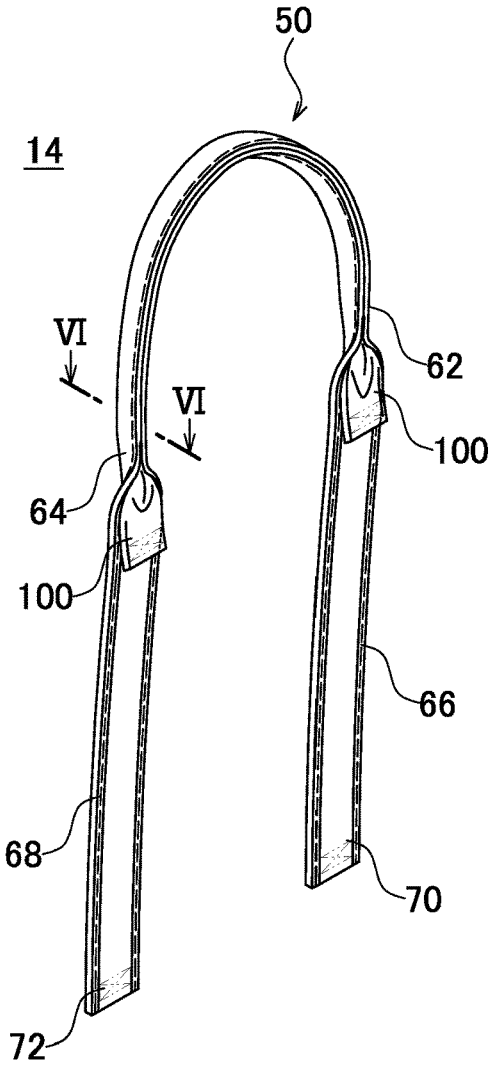
FIGS. 12*a* and 12*b* are views showing a process of manufacturing the hand-carrying portion of the bag of FIG. 1, in which 12*a* is a perspective view and 12*b* is a cross-sectional view.
Figure 12B:
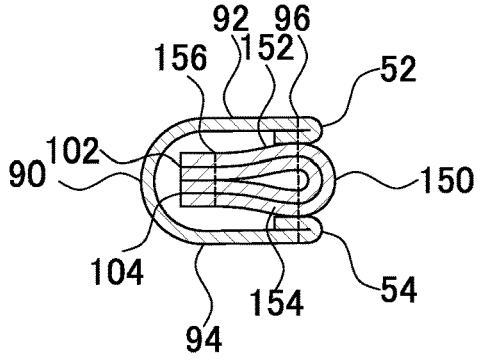
Figure 13:
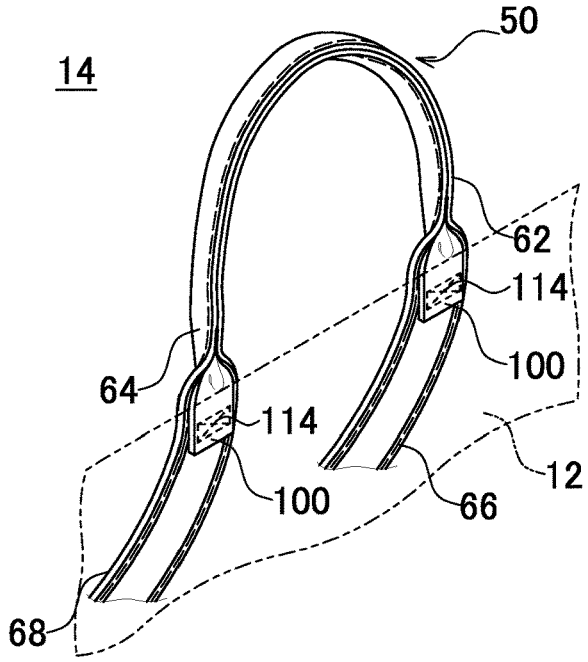
FIG. 13 is a perspective view showing a manufacturing process of the hand-carrying portion of the bag of FIG. 1.
Figure 14:
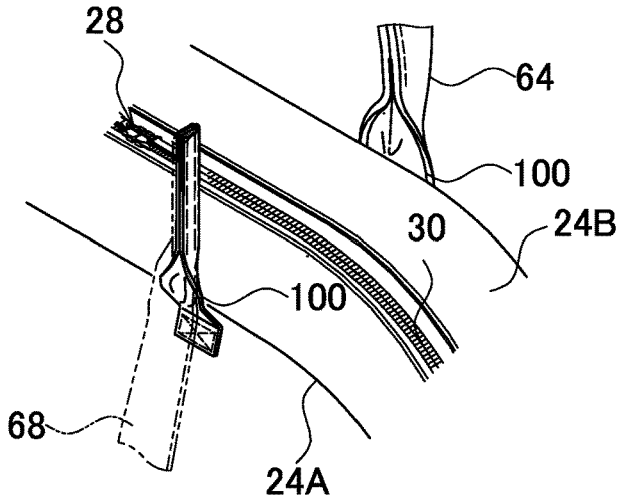
FIG. 14 is a perspective view showing a manufacturing process of the hand-carrying portion of the bag of FIG. 1.
Figure 15:
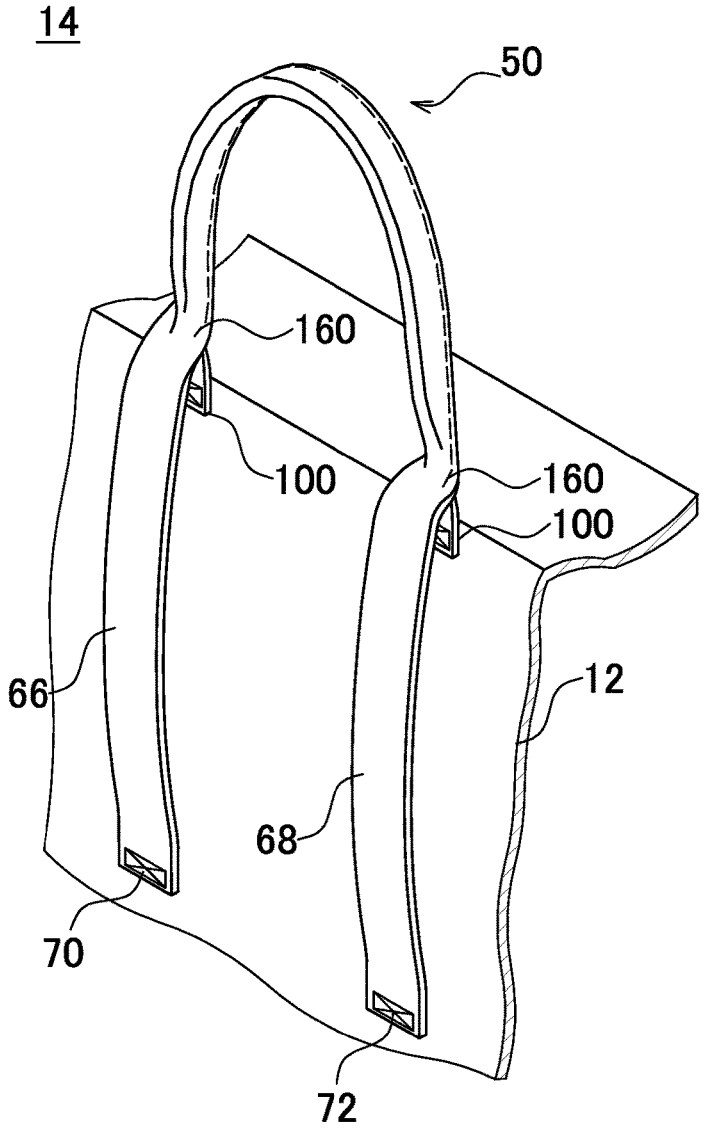
FIG. 15 is a perspective view showing the structure of the hand-carrying portion of the bag of FIG. 1.
Figure 16A:
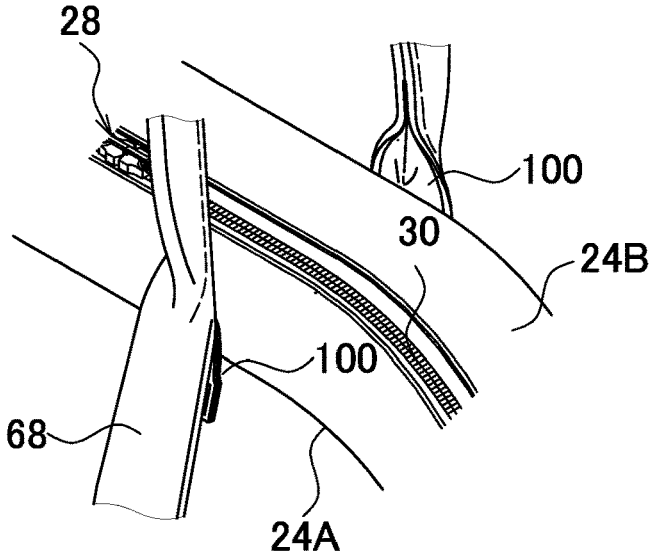
FIGS. 16*a* and 16*b* are perspective views showing the structure of the hand-carrying portion of the bag of FIG. 1.
Figure 16B:
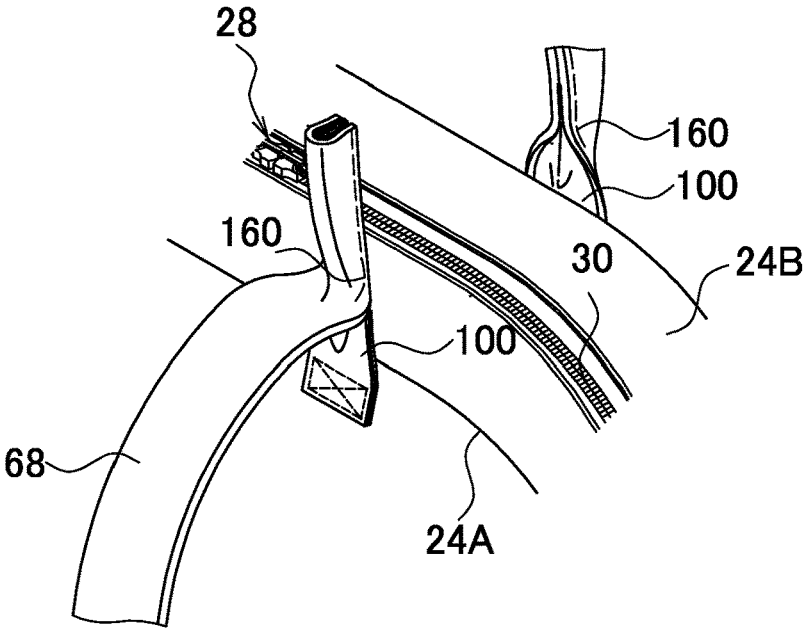
Figure 17A:
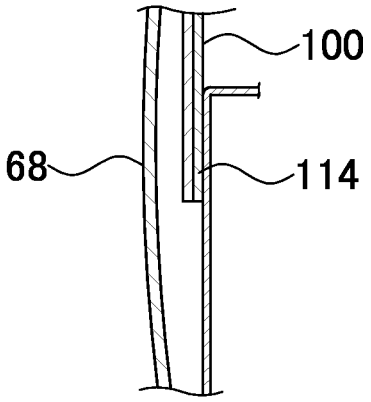
FIGS. 17*a* and 17*b* are cross-sectional views showing the structure of the hand-carrying portion of the bag of FIG. 1.
Figure 17B:
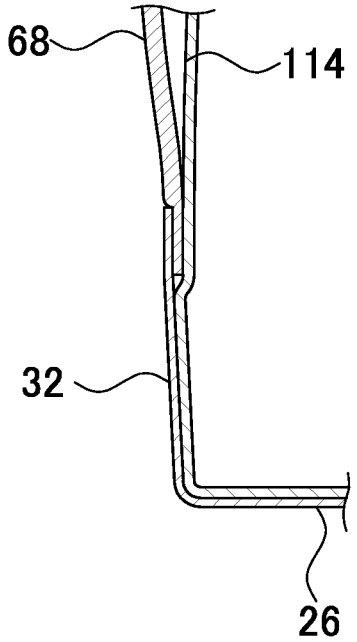
Figure 18:
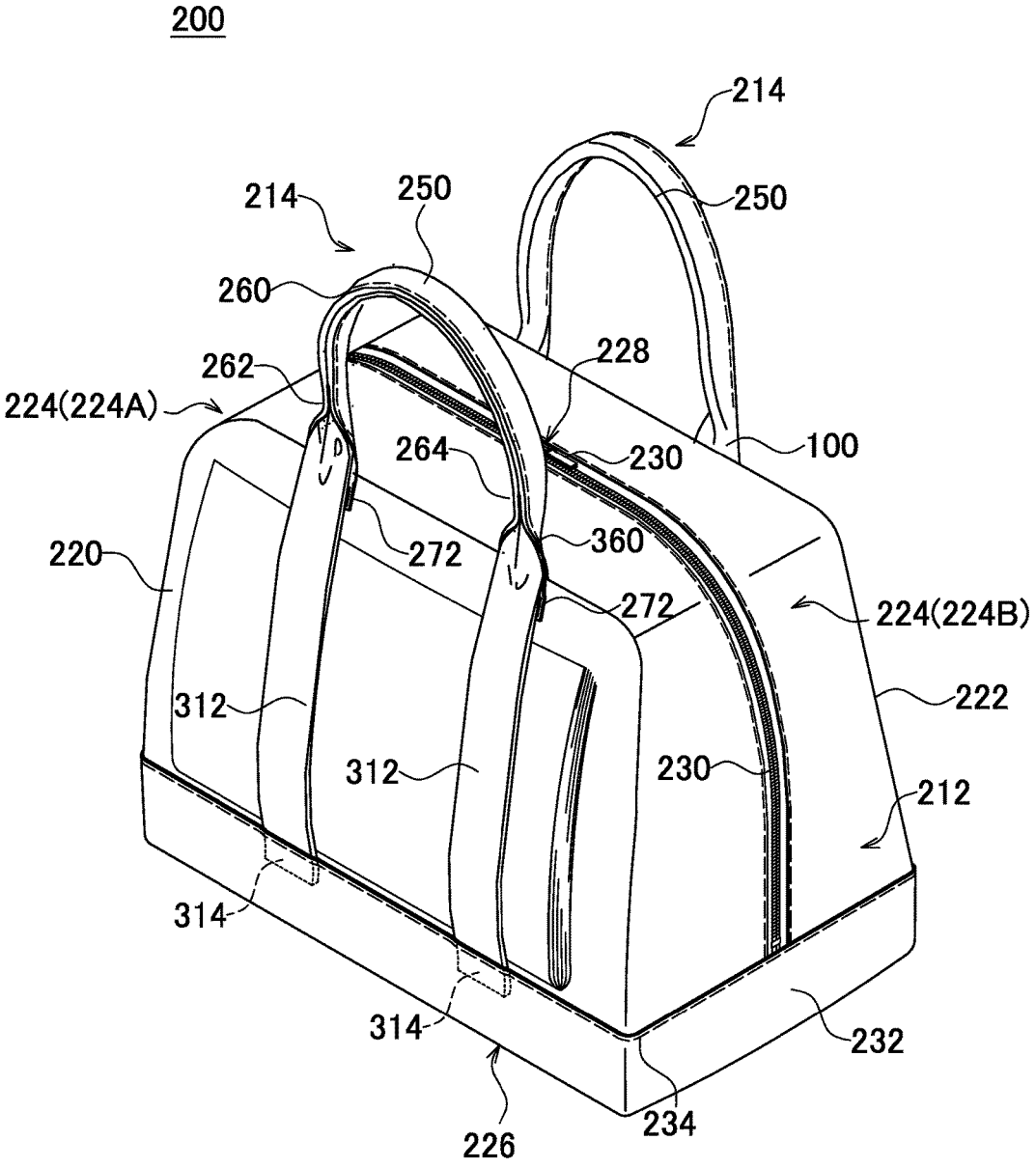
FIG. 18 is a front view of the bag using the structure of a hand-carrying portion of a bag of another embodiment of the present invention.
Figure 19:
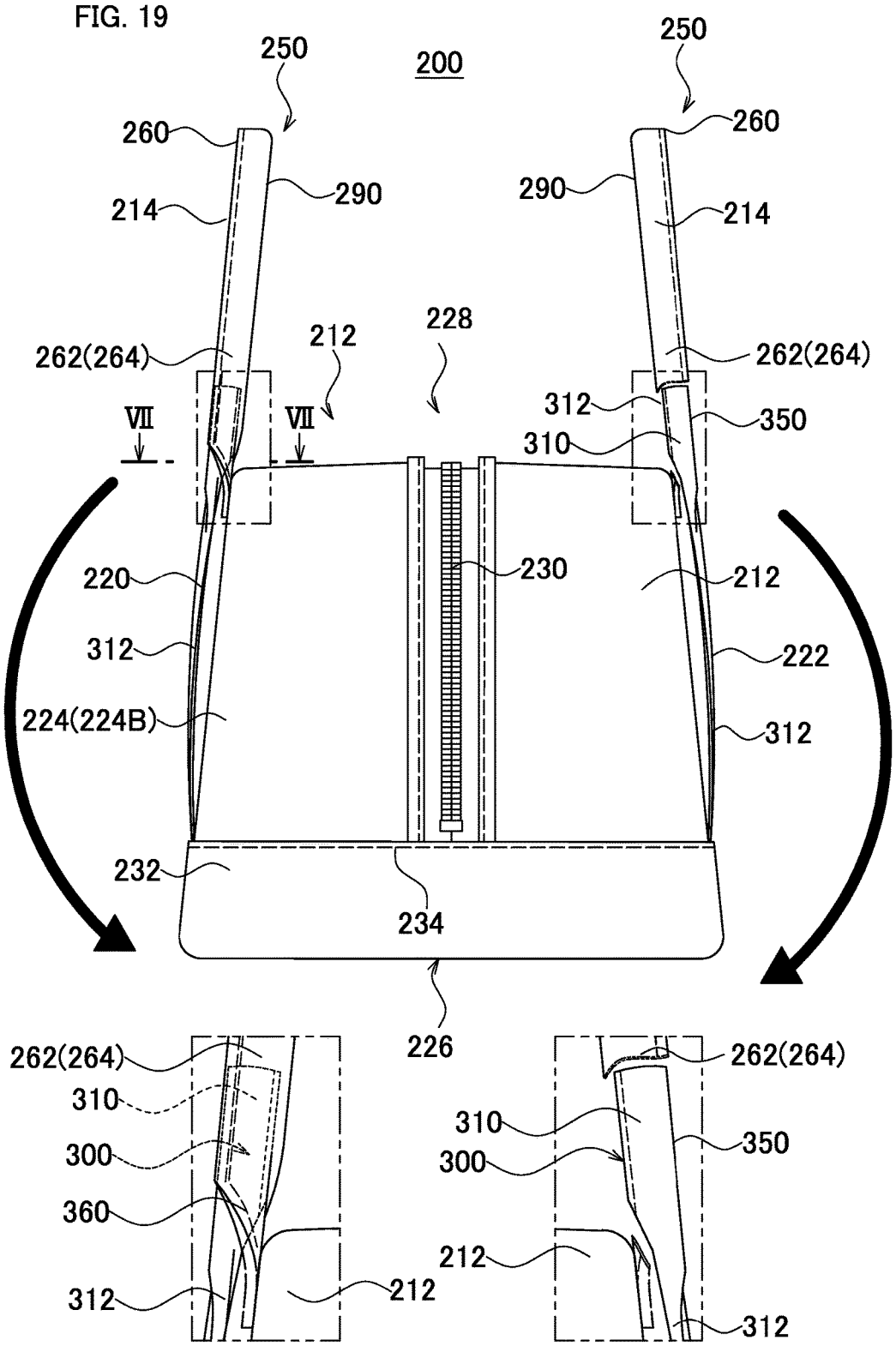
FIG. 19 is a side view of the bag using the structure of a hand-carrying portion of a bag of another embodiment of the present invention.
Figure 20:
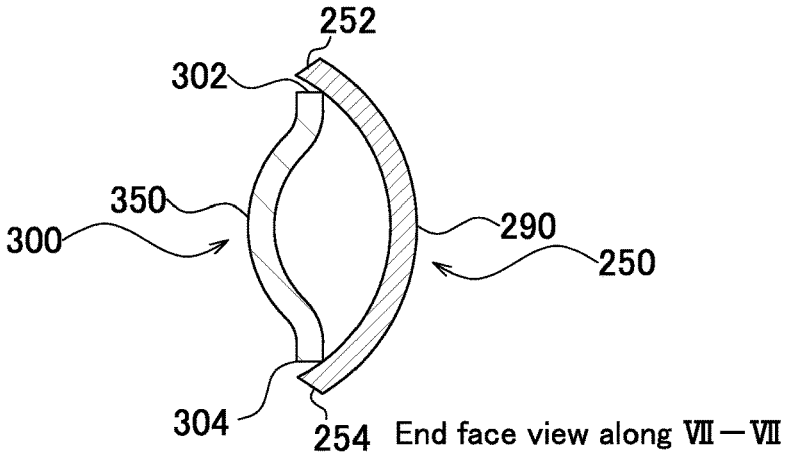
FIG. 20 is a cross-sectional view along VII-VII of FIG. 19.

FIG. 1 is a perspective view of a bag using a structure of a hand-carrying portion of a bag according to one embodiment of the present invention. FIG. 2 is a perspective view of a rear side of the bag of FIG. 1. FIG. 3 is an opposite side view showing the structure of the hand-carrying portion of the bag of FIG. 1. FIG. 4 is a side view showing the structure of the hand-carrying portion of the bag of FIG. 1. FIG. 5 is an end face view along I-I of FIG. 4. FIG. 6 is a perspective view showing the structure of the hand-carrying portion of the bag of FIG. 1. FIG. 7 is a cross-sectional view showing the structure of the hand-carrying portion of the bag of FIG. 1.

As shown in FIG. 1, the structure of the hand-carrying portion of the bag of the present invention can be used to attach a hand-carrying portion 14 to a bag main body 12 of a hand-carrying bag 10 such as an overnight bag, and the like. The structure of the hand-carrying portion of the bag of the present invention can also be used in a shoulder bag, and the like, other than the hand-carrying bag.

The bag main body 12 includes a front body portion 20, a back body portion 22 facing the front body portion 20, a gore portion 24 interposed between the front body portion 20 and the back body portion 22, and a bottom portion 26 arranged at the lower ends of the front body portion 20, the back body portion 22, and the gore portion 24.

An opening 28 between the front body portion 20 and the back body portion 22 is configured to be opened and closed with a zipper 30 provided at the open edge of the front body portion 20 and an open edge of the back body portion 22.

The gore portion 24 includes a left side gore portion 24A formed on the left side of the front body portion 20, and a right side gore portion 24B formed on the right side of the front body portion 20.

The bottom portion 26 is formed by sewing a bottom member 32 overlapped with the outer surfaces of the front body portion 20, the back body portion 22, and the gore portion 24 at the lower end edges of the front body portion 20, the back body portion 22, and the gore portion 24.

The bottom member 32 is entirely formed to a plate shape, where the peripheral edge thereof is sewed to the front body portion 20, the back body portion 22, and the gore portion 24 at a bottom member joining region 34 having a constant width.

The structure of the hand-carrying portion attached to the bag main body 12 of the present invention is applied to the hand-carrying portion 14 in which a hand-carrying region A1, which is to be carried by the person's hand, is attached to extend toward the upper side of the front body portion 20 and/or the back body portion 22 on the outer side of the bag main body 12.

The structure of the hand-carrying portion of the bag according to the present invention is a structure which supports a hand-carrying member 50 attached to the bag main body 12.

The hand-carrying member 50 includes a curved region 60, one overlapping region 62 and other overlapping region 64 formed continuously to both ends of the curved region 60, bridging regions (one bridging region 66 and other bridging region 68) formed continuously to the overlapping regions (one overlapping region 62 and other overlapping region 64), and fixing regions (one fixing region 70 and other fixing region 72) formed continuously to the one bridging region 66 and the other bridging region 68 configuring the bridging regions.

The outer hand-carrying member 50 is curved in a substantially U shape in a front view in the hand-carrying region A1.

In the outer hand-carrying member 50, the one bridging region 66 and the one fixing region 70 and the other bridging region 68 and the other fixing region 72 in an extended region which extends from the curved region 60 as divided leftward and rightward are attached with an appropriate space to the outside of the bag main body 12.

The longitudinal band-shaped hand-carrying member 50 is a linear longitudinal band-shaped body made of leather or fabric, and is formed in an arch shape with a substantially C-shaped cross section by combining both longitudinal edges, that is, one longitudinal edge 52 and other longitudinal edge 54, together.

The hand-carrying member 50 has the curved region 60, the overlapping regions (one overlapping region 62 and other overlapping region 64), and portions nearby continued to the overlapping regions of the bridging regions (one bridging region 66 and other bridging region 68) formed in an arch shape with a substantially C-shaped cross section.

The hand-carrying member 50 has a support member 100 for each of the one bridging region 66 and the other bridging region 68, the support member 100 intervened between both of the longitudinal edges, that is, between the one longitudinal edge 52 and the other longitudinal edge 54, of the band-shaped body in the one bridging region 66 and the other bridging region 68.

The support members 100 are formed so as to extend along the one overlapping region 62 and the other overlapping region 64 of the hand-carrying member 50 in order to raise the hand-carrying member 50 upward from the bag main body 12.

The support member 100 is a linear longitudinal band-shaped body made of leather or fabric, including: an overlapping region 110 having at least its upper portion formed in an arch shape with a substantially C-shaped cross section by combining both longitudinal edges (one longitudinal edge 102 and other longitudinal edge 104) together, a support region 112 extending downward from the overlapping region 110, and a fixing region 114 formed below the support region 112.

The support member 100 has both longitudinal edges, that is, the one longitudinal edge 102 and the other longitudinal edge 104, of the overlapping region 110 intervened between both longitudinal edges, that is, the one longitudinal edge 52 and the other longitudinal edge 54, of the hand-carrying member 50 formed in an arch shape with a substantially C-shaped cross section.

The support member 100 is coupled, with the overlapping region 110 of the support member 100 and the overlapping region (one overlapping region 62 and other overlapping region 64) of the hand-carrying member 50 sewed together so that a crest portion 150 of the support member 100 faces a crest portion 90 of the hand-carrying member 50 so as to be positioned oppositely thereto.

The support member 100 has the support region 112 formed in an arch shape with a substantially C-shaped cross section or a substantially U-shaped cross section at least near the overlapping region 110, and is fixed to the bag main body 12 in the fixing region 114 below the support region 112.

The hand-carrying member 50 extends downward from the fixing regions 114 of the support members 100 fixed to the bag main body 12, and is fixed to the bag main body 12 in the fixing regions (one fixing region 70 and other fixing region 72) of the hand-carrying member 50.

The support member 100 has a plurality of band-shaped bodies 130 and band-shaped bodies 140 laminated, with the laminated band-shaped bodies 130 and band-shaped bodies 140 curved in their width to form the overlapping region 110 in an arch shape with a substantially C-shaped cross section.

The band-shaped bodies 130 and band-shaped bodies 140 are formed by folding portions near both band-shaped longitudinal edges made of leather or fabric inward and bonding folded portions together.

The band-shaped bodies 130 and band-shaped bodies 140 are configured so that the folded portions face each other to be laminated together to form one support member 100.

The support member 100 has formed therein: a closing portion 156 formed by curving the band-shaped bodies 130 and band-shaped bodies 140 at the center in a width direction with the band-shaped bodies 140 placed inward, closing the one longitudinal edge 102 and the other longitudinal edge 104 together, and sewing the one longitudinal edge 102 and the other longitudinal edge 104 together so that an inner side of the one longitudinal edge 102 and the other longitudinal edge 104 is curved to swell to an outer direction, that is, to a band-shaped bodies 130 side; a swelled portion 152 and a swelled portion 154 continued to the one longitudinal edge 102 and the other longitudinal edge 102; and the crest portion 150 of the support region 112 with the band-shaped bodies 130 and band-shaped bodies 140 curved at the center in the width direction.

The hand-carrying member 50 is formed by folding a band-shaped body 80 made of leather or fabric so that portions near both longitudinal edges made of band-shaped leather or fabric overlap each other inward, and bonding folded portions together.

The band-shaped body 80 is configured so that the folded portions face each other to be laminated together to form one hand-carrying member 50.

The hand-carrying member 50 has formed therein: a closing portion 96 formed by curving the band-shaped body 80 at the center in a width direction with the folded portions placed inward, closing the one longitudinal edge 52 and the other longitudinal edge 54 together, and sewing the one longitudinal edge 52 and the other longitudinal edge 54 together so that an inner side of the one longitudinal edge 52 and the other longitudinal edge 54 is curved to swell to an outer direction, that is, oppositely to the folded portions; a swelled portion 92 and a swelled portion 94 continued to the one longitudinal edge 52 and the other longitudinal edge 54; and the crest portion 90.

The outer hand-carrying member 50 and the inner support member 100 have different lengths, and the outer hand-carrying member 50 is longer than the inner support member 100.

The hand-carrying member 50 and the inner support member 100 have a substantially same width.

The outer hand-carrying member 50 is curved at a portion near the center in the width direction of the band-shaped body 80 in the overlapped regions, that is, the one overlapping region 62 and the other overlapping region 64 of the hand-carrying member 50 and the overlapping regions 110 of the support members 100.

The one overlapping region 62 and the other overlapping region 64 of the outer hand-carrying member 50 swell toward outside of the bag main body 12.

The support members 100 are curved at portions near the center in the width direction of the band-shaped bodies 130 in the overlapped regions, that is, the one overlapping region 62 and the other overlapping region 64 of the hand-carrying member 50 and the overlapping regions 110 of the support members 100.

The overlapping regions 110 of the support members 100 swell toward a bag main body 12 side.

In the support member 100, the closing portion 156 of the band-shaped bodies 130 and band-shaped bodies 140 in the overlapping region 110 is inserted from a space between the one longitudinal edge 52 and the other longitudinal edge 54 in the one overlapping region 62 (and other overlapping region 64) of the hand-carrying member 50 toward the inside of the crest portion 90 of the hand-carrying member 50, and the overlapping region 110 of the support member 100 and the one overlapping region 62 (and other overlapping region 64) of the hand-carrying member 50 are overlapped each other.

The one longitudinal edge 52 and the other longitudinal edge 54 in the one overlapping region 62 (and other overlapping region 64) of the hand-carrying member 50 reach near the crest portion 150 in the overlapping region 110 of the support member 100.

In the outer hand-carrying member 50 and the inner support member 100, in a region where the closing portion 96 of the band-shaped body 80 and the crest portion 150 of the band-shaped bodies 130 and band-shaped bodies 140 are overlapped each other, a portion near the longitudinal edges (one longitudinal edge 52 and other longitudinal edge 54) of the outer hand-carrying member 50 and a portion near the crest portion 150 of the inner one support member 100 are sewed together to form a sewing portion 160.

In the sewing portion 160, in an overlapping region between the one overlapping region 62 of the hand-carrying member 50 and the overlapping region 110 of the support member 100 and an overlapping region between the other overlapping region 64 of the hand-carrying member 50 and the overlapping region 110 of the support member 100 extending from the hand-carrying region A1, a portion near the one longitudinal edge 52 and the other overlapping region 64 of the hand-carrying member 50 and the crest portion 150 of the support member 100 are sewed together along the one longitudinal edge 52 and the other longitudinal edge 54 of the hand-carrying member 50.

The support region 112 of the support member 100 is located between the overlapping region 110 and the fixing region 114 where the inner support member 100 is attached to the surface of the bag main body 12. The support region 112 is formed with the band-shaped bodies 130 and band-shaped bodies 140 curved at the center in the width direction, without the support region 112 portion being sewed.

The inner support members 100 have the overlapping regions 110 at one end attached to the one overlapping region 62 and the other overlapping region 64 of the hand-carrying member 50, and have the fixing regions 114 at the other end attached to the outer surface of the bag main body 12.

In this embodiment, the inner support members 100 have the overlapping regions 110 at one end sewed to the one overlapping region 62 and the other overlapping region 64 of the hand-carrying member 50 near the left side gore portion 24A (right side gore portion 24B) configuring the gore portion 24 near the opening 28 of the front body portion 20, and also have the fixing regions 114 at the other end sewed to portions near the right side gore portion 24B configuring the gore portion 24 near the opening 28 of the front body portion 20.

In a flat state of the long band-shaped bodies (band-shaped bodies 130 and band-shaped bodies 140) configuring the inner support member 100, a back surface side of the fixing region 114 is made in contact with and sewed to the outer surface of the bag main body 12.

In the inner support member 100, the support region 112, which is a non-joining region A4 not in contact with the outer hand-carrying member 50 and the bag main body 12, is formed between the overlapping region 110 and the one overlapping region 62 and the other overlapping region 64 of the outer hand-carrying member 50.

The inner support member 100 is in a mode of the band-shaped bodies 130 and band-shaped bodies 140 in which the long band-shaped bodies configuring the inner support member 100 are in a flat state on a side near the fixing region 114 in a non-sewing region A2 not sewed to the outer hand-carrying member 50.

The outer hand-carrying member 50 is curved in a U shape in a front view in the hand-carrying region A1.

The outer hand-carrying member 50 is attached to the outside of the bag main body 12 with an appropriate space from the outer surface of the bag main body 12 in an extended region extending from the one overlapping region 62 and the other overlapping region 64 overlapped with the inner support members 100 to a bottom direction of the bag main body 12.

In the outer hand-carrying member 50, in the one bridging region 66 and the other bridging region 68, which are extended regions extending from the one overlapping region 62 and the other overlapping region 64 in a joining region A3 joined to the inner support members 100, the non-sewing region A2 not sewed to the support member 100 and the bag main body 12 is formed to a position joined to the bag main body 12.

The outer hand-carrying member 50 is in a mode of a band-shaped body in which the long band-shaped body 80 configuring the outer hand-carrying member 50 is in a flat state at a part (a portion on one end and the other end sides below the one overlapping region 62 and the other overlapping region 64) of the non-sewing region A2 not sewed to the inner support members 100.

The one fixing region 70 and the other fixing region 72 in the extended region of the outer hand-carrying member 50 are inserted between the bottom member 32 and the bag main body 12 from an edge of a joining region of the bottom member 32 joined to the bag main body 12, and are attached to the outer surface of the bag main body 12 and/or the inner surface of the bag main body 12.

In this embodiment, the outer hand-carrying member 50 has the one fixing region 70 at one end sewed over the front body portion 20 and the bottom member 32 in the bottom member joining region 34 between the bottom member 32 and the front body portion 20 near the left side gore portion 24A.

Specifically, when the bottom member 32 and the front body portion 20 are sewed together in the bottom member joining region 34, the one fixing region 70 at one end of the outer hand-carrying member 50 interposed between the front body portion 20 and the bottom member 32 is attached by sewing.

Furthermore, the other fixing region 72 at the other end is sewed over the front body portion 20 and the bottom member 32 in the bottom member joining region 34 between the bottom member 32 and the front body portion 20 near the right side gore portion 24B.

Specifically, when the bottom member 32 and the front body portion 20 are sewed together in the bottom member joining region 34, the other fixing region 72 at the other end of the outer hand-carrying member 50 interposed between the front body portion 20 and the bottom member 32 is attached by sewing.

The outer hand-carrying member 50 has a region configuring the one fixing region 70 and the other fixing region 72 sewed with a back surface side of the long band-shaped member 80 configuring the outer hand-carrying member 50 in a flat state in contact with the outer surface of the bag main body 12.

In the outer hand-carrying member 50, in a extended region of the outer hand-carrying member 50 extending from the one overlapping region 62 and the other overlapping region 64 in the sewed joining region A3, a non-joining region A4 not joined to the one fixing region 70 and the other fixing region 72 of the inner hand-carrying member 50 is formed.

The outer hand-carrying member 50 is in a mode of a band-shaped body in which the long band-shaped body 80 configuring the outer hand-carrying member 50 is in a flat state in the non-joining region A4 not sewed to the inner support members 100 and the bag main body 12.

In the non-joining region A4, which is an extended region of the outer hand-carrying member 50, the one bridging region 66 and the other bridging region 68 are formed for nipping an article in a space between their inner side and the outer surface of the bag main body 12.

Next, a method of attaching the hand-carrying portion of the bag is described mainly based on FIG. 8 to FIG. 13.

The longitudinal band-shaped body 80 made of leather or fabric to form the longitudinal band-shaped hand-carrying member 50 is prepared.

The hand-carrying member 50 is formed by folding the band-shaped body 80 made of leather or fabric so that portions near both longitudinal edges made of band-shaped leather or fabric overlap each other inward, and bonding folded portions together.

The band-shaped body 80 is configured so that the folded portions face each other to be laminated to form one hand-carrying member 50.

The band-shaped body 80 is formed in an arch shape with a substantially C-shaped cross section by combining both of the longitudinal edges, that is, the one longitudinal edge 52 and the other longitudinal edge 54, together.

The hand-carrying member 50 has the curved region 60, the overlapping regions (the one overlapping region 62 and the other overlapping region 64), and portions nearby continued to the overlapping regions of the bridging regions (one bridging region 66 and the other bridging region 68) formed in an arch shape with a substantially C-shaped cross section.

The curved region 60 and the other overlapping region 64 are sewed together near the one longitudinal edge 52 and the other longitudinal edge 54.

The hand-carrying member 50 has formed therein: the closing portion 96 formed by curving the band-shaped body 80 at the center in the width direction with the folded portions placed inward, closing the one longitudinal edge 52 and the other longitudinal edge 54 together, and sewing the one longitudinal edge 52 and the other longitudinal edge 54 together so that an inner side of the one longitudinal edge 52 and the other longitudinal edge 54 is curved to swell to an outer direction, that is, oppositely to the folded portions; the swelled portion 92 and the swelled portion 94 continued to the one longitudinal edge 52 and the other longitudinal edge 54; and the crest portion 90 (hand-carrying member forming step).

Next, the support member 100 is intervened for each of the one bridging region 66 and the other bridging region 68 in each of both longitudinal edges, that is, the one longitudinal edge 52 and the other longitudinal edge 54, of the band-shaped body in the one bridging region 66 and the other bridging region 68 of the hand-carrying member 50.

The support members 100 are intervened in the one overlapping region 62 and the other overlapping region 64 along the one overlapping region 62 and the other overlapping region 64 of the hand-carrying member 50 in order to raise the hand-carrying member 50 upward from the bag main body 12 (support member intervening step).

The longitudinal band-shaped bodies 130 and 140 made of leather or fabric forming the support members 100 include the overlapping region 110 having at least an upper portion formed in an arch shape with a substantially C-shaped cross section by combining both longitudinal edges (one longitudinal edge 102 and other longitudinal edge 104) together, the support region 112 extending downward from the overlapping region 110, and the fixing region 114 formed below the support region 112.

In the support members 100, both longitudinal edges, that is, the one longitudinal edge 102 and the other longitudinal edge 104, of the overlapping region 110, are intervened in both longitudinal edges, that is, the one longitudinal edge 52 and the other longitudinal edge 54, of the hand-carrying member 50 formed in an arch shape with a substantially C-shaped cross section.

The overlapping region 110 of the support member 100 and the overlapping region (one overlapping region 62 and other overlapping region 64) of the hand-carrying member 50 are sewed together so that the crest portion 150 of the support member 100 faces the crest portion 90 of the hand-carrying member 50 so as to be positioned oppositely thereto, thereby coupling the support member 100 to the hand-carrying member 50 (support member coupling step).

The band-shaped bodies 130 and band-shaped bodies 140 are formed by folding portions near both band-shape longitudinal edges made of leather or fabric inward and bonding folded portion together.

The band-shaped bodies 130 and band-shaped bodies 140 are configured so that the folded portions face each other to be laminated together to form one support member 100.

The support member 100 has formed therein: the closing portion 156 formed by curving the band-shaped bodies 130 and band-shaped bodies 140 at the center in the width direction with the band-shaped bodies 140 placed inward, closing the one longitudinal edge 102 and the other longitudinal edge 104 together, and sewing the one longitudinal edge 102 and the other longitudinal edge 104 together so that an inner side of the one longitudinal edge 102 and the other longitudinal edge 104 is curved to swell to the outer direction, that is, to the band-shaped bodies 130 side; the swelled portion 152 and the swelled portion 154 continued to the one longitudinal edge 102 and the other longitudinal edge 104; and the crest portion 150 of the support region 112 with the band-shaped bodies 130 and band-shaped bodies 140 curved at the center in the width direction (support member forming step).

For the outer hand-carrying member 50 and the inner support member 100, in a region where the closing portion 96 of the band-shaped body 80 and the crest portion 150 of band-shaped bodies 130 and band-shaped bodies 140 are overlapped each other, a portion near the longitudinal edge (one longitudinal edge 52 and other longitudinal edge 54) of the outer hand-carrying member 50 and a portion near the crest portion 150 of the inner one support member 100 are sewed together to form the sewing portion 160.

In an overlapping region between the one overlapping region 62 of the hand-carrying member 50 and the overlapping region 110 of the support member 100 and an overlapping region between the other overlapping region 64 of the hand-carrying member 50 and the overlapping region 110 of the support member 100 extending from the hand-carrying region A1, a portion near the one longitudinal edge 52 and the other overlapping region 64 of the hand-carrying member 50 and the crest portion 150 of the support member 100 are sewed together along the one longitudinal edge 52 and the other longitudinal edge 54 of the hand-carrying member 50 to form the sewing portion 160.

Next, the support member 100 is formed so that the support region 112 has an arch shape with a substantially C-shaped or substantially U-shaped cross section at least near the overlapping region 110, and the fixing region 114 below the support region 112 is fixed to the bag main body 12 (support member fixing step).

Next, the hand-carrying member 50 extends downward from the fixing region 114 of the support members 100 fixed to the bag main body 12, and is fixed to the bag main body 12 in the fixing regions (one fixing region 70 and other fixing region 72) of the hand-carrying member 50 (hand-carrying member fixing step).

The support region 112 of the support member 100 is located between the overlapping region 110 and the fixing region 114 where the inner support member 100 is attached to the surface of the bag main body 12. The support region 112 is formed with the band-shaped bodies 130 and band-shaped-bodies 140 curved at the center in the width direction, without the support region 112 portion being sewed.

The overlapping regions 110 at one end of the inner support members 100 are attached to the one overlapping region 62 and the other overlapping region 64 of the hand-carrying members 50, and the fixing regions 114 at the other end are attached to the outer surface of the back main body 12.

In this embodiment, the overlapping regions 110 at one end of the inner support members 100 are sewed to the one overlapping region 62 and the other overlapping region 64 of the hand-carrying member 50 near the left side gore portion 24A (right side gore portion 24B) configuring the gore portion 24 near the opening 28 of the front body portion 20, and also the fixing regions 114 at the other end are sewed to portions near the right side gore portion 24B configuring the gore portion 24 near the opening 28 of the front body portion 20.

The back surface side of the fixing regions 114 in a flat state of the long band-shaped bodies (band-shaped bodies 130 and band-shaped bodies 140) configuring the inner support member 100 is made in contact with and sewed to the outer surface of the bag main body 12.

In this manner, the bag including the structure of the hand-carrying portion 14 of the bag of the present invention can be formed.

Figure 23:
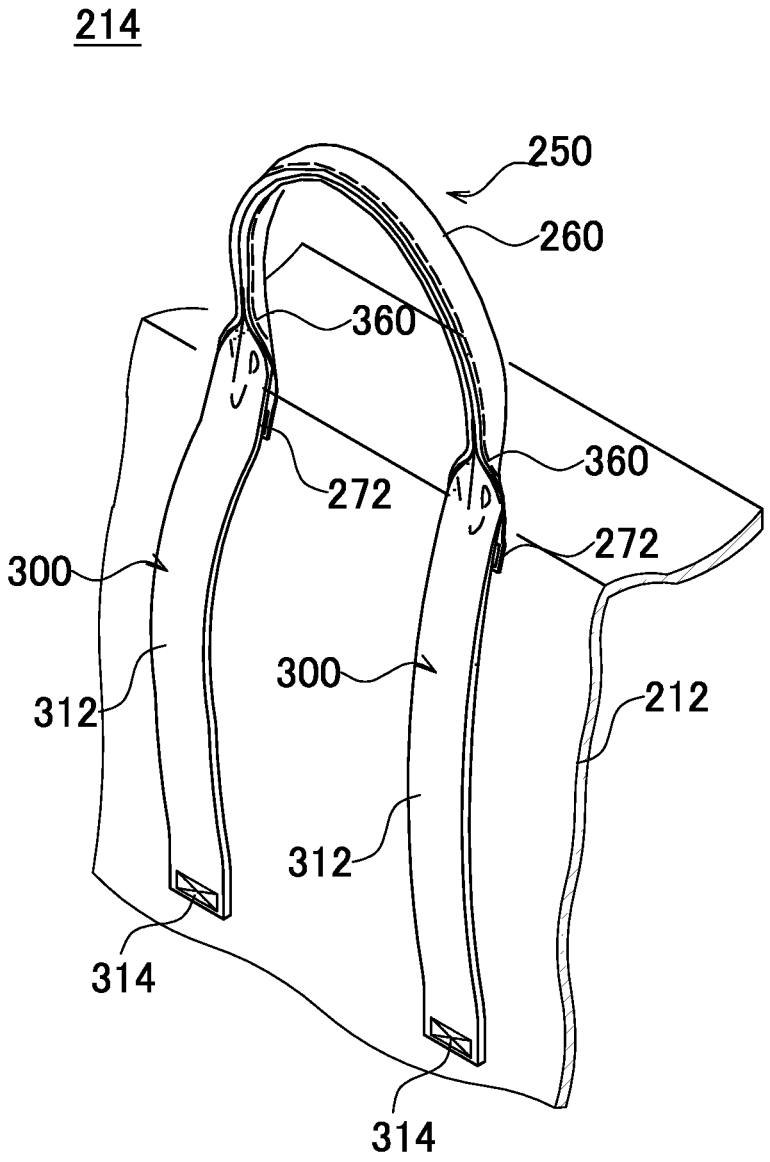
FIG. 23 is a partially-enlarged perspective view with a portion near the hand-carrying portion of the bag of FIG. 18 enlarged.
Figure 24:
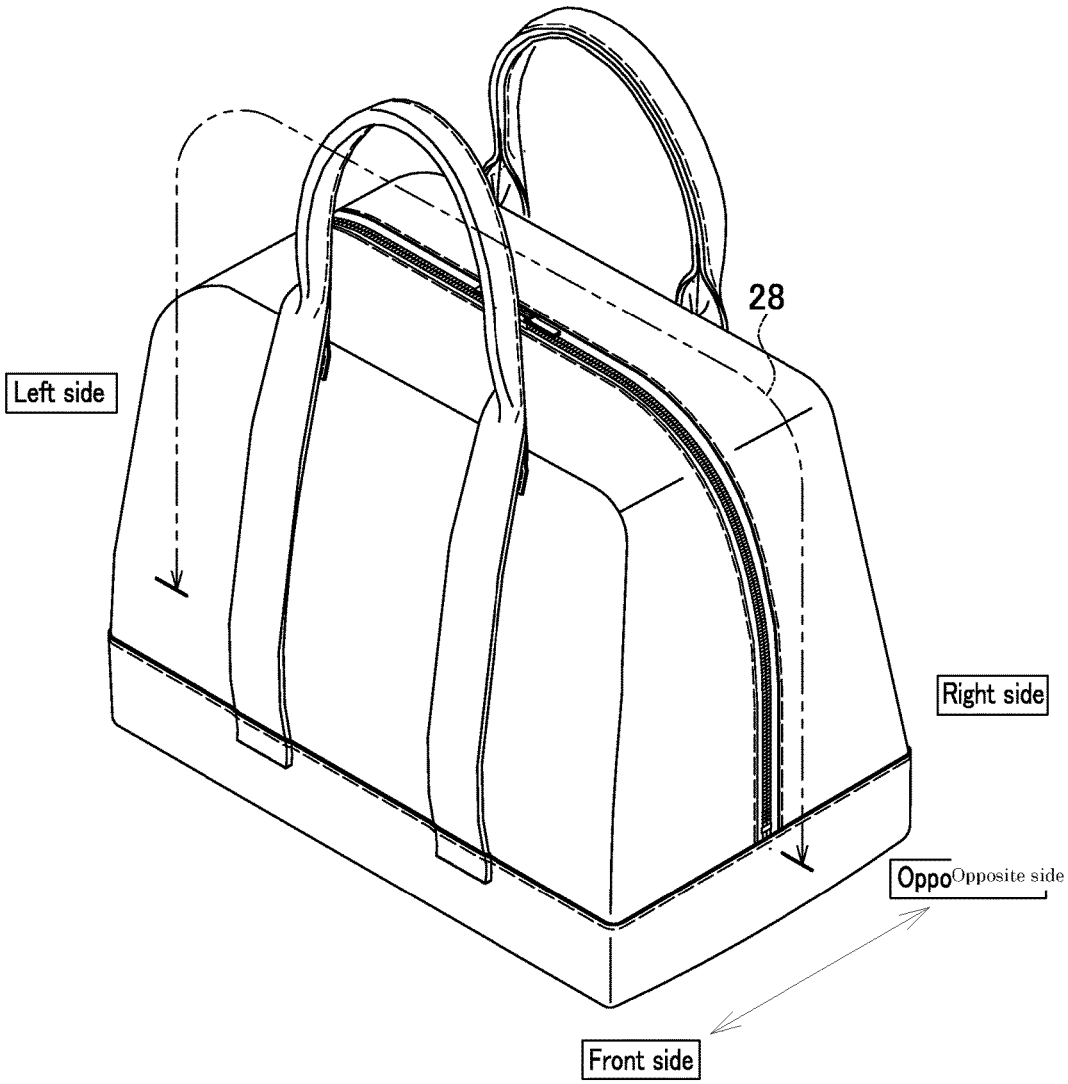
FIG. 24 is a diagram for describing the bag according to the present invention.
Figure 25:
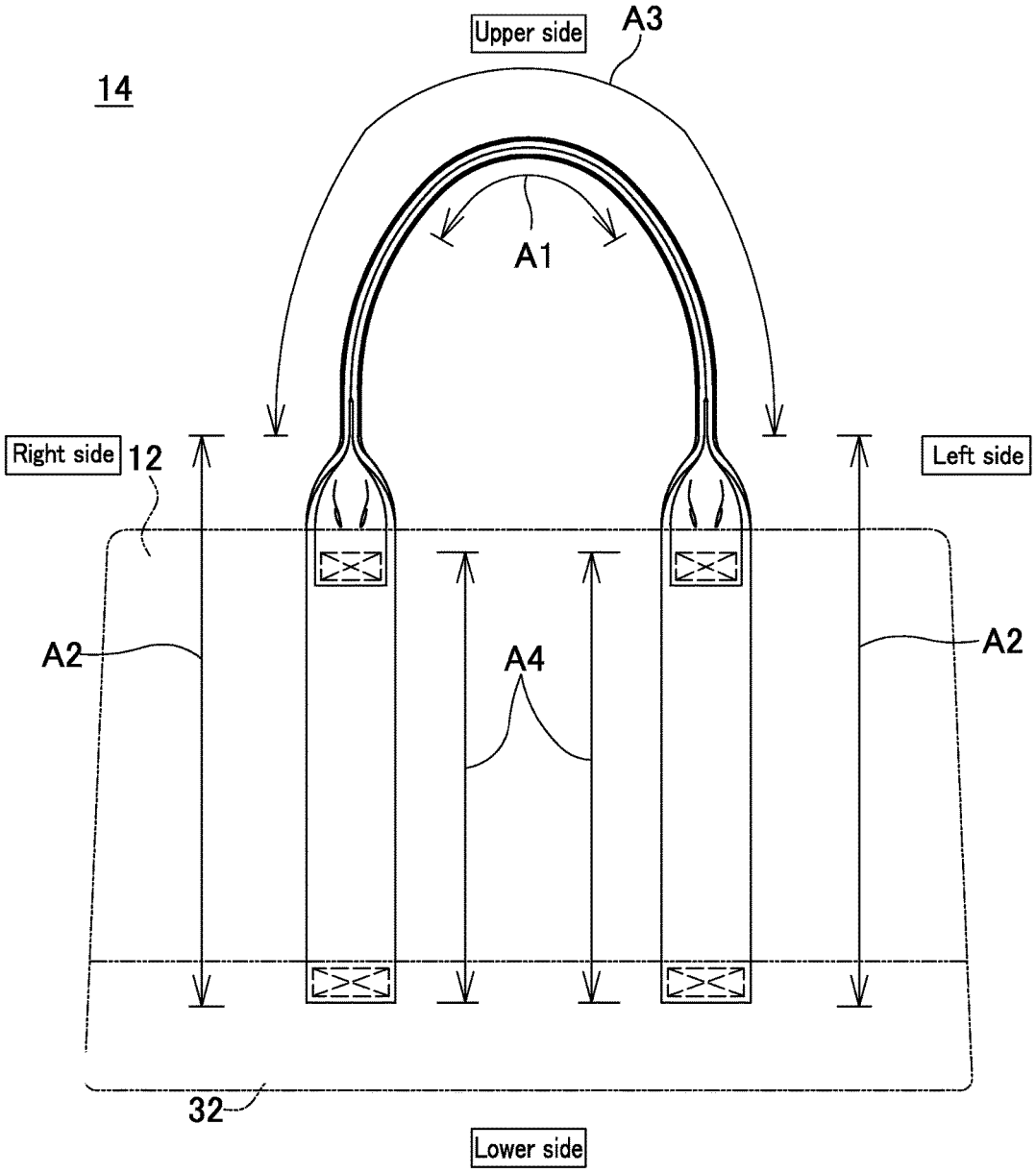
FIG. 25 is a diagram for describing the bag according to the present invention.

Next, the structure of a hand-carrying portion of a bag in another embodiment of the present invention is described mainly based on FIG. 23 to FIG. 25.

In the structure of the hand-carrying portion attached to a bag main body 212 to support a hand-carrying member 250, the longitudinal band-shaped hand-carrying member 250 is formed in an arch shape with a substantially C-shaped cross section by combining both longitudinal edges (one longitudinal edge 252 and other longitudinal edge 254) together.

The hand-carrying member 250 has support members 300 intervened therein for raising the hand-carrying member 250 upward from the bag main body 212.

The hand-carrying member 250 is positioned on a bag main body 212 side, and the support members 300 are positioned outside the hand-carrying member 250 oppositely to the hand-carrying portion 214 of the embodiment described above.

Also, compared with the hand-carrying portion 214 of the embodiment described above, the hand-carrying member 250 is shorter and, conversely, the support members 300 are longer.

The support member 300 is a longitudinal band-shaped body 330(340), and includes an overlapping region 310 having at least its upper portion formed in an arch shape with a substantially C-shaped cross section by combining both longitudinal edges together, a support region 312 extending downward from the overlapping region 310, and a fixing region 314 formed below the support region 312.

The support member 300 has both longitudinal edges of the overlapping region 310 intervened between both longitudinal edges (one longitudinal edge 252 and other longitudinal edge 254) of the hand-carrying member 250 formed in an arch shape with a substantially C-shaped cross section.

The support member 300 is coupled, with the overlapping region 310 of the support member 300 and overlapping region (one overlapping region 262 and other overlapping region 264) of the hand-carrying member 250 sewed together so that a crest portion 350 of the support member 300 faces a crest portion 290 of the hand-carrying member 250 so as to be positioned oppositely thereto.

The support member 300 has the support region 312 formed in an arch shape with a substantially C-shaped cross section or a substantially U-shaped cross section at least near the overlapping region 310, and is fixed to the bag main body 212 in the fixing region 314 below the support region 312.

The support region 312 of the support member 300 extends long in a height direction of the bag main body 212.

The hand-carrying member 250 extends downward from the overlapping regions (one overlapping region 262 and other overlapping region 264), and is fixed to the bag main body 212 in the fixing region of the hand-carrying member 250 of the portion extending downward.

The hand-carrying member 250 has one bridging region 266 and other bridging region 268 each having a short length so as to be fixed with one fixing region 270 and other fixing region 272 of lower portions in upper portions of the bag main body 212.

A bag main body 212 includes a front body portion 220, a back body portion 222 facing the front body portion 220, a gore portion 224 interposed between the front body portion 220 and the back body portion 222, and a bottom portion 226 arranged at the lower ends of the front body portion 220, the back body portion 222, and the gore portion 224.

An opening 228 between the front body portion 220 and the back body portion 222 is configured to be opened and closed with a zipper 230 provided at the open edge of the front body portion 220 and an open edge of the back body portion 222.

The gore portion 224 includes a left side gore portion 224A formed on the left side of the front body portion 220, and a right side gore portion 224B formed on the right side of the front body portion 220.

The bottom portion 226 is formed by sewing a bottom member 232 overlapped with the outer surfaces of the front body portion 220, the back body portion 222, and the gore portion 224 at the lower end edges of the front body portion 220, the back body portion 222, and the gore portion 224.

The bottom member 232 is entirely formed to a plate shape, where the peripheral edge thereof is sewed to the front body portion 220, the back body portion 222, and the gore portion 224 in a bottom member joining region 234 having a constant width.

The hand-carrying member 250 includes a curved region 260, one overlapping region 262 and other overlapping region 264 formed continuously to both ends of the curved region 260, bridging regions (one bridging region 266 and other bridging region 268) formed continuously to the overlapping regions (one overlapping region 262 and other overlapping region 264), and fixing regions (one fixing region 270 and other fixing region 272) formed continuously to the one bridging region 266 and the other bridging region 268 configuring the bridging regions.

The inner hand-carrying member 250 is curved in a substantially U shape in a front view in the hand-carrying region A1.

In the hand-carrying member 250, the one bridging region 266 and the one fixing region 270 and the other bridging region 268 and the other fixing region 272 in an extended region which extends from the curved region 260 as divided leftward and rightward are attached with an appropriate space to the outside of an upper portion of the bag main body 212.

The hand-carrying member 250 has a support member 300 for each of the one bridging region 266 and the other bridging region 268, the support member 300 intervened between both longitudinal edges, that is, between the one longitudinal edge 252 and the other longitudinal edge 254, of the band-shaped body in the one bridging region 266 and the other bridging region 268.

The support members 300 are formed so as to extend along the one overlapping region 262 and the other overlapping region 264 of the hand-carrying member 250 in order to raise the hand-carrying member 250 upward from the bag main body 212.

In the support member 300 is coupled, with the overlapping region 310 of the support member 300 and the overlapping regions (one overlapping region 262 and other overlapping region 264) of the hand-carrying member 250 sewed together so that the crest portion 350 of the support member 300 faces the crest portion 290 of the hand-carrying member 250 so as to be positioned oppositely thereto.

The support member 300 extends downward from the fixing region (one fixing region 270 and other fixing region 272) of the hand-carrying member 250 fixed to the bag main body 212, and is fixed to the bag main body 212 in the long-extended support region 312.

The hand-carrying member 250 has formed therein: a closing portion 296 formed by curving the band-shaped body 280 at the center in a width direction with the folded portions placed inward, closing the one longitudinal edge 252 and the other longitudinal edge 254 together, and sewing the one longitudinal edge 252 and the other longitudinal edge 254 together so that an inner side of the one longitudinal edge 252 and the other longitudinal edge 254 is curved to swell to an outer direction, that is, oppositely to the folded portions; a swelled portion 292 and a swelled portion 294 continued to the one longitudinal edge 252 and the other longitudinal edge 254; and the crest portion 290. The hand-carrying member 250 has the crest portion 290 oriented to the inside of the bag main body 212.

The inner hand-carrying member 250 (one bridging region 266 and other bridging region 268) and the outer support member 300 have different lengths, and the inner hand-carrying member 250 is shorter than the outer support member 300.

The inner hand-carrying member 250 and the outer support member 300 have a substantially same width.

The one overlapping region 262 and the other overlapping region 264 of the inner hand-carrying member 250 swell toward the inside of the bag main body 212.

In the support member 300, the closing portion 356 of the band-shaped bodies 330 and band-shaped bodies 340 in the overlapping region 310 is inserted from a space between the one longitudinal edge 252 and the other longitudinal edge 254 in the one overlapping region 262 (and other overlapping region 264) of the hand-carrying member 250 toward the inside of the crest portion 290 of the hand-carrying member 250, and the overlapping region 310 of the support member 300 and the one overlapping region 262 (and other overlapping region 264) of the hand-carrying member 250 are overlapped each other.

The one longitudinal edge 252 and the other longitudinal edge 254 in the one overlapping region 262 (and other overlapping region 264) of the hand-carrying member 250 reach near the crest portion 350 in the overlapping region 310 of the support member 300.

In the inner hand-carrying member 250 and the outer support member 300, in a region where the closing portion 296 of the band-shaped body 280 and the crest portion 350 of the band-shaped bodies 330 and band-shaped bodies 340 are overlapped each other, a portion near the longitudinal edges (one longitudinal edge 252 and other longitudinal edge 254) of the inner hand-carrying member 250 and a portion near the crest portion 350 of the outer one support member 300 are sewed together to form a sewing portion 360.

In the sewing portion 360, in an overlapping region between the one overlapping region 262 of the hand-carrying member 250 and the overlapping region 310 of the support member 300 and an overlapping region between the other overlapping region 264 of the hand-carrying member 250 and the overlapping region 310 of the support member 300 extending from the hand-carrying region A1, a portion near the one longitudinal edge 252 and the other overlapping region 264 of the hand-carrying member 250 and the crest portion 350 of the support member 300 are sewed together along the one longitudinal edge 252 and the other longitudinal edge 254 of the hand-carrying member 250.

The support region 312 of the support member 300 is located between the overlapping region 310 and the fixing region 314 where the outer support member 300 is attached to the surface of the bag main body 212. The support region 312 is formed with the band-shaped bodies 330 and band-shaped bodies 340 curved at the center in the width direction, without the support region 312 portion being sewed.

The outer support member 300 has the overlapping region 310 at one end attached to the one overlapping region 262 and the other overlapping region 264 of the hand-carrying member 250, and have the fixing region 314 at the other end attached to the outer surface of the bag main body 212.

Figure 21:
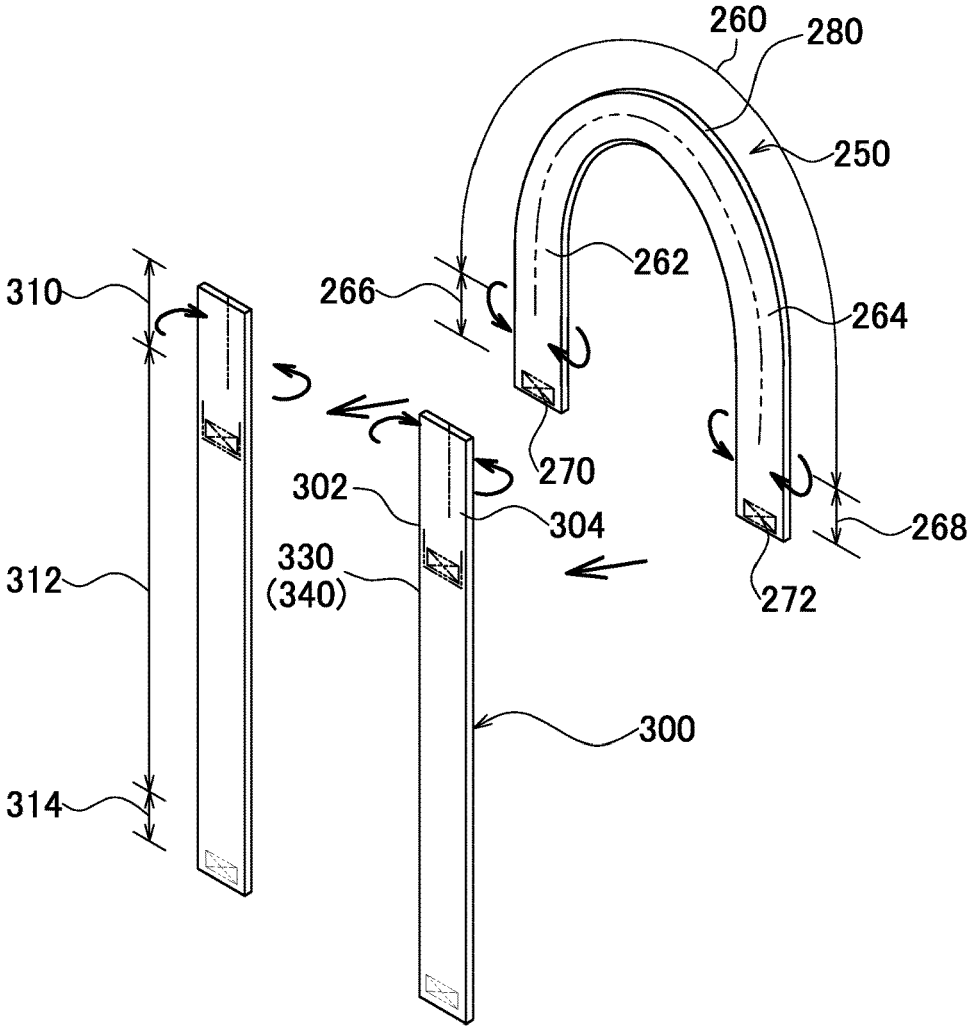
FIG. 21 is a perspective view showing a manufacturing process of the hand-carrying portion of the bag of FIG. 18.
Figure 22A:
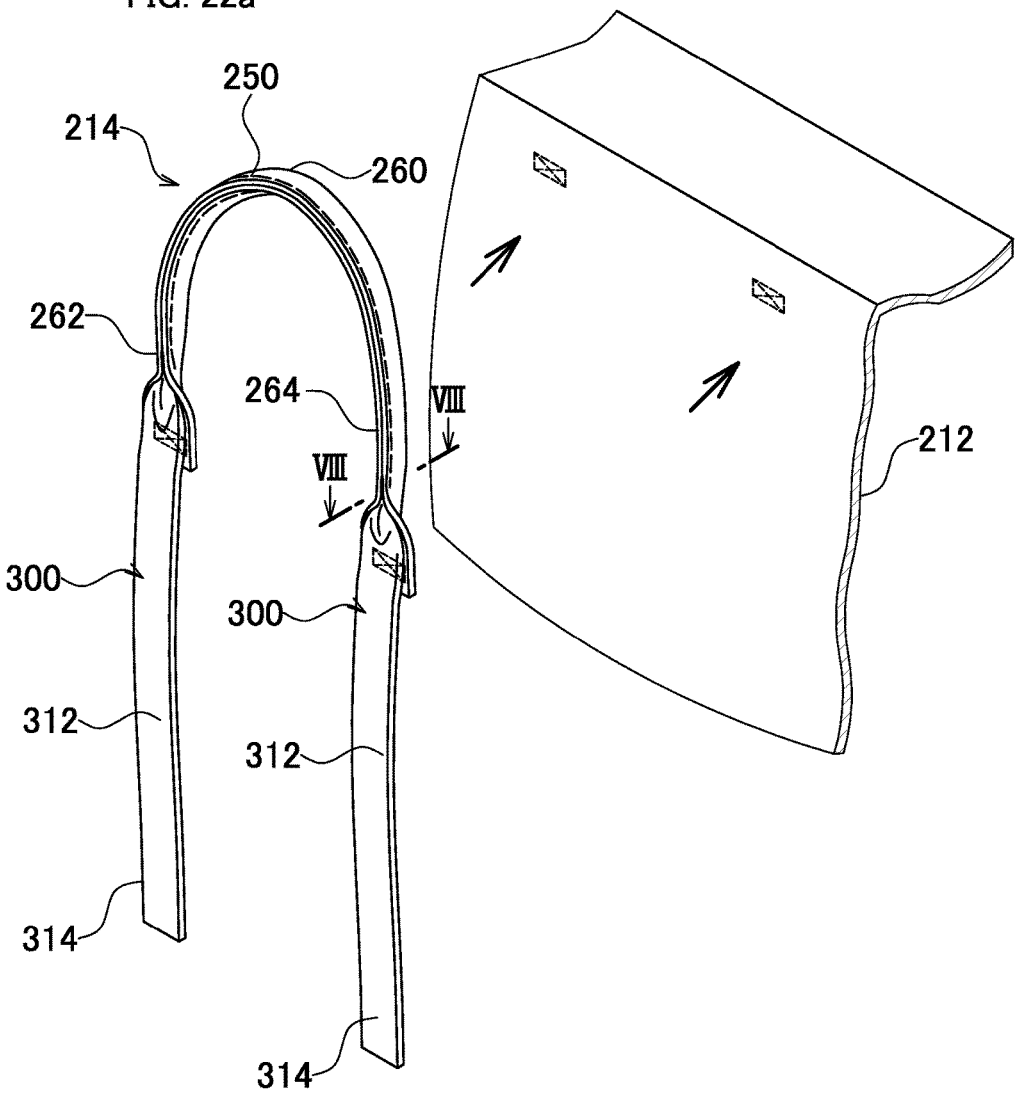
FIGS. 22*a* and 22*b* are views showing a process of manufacturing the bag of FIG. 18, in which 22*a* is a perspective view and 22*b* is a cross-sectional view.
Figure 22B:
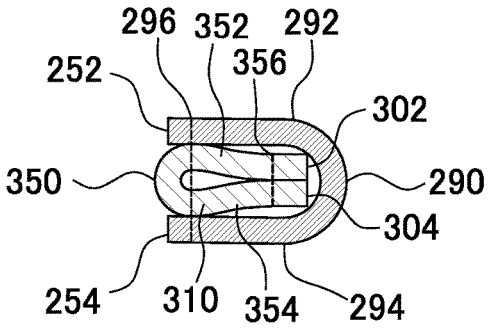

Next, a method of attaching the hand-carrying portion of the bag according to the other embodiment is described mainly based on FIG. 21 to FIG. 23.

The longitudinal band-shaped body 280 made of leather or fabric to form the longitudinal band-shaped hand-carrying member 250 is prepared.

The hand-carrying member 250 is formed by folding the band-shaped body 280 made of leather or fabric so that portions near both longitudinal edges made of band-shaped leather or fabric overlap each other inward, and bonding folded portions together.

The band-shaped body 280 is configured so that the folded portions face each other to be laminated to form one hand-carrying member 250.

The band-shaped body 280 is formed in an arch shape with a substantially C-shaped cross section by combining both of the longitudinal edges, that is, the one longitudinal edge 252 and the other longitudinal edge 254, together.

The hand-carrying member 250 has the curved region 260, the overlapping regions (the one overlapping region 262 and the other overlapping region 264), and portions nearby continued to the overlapping regions of the bridging regions (one bridging region 266 and the other bridging region 268) formed in an arch shape with a substantially C-shaped cross section.

The curved region 260 and the other overlapping region 264 are sewed together near the one longitudinal edge 252 and the other longitudinal edge 254.

The hand-carrying member 250 has formed therein: the closing portion 296 formed by curving the band-shaped body 280 at the center in the width direction with the folded portions placed inward, closing the one longitudinal edge 252 and the other longitudinal edge 254 together, and sewing the one longitudinal edge 252 and the other longitudinal edge 254 together so that an inner side of the one longitudinal edge 252 and the other longitudinal edge 254 is curved to swell to an outer direction, that is, oppositely to the folded portions; the swelled portion 292 and the swelled portion 294 continued to the one longitudinal edge 252 and the other longitudinal edge 254; and the crest portion 290 (hand-carrying member forming step).

Next, the support member 300 is intervened for each of the one bridging region 266 and the other bridging region 268 in each of both longitudinal edges, that is, the one longitudinal edge 252 and the other longitudinal edge 254, of the band-shaped body in the one bridging region 266 and the other bridging region 268 of the hand-carrying member 250.

The support members 300 are intervened in the one overlapping region 262 and the other overlapping region 264 along the one overlapping region 262 and the other overlapping region 264 of the hand-carrying member 250 in order to raise the hand-carrying member 250 upward from the bag main body 212 (support member intervening step).

The longitudinal band-shaped bodies 330 and 340 made of leather or fabric forming the support members 300 include the overlapping region 310 having at least an upper portion formed in an arch shape with a substantially C-shaped cross section by combining both longitudinal edges (one longitudinal edge 302 and other longitudinal edge 304) together, the support region 312 extending downward from the overlapping region 310, and the fixing region 314 formed below the support region 312.

In the support members 300, both longitudinal edges, that is, the one longitudinal edge 302 and the other longitudinal edge 304, of the overlapping region 310, are intervened in both longitudinal edges, that is, the one longitudinal edge 252 and the other longitudinal edge 254, of the hand-carrying member 250 formed in an arch shape with a substantially C-shaped cross section.

The overlapping region 310 of the support member 300 and the overlapping region (one overlapping region 262 and other overlapping region 264) of the hand-carrying member 250 are sewed together so that the crest portion 350 of the support member 300 faces the crest portion 290 of the hand-carrying member 250 so as to be positioned oppositely thereto, thereby coupling the support member 300 to the hand-carrying member 250 (support member coupling step).

The band-shaped bodies 330 and band-shaped bodies 340 are formed by folding portions near both band-shape longitudinal edges made of leather or fabric inward and bonding folded portion together.

The band-shaped bodies 330 and band-shaped bodies 340 are configured so that the folded portions face each other to be laminated together to form one support member 300.

The support member 300 has formed therein: the closing portion 356 formed by curving the band-shaped bodies 330 and band-shaped bodies 340 at the center in the width direction with the band-shaped bodies 340 placed inward, closing the one longitudinal edge 302 and the other longitudinal edge 304 together, and sewing the one longitudinal edge 302 and the other longitudinal edge 304 together so that an inner side of the one longitudinal edge 302 and the other longitudinal edge 304 is curved to swell to the outer direction, that is, to the band-shaped bodies 330 side; the swelled portion 352 and the swelled portion 354 continued to the one longitudinal edge 302 and the other longitudinal edge 304; and the crest portion 350 of the support region 312 with the band-shaped bodies 330 and band-shaped bodies 340 curved at the center in the width direction (support member forming step).

For the inner hand-carrying member 250 and the outer support member 300, in a region where the closing portion 296 of the band-shaped body 280 and the crest portion 350 of band-shaped bodies 330 and band-shaped bodies 340 are overlapped each other, a portion near the longitudinal edge (one longitudinal edge 252 and other longitudinal edge 254) of the inner hand-carrying member 250 and a portion near the crest portion 350 of one inner support member 300 are sewed together to form the sewing portion 360.

In an overlapping region between the one overlapping region 262 of the hand-carrying member 250 and the overlapping region 310 of the support member 300 and an overlapping region between the other overlapping region 264 of the hand-carrying member 250 and the overlapping region 310 of the support member 300 extending from the hand-carrying region A1, a portion near the one longitudinal edge 252 and the other overlapping region 264 of the hand-carrying member 250 and the crest portion 350 of the support member 300 are sewed together along the one longitudinal edge 252 and the other longitudinal edge 254 of the hand-carrying member 250 to form the sewing portion 360 (support member fixing step).

Next, the support member 300 is formed so that the support region 312 has an arch shape with a substantially C-shaped or substantially U-shaped cross section at least near the overlapping region 310, and the fixing region 314 below the support region 312 is fixed to the bag main body 212 (hand-carrying member fixing step).

Next, the hand-carrying member 250 is fixed to the bag main body 212 in the fixing regions (one fixing region 270 and other fixing region 272) of the hand-carrying member 250 below the one bridging region 266 and the other bridging region 268 extending downward from the one overlapping region 262 and the other overlapping region 264.

The support region 312 of the support member 300 is located between the overlapping region 310 and the fixing region 314 where the outer support member 300 is attached to the surface of the bag main body 212. The support region 312 is formed with the band-shaped bodies 330 and band-shaped bodies 340 curved at the center in the width direction, without the support region 312 portion being sewed.

The overlapping regions 310 at one end of the outer support members 300 are attached to the one overlapping region 262 and the other overlapping region 264 of the hand-carrying member 250, and the fixing regions 314 at the other end are attached to the outer surface of the back main body 212.

In this embodiment, the overlapping regions (one overlapping region 262 and other overlapping region 264) at one end of the inner hand-carrying member 250 are sewed to the one longitudinal edge 302 and the other overlapping region 264 of the support member 300 near the left side gore portion 224A (right side gore portion 224B) configuring the gore portion 224 near the opening 228 of the front body portion 220, and also the fixing regions (one fixing region 270 and other fixing region 272) at the other end are sewed to portions near the right side gore portion 224B configuring the gore portion 224 near the opening 228 of the front body portion 220.

The back surface side of the fixing regions 314 in a flat state of the long band-shaped bodies (band-shaped bodies 330 and band-shaped bodies 340) configuring the outer support member 300 is made in contact with and sewed to the outer surface of the bag main body 212.

In this manner, the bag including the structure of the hand-carrying portion 214 of the bag of the present invention can be formed.

Next, another embodiment of the structure of the hand-carrying portion of the bag of the present invention is described.

Figure 26:
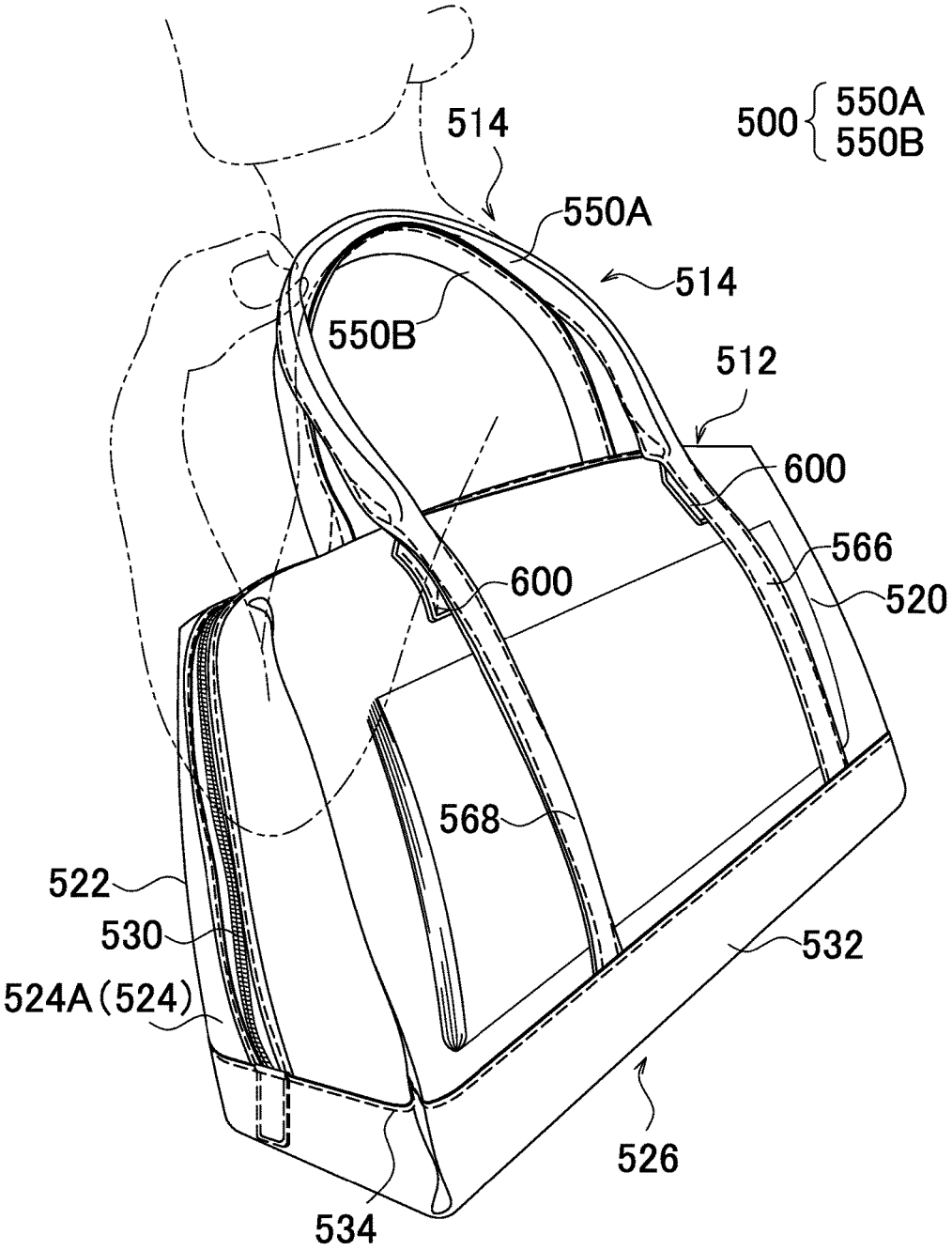
FIG. 26 is a perspective view of a bag using the structure of a hand-carrying portion of a bag according to still another embodiment of the present invention.

FIG. 26 is a perspective view of a bag using the structure of a hand-carrying portion of a bag according to still another embodiment of the present invention.

Figure 27:
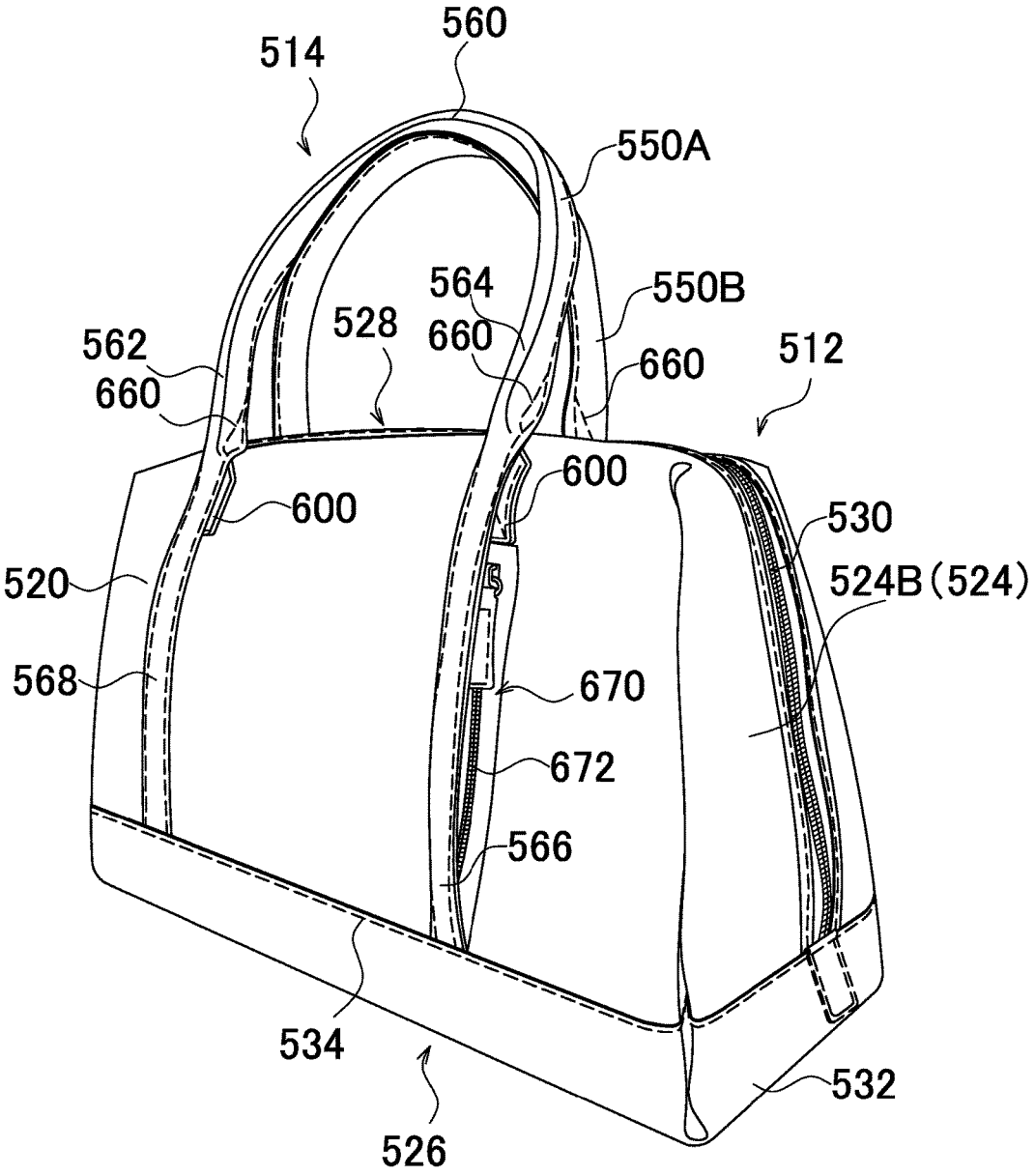
FIG. 27 is a perspective view of a front side of the bag of FIG. 26.

FIG. 27 is a perspective view of a front side of the bag of FIG. 26.

Figure 28:
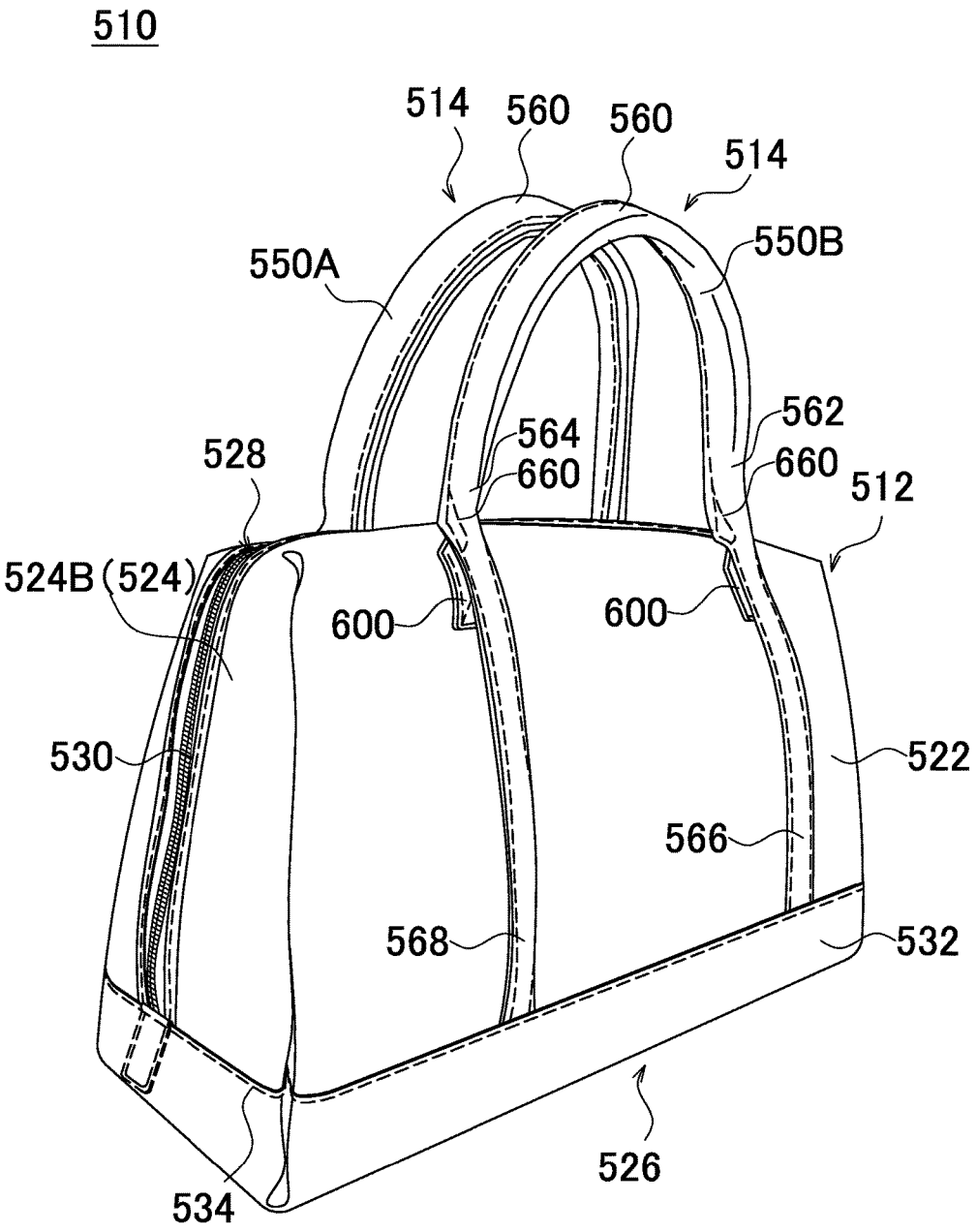
FIG. 28 is an opposite side view showing the structure of the hand-carrying portion of the bag of FIG. 26.
Figure 29:
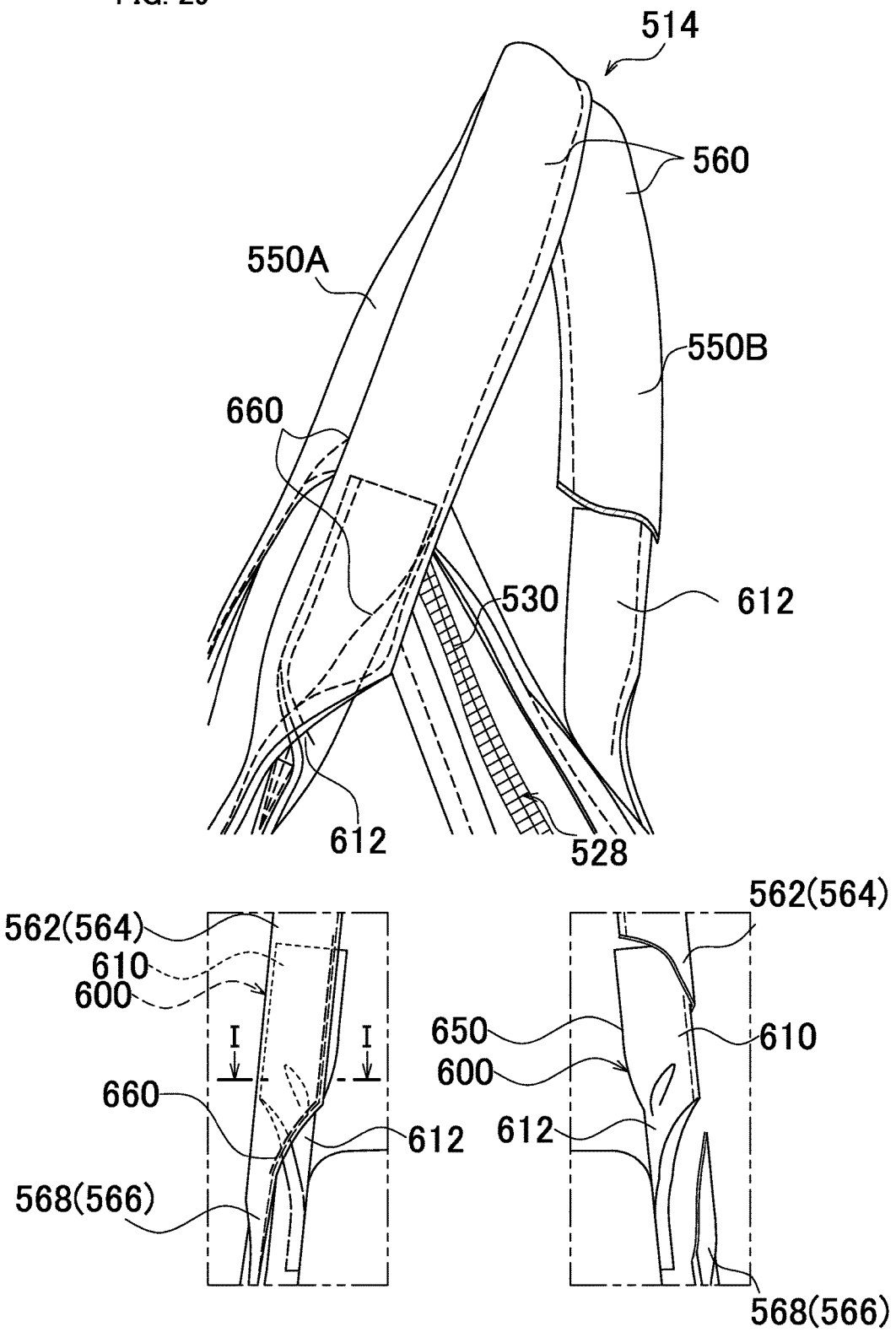
FIG. 29 is a side view showing the structure of the hand-carrying portion of the bag of FIG. 26.
Figure 30:
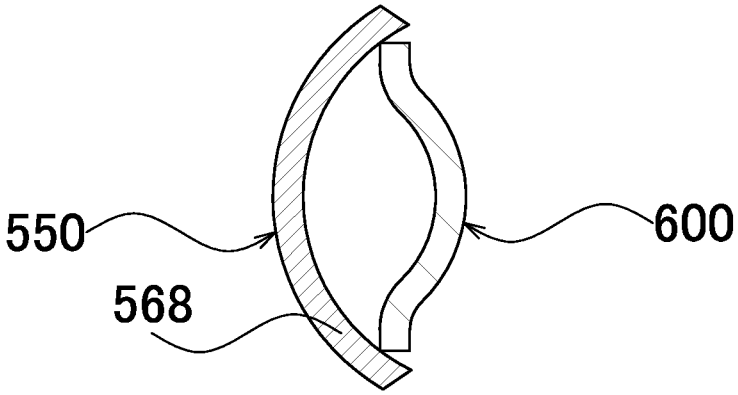
FIG. 30 is an end face view along I-I of FIG. 29.
Figure 31:
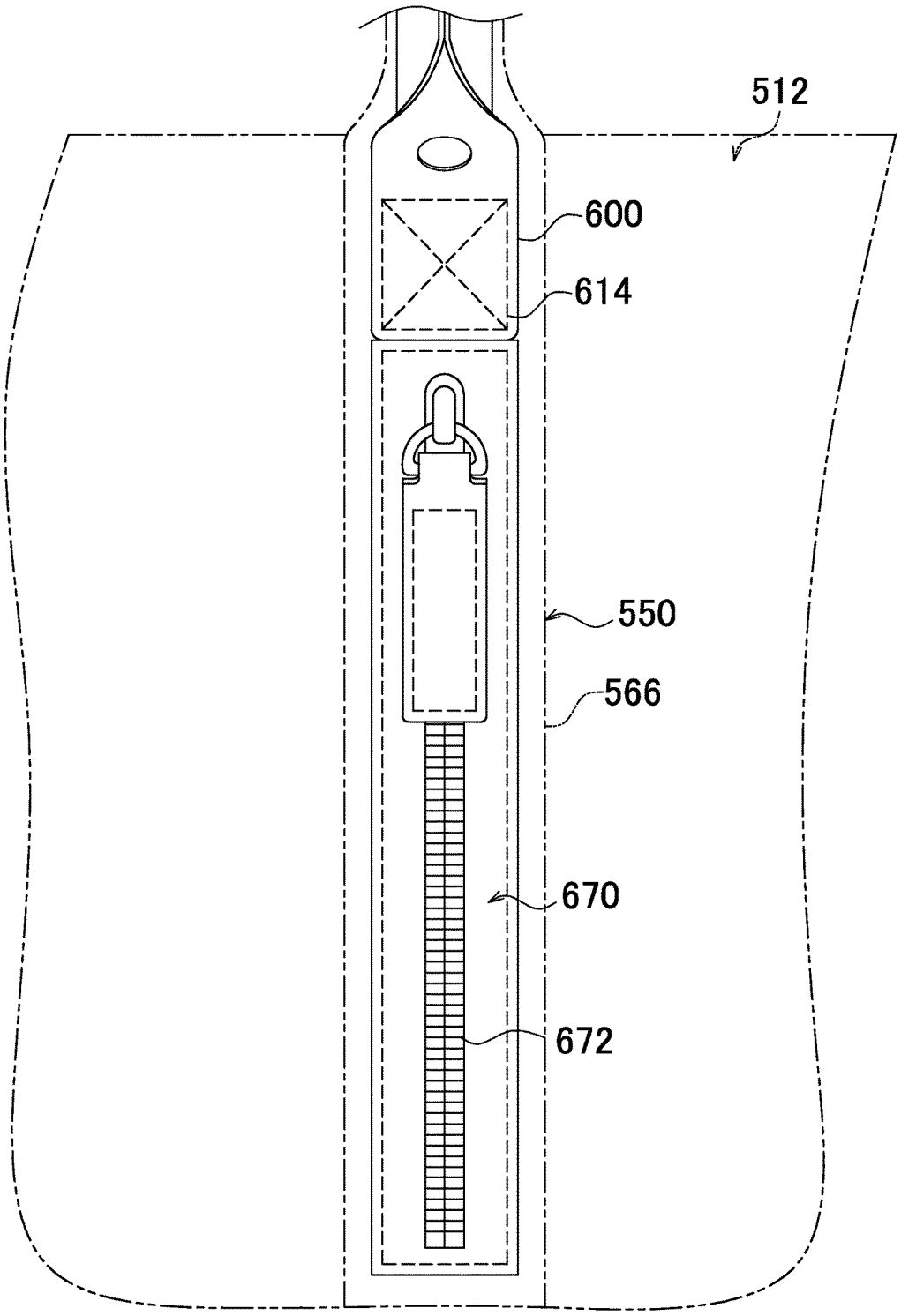
FIG. 31 is a side view showing the structure of the hand-carrying portion of the bag of FIG. 26.
Figure 32A:
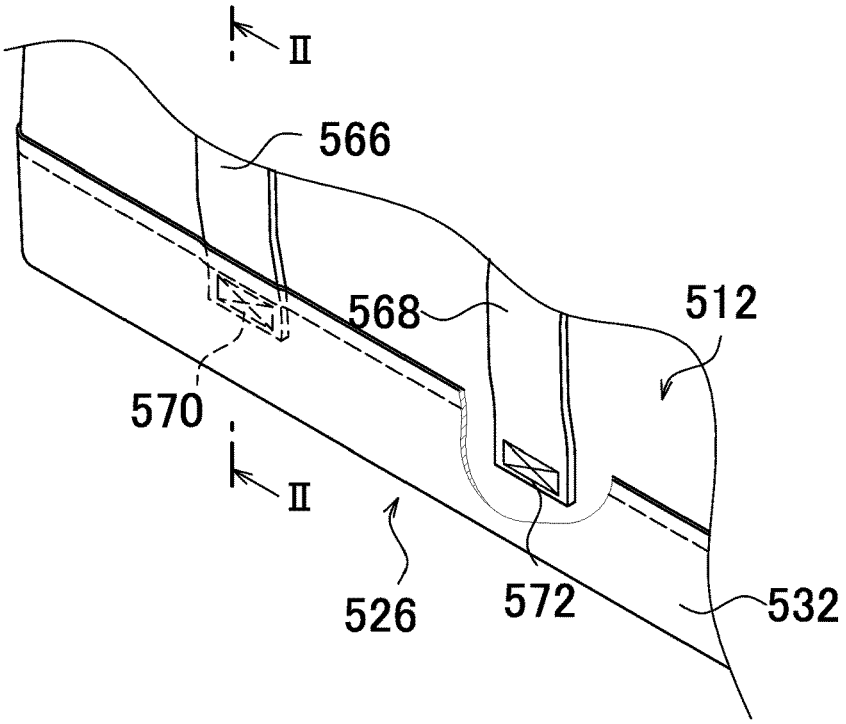
FIGS. 32*a* and 32*b* are views showing the structure of the hand-carrying portion of the bag of FIG. 26, in which 32*a* is a perspective view and 32*b* is a view along a II-II plane.
Figure 32B:
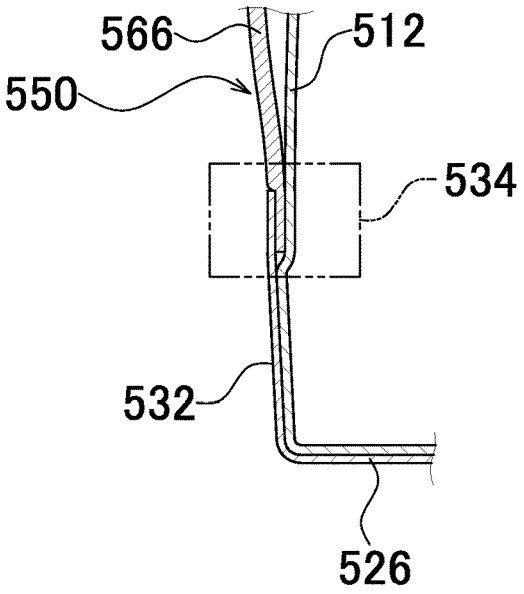
Figure 33:
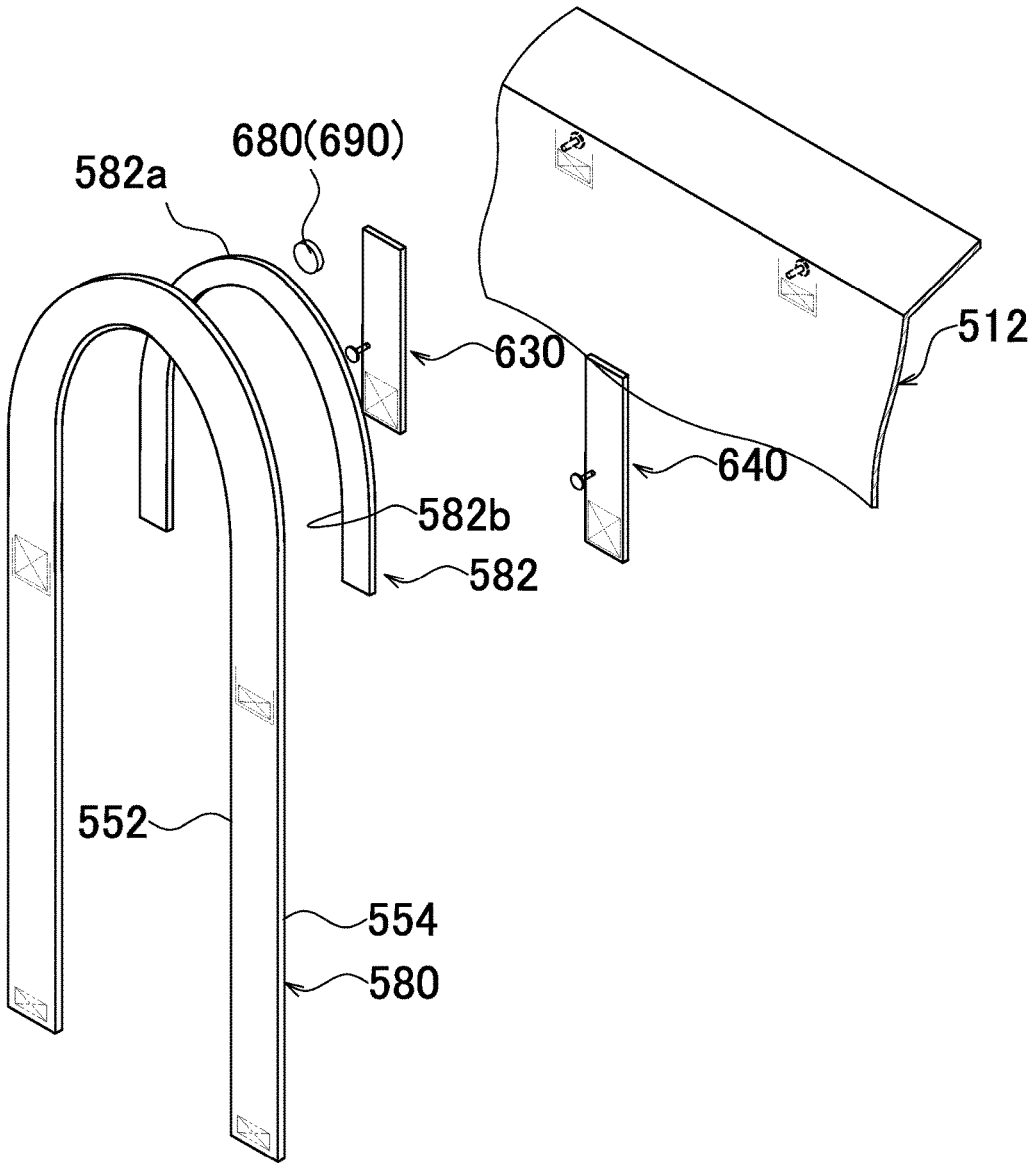
FIG. 33 is a perspective view showing a manufacturing process of the hand-carrying portion of the bag of FIG. 26.
Figure 34A:
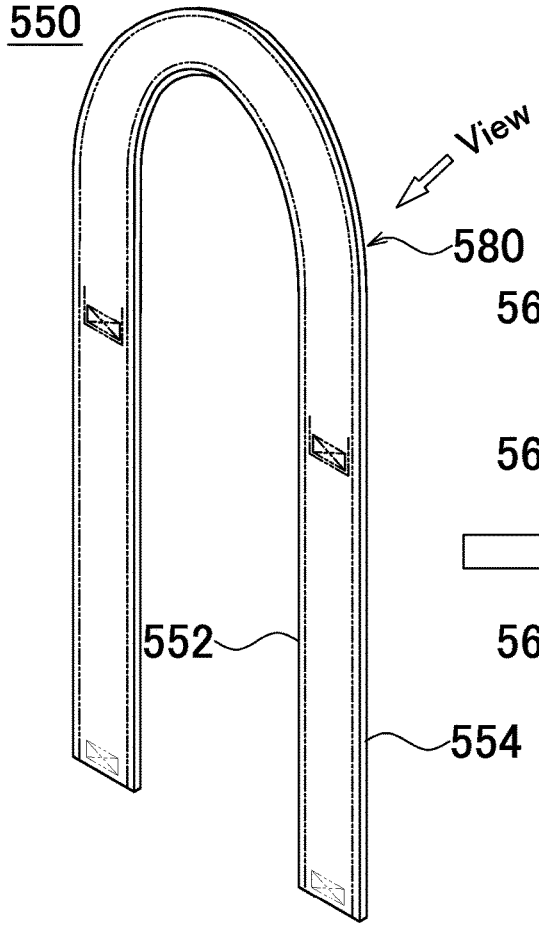
FIGS. 34*a* and 34*b* are perspective views showing a manufacturing process of the hand-carrying portion of the bag of FIG. 26.
Figure 34B:
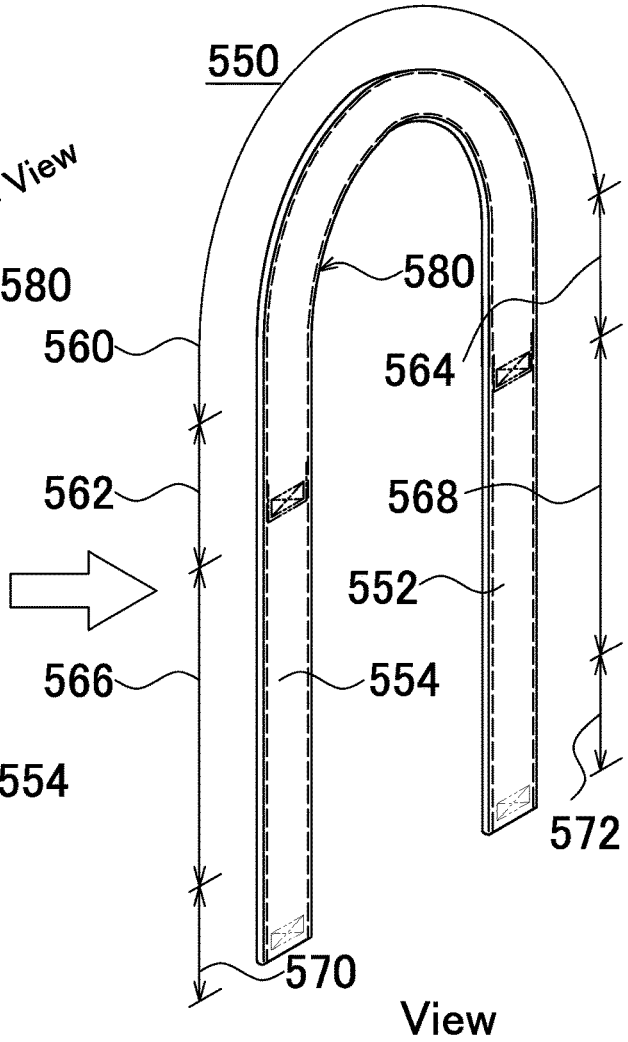
Figure 35A:
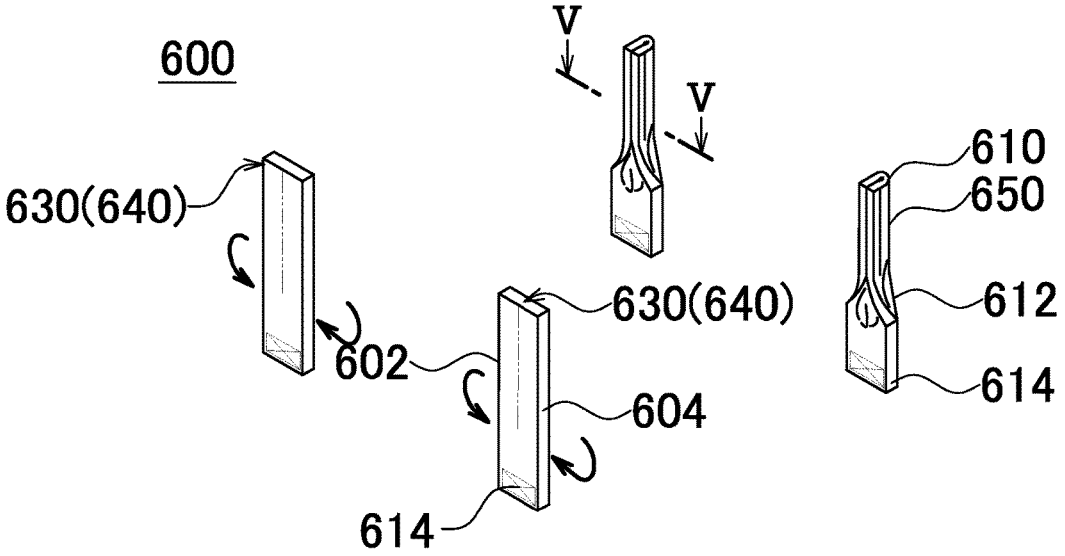
FIGS. 35*a* and 35*b* are views showing a process of manufacturing the hand-carrying portion of the bag of FIG. 26, in which 35*a* is a perspective view and 35*b* is a view along a V-V end face.
Figure 35B:
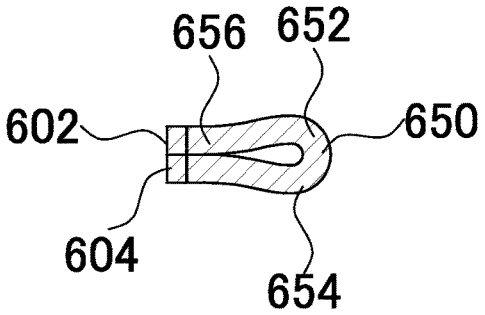
Figure 36:
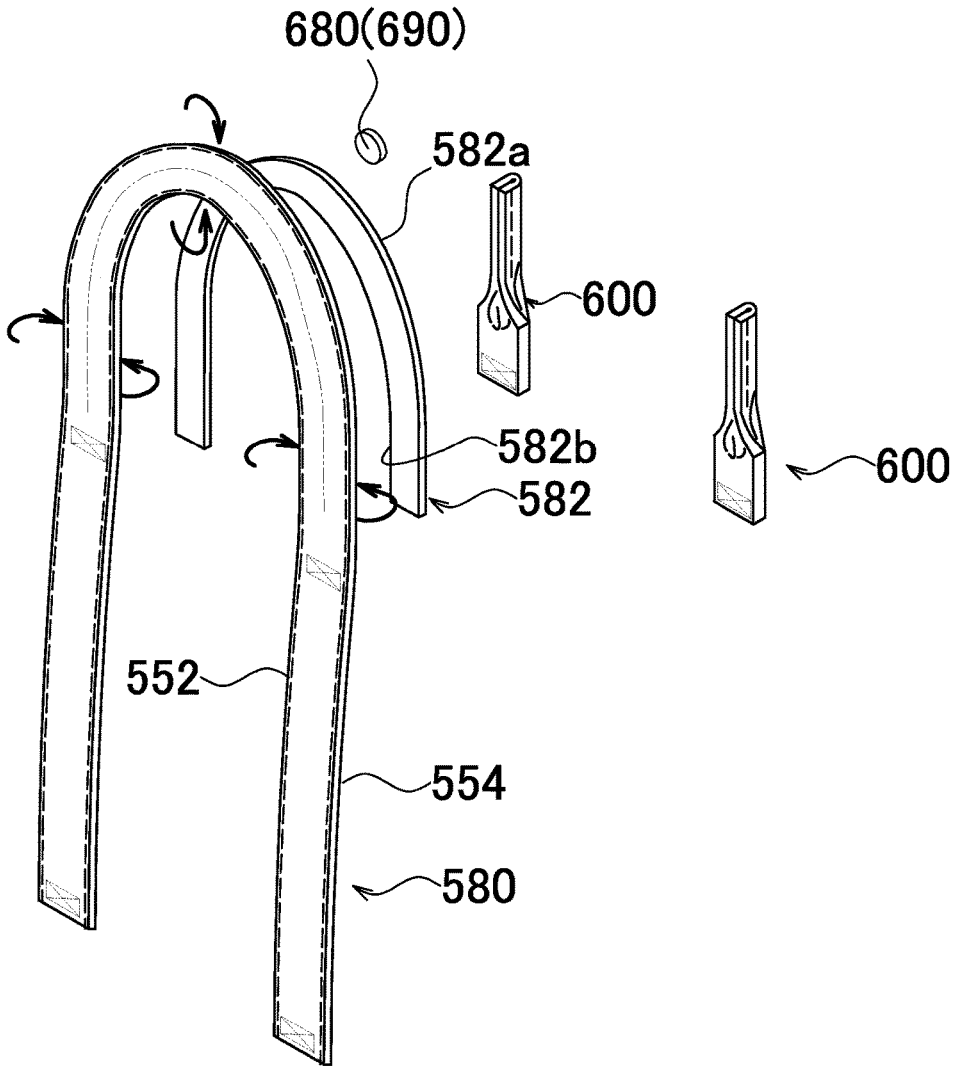
FIG. 36 is a perspective view showing a manufacturing process of the hand-carrying portion of the bag of FIG. 26.
Figure 37A:
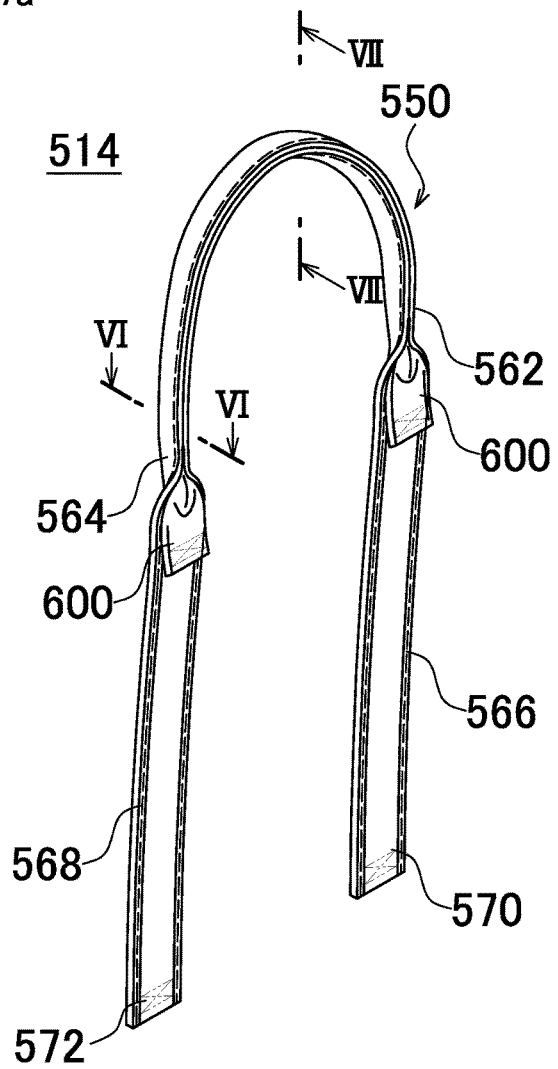
FIGS. 37*a*, 37*b* and 37*c* are views showing a process of manufacturing the hand-carrying portion of the bag of FIG. 26, in which 37*a* is a perspective view, 37*b* is a cross-sectional view along VI-VI, and 37*c* is a cross-sectional view along VII-VII.
Figure 37B:
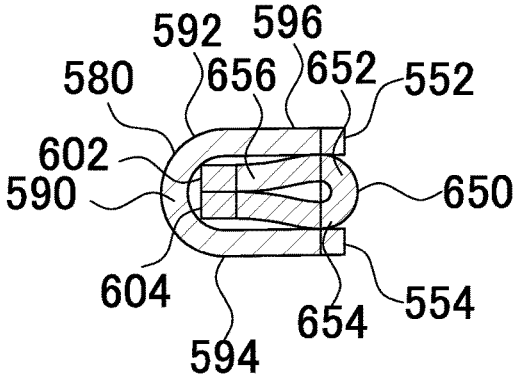
Figure 37C:
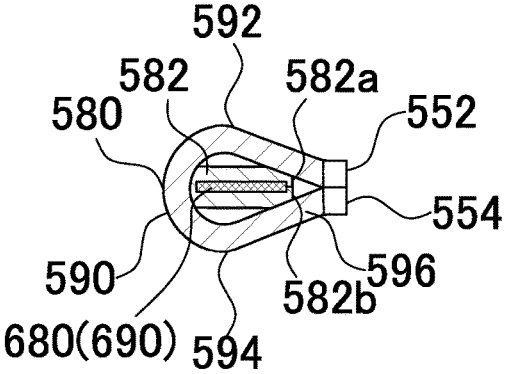
Figure 38A:
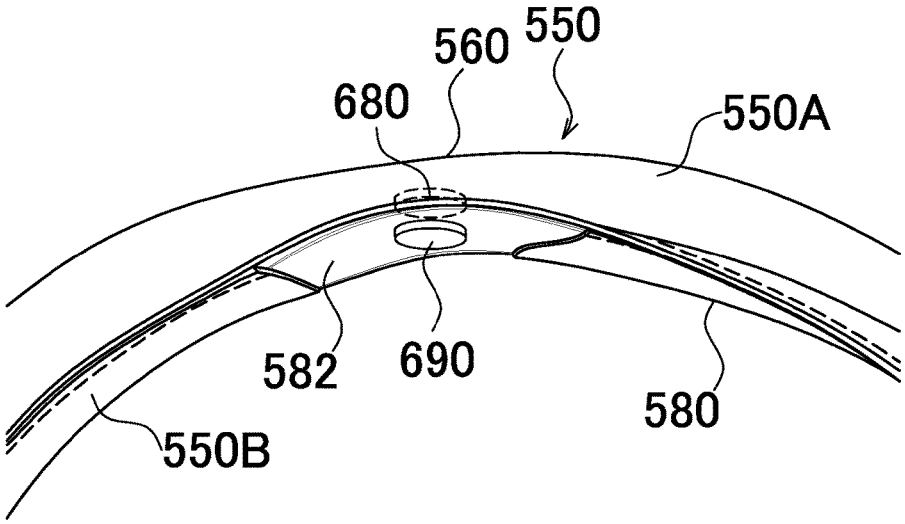
FIGS. 38*a* and 38*b* are partially-enlarged views with a portion near a crest portion of the hand-carrying portion of the bag of FIG. 26, in which 38*a* is a perspective view and 38*b* is a cross-sectional view.
Figure 38B:
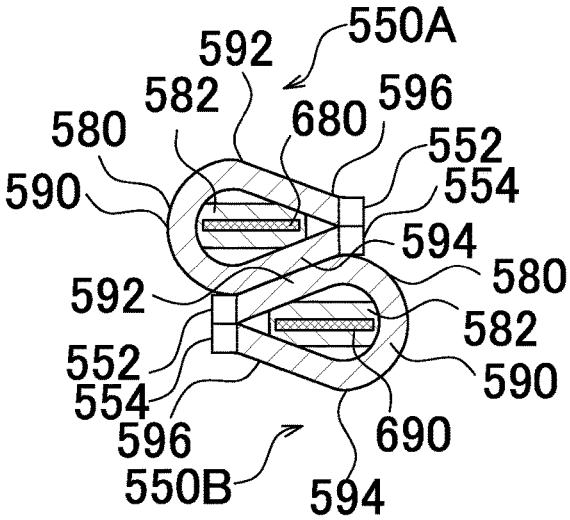
Figure 39:
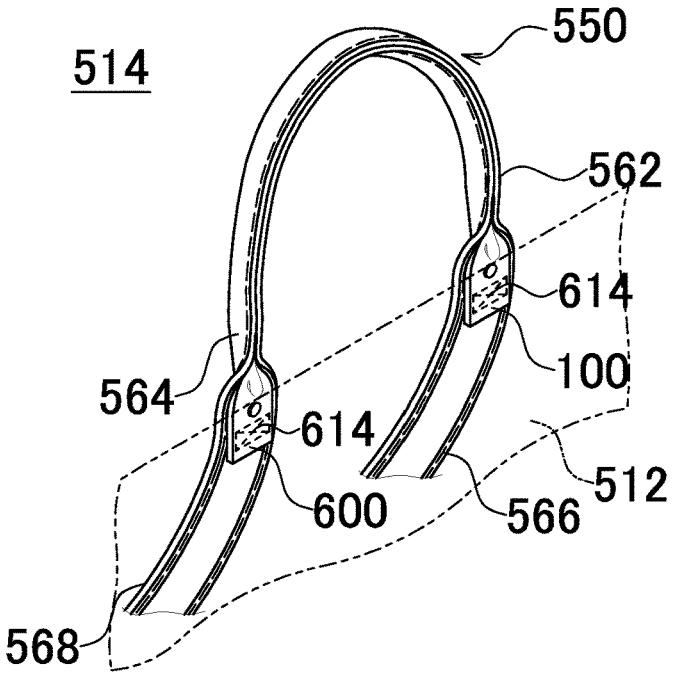
FIG. 39 is a perspective view showing the structure of the hand-carrying portion of the bag of FIG. 26.
Figure 40:
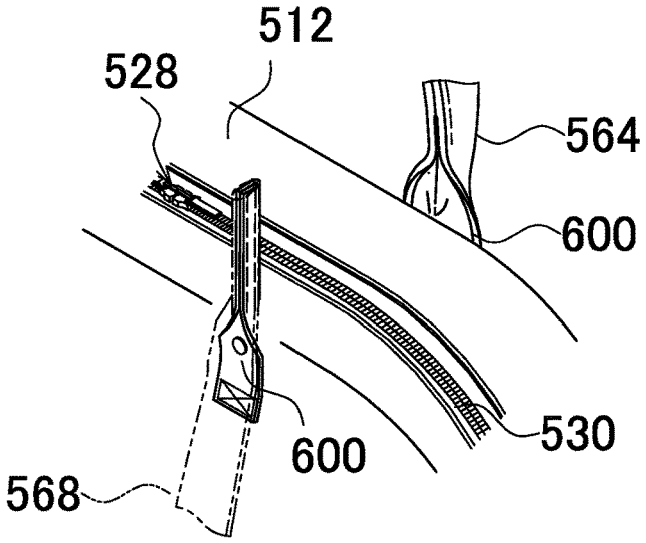
FIG. 40 is a perspective view showing the structure of the hand-carrying portion of the bag of FIG. 26.
Figure 41:
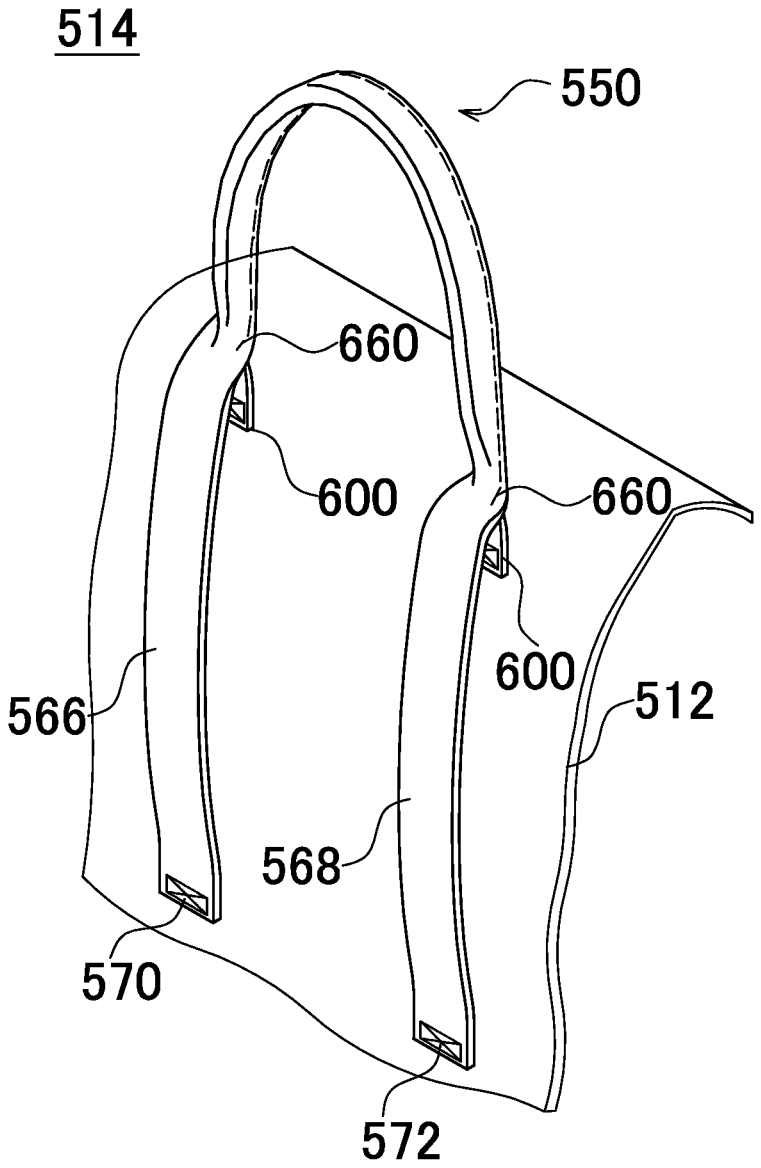
FIG. 41 is a perspective view showing the structure of the hand-carrying portion of the bag of FIG. 26.
Figure 42A:
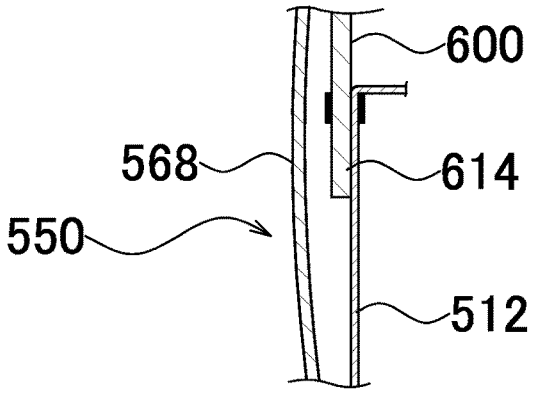
FIGS. 42*a* and 42*b* are cross-sectional views showing the structure of the hand-carrying portion of the bag of FIG. 26, in which 42*a* is a cross-sectional view of an upper portion and 42*b* is a cross-sectional view of a lower portion.
Figure 42B:
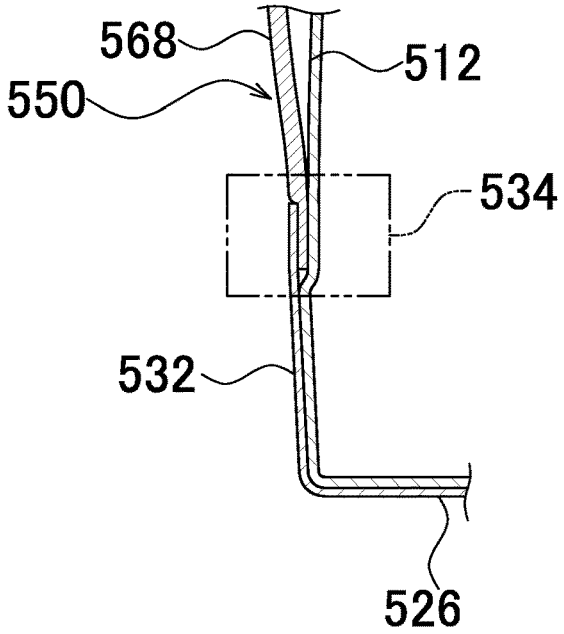
Figure 43:
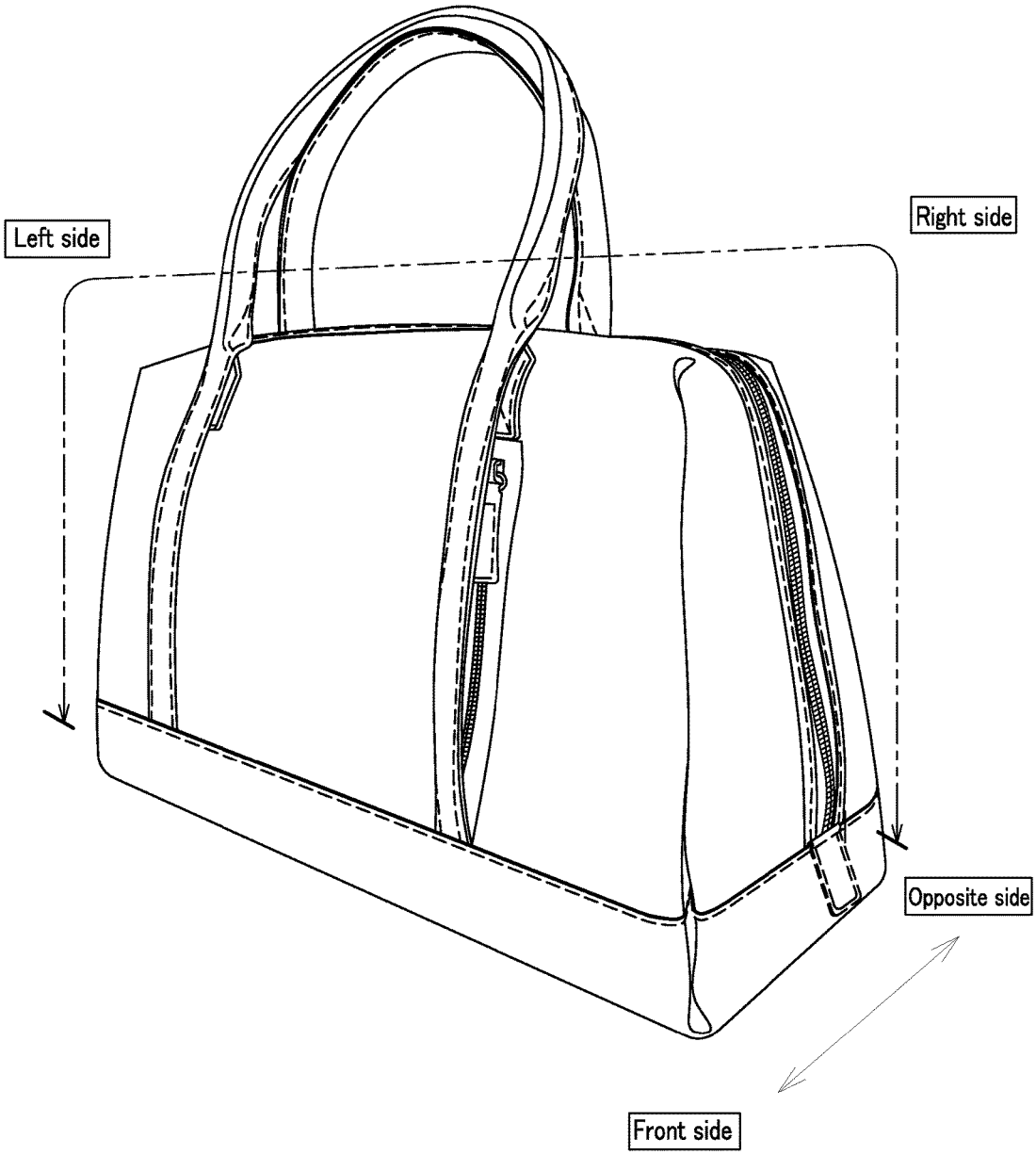
FIG. 43 is a diagram for describing the bag according to the present invention.
Figure 44:
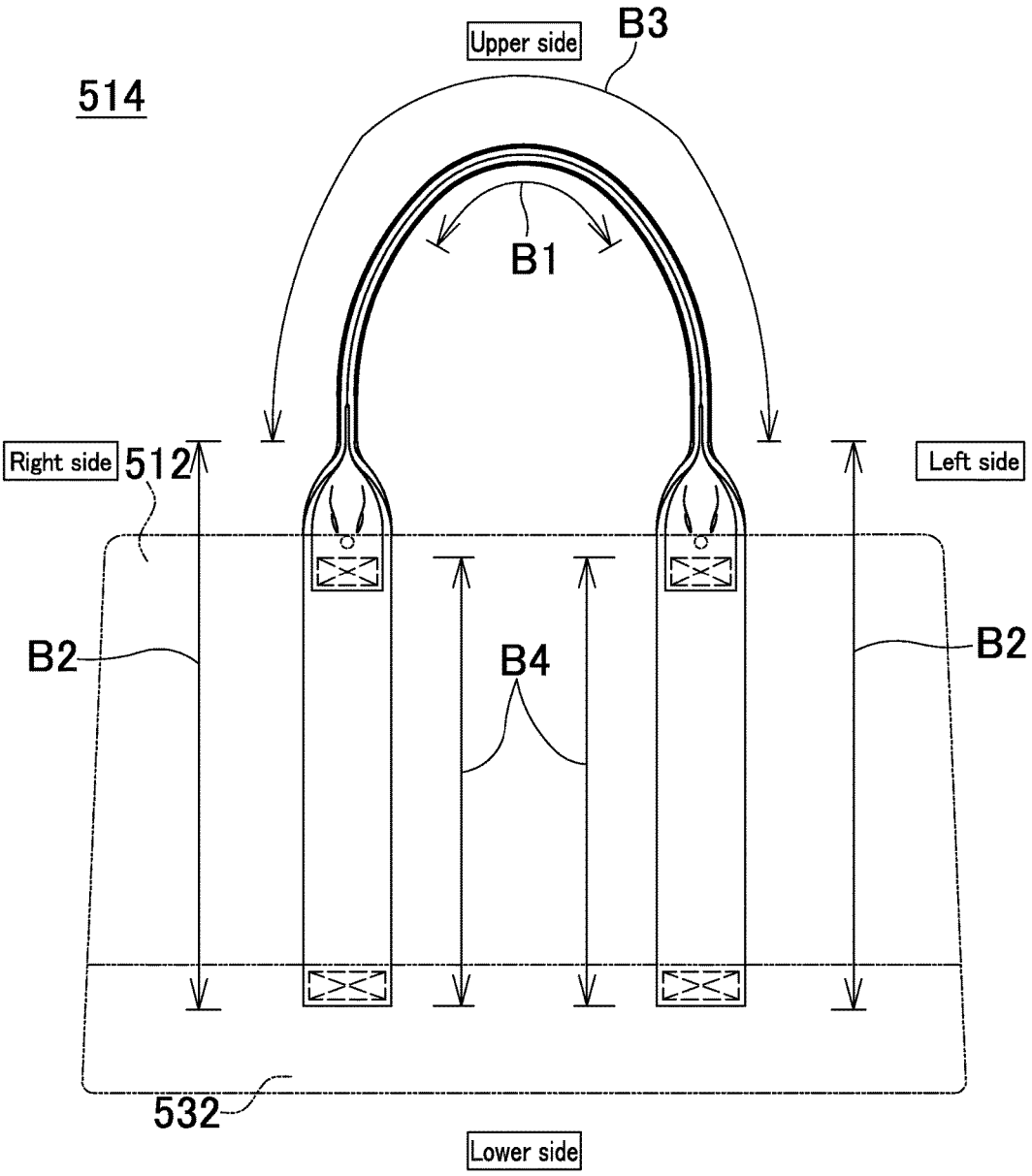
FIG. 44 is a diagram for describing the bag according to the present invention.

FIG. 28 is an opposite side view showing the structure of the hand-carrying portion of the bag of FIG. 26.

The structure of the hand-carrying portion of the bag of the present invention particularly includes a structure suitable for use as a shoulder bag.

In the shoulder bag, normally, hand-carrying portions are attached so as to extend upward from both sides of a front body portion and a back body portion of a bag main body. Normally, these two front and back hand-carrying portions are overlapped each other and put on the shoulder. At the time of walking with the shoulder bag put on the shoulder or the like, the overlapped two hand-carrying portions tend to be separated to cause one hand-carrying portion to be slipped off the shoulder.

When one hand-carrying portion falls off the shoulder, the shoulder bag is inconveniently slipped off the shoulder accordingly, or the like.

In view of these circumstances, the structure of the hand-carrying portion of the bag of this embodiment can provide bag hand-carrying portions allowing a state in which two hand-carrying portions are overlapped each other to be kept.

According to the structure of the hand-carrying portion of the bag of this embodiment, two bag hand-carrying portions are hooked as being overlapped each other on the shoulder, and the bag is less prone to be slipped off the shoulder.

The structure of the hand-carrying portion of the bag of the present invention can be used for a shouldering portion or the like of a shoulder bag, as shown in FIG. 26.

The bag main body 512 includes a front body portion 520, a back body portion 522 facing the front body portion 520, a gore portion 524 interposed between the front body portion 520 and the back body portion 522, and a bottom portion 526 arranged at the lower ends of the front body portion 520, the back body portion 522, and the gore portion 524.

An opening 528 between the front body portion 520 and the back body portion 522 is configured to be opened and closed with a zipper 530 provided at the open edge of the front body portion 520 and an open edge of the back body portion 522.

The gore portion 524 includes a left side gore portion 524A formed on the left side of the front body portion 520, and a right side gore portion 524B formed on the right side of the front body portion 520.

The bottom portion 526 is formed by sewing a bottom member 532 overlapped with the outer surfaces of the front body portion 520, the back body portion 522, and the gore portion 524 at the lower end edges of the front body portion 5250, the back body portion 522, and the gore portion 524.

The bottom member 532 is entirely formed to a plate shape, where the peripheral edge thereof is sewed to the front body portion 520, the back body portion 522, and the gore portion 524 at a bottom member joining region 534 having a constant width.

The structure of the hand-carrying portion 514 to be attached to the bag main body 512 of the present invention is applied to the hand-carrying portion 514 attached outside the bag main body 512 so that a shouldering region B1 at the top to be put on the human shoulder extends upward from the front body portion 520 and/or the back body portion 522.

The structure of the hand-carrying portion 514 of the bag according to the present invention includes a structure which supports a hand-carrying member 550 attached to the bag main body 512 and a structure which affixing the shouldering regions B1 at the top of the paired front and back hand-carrying portions 514 together as being overlapped each other.

The hand-carrying member 550 configuring the hand-carrying portion 514 includes a first hand-carrying member 550A on one side (that is, on a front side) attached to the front body portion 520 and a second hand-carrying member 550B on the other side (that is, an opposite side) attached to a back body portion 522 side.

The first hand-carrying member 550A and the second hand-carrying member 550B have a substantially same structure which supports a hand-carrying member.

Thus, in the following, the first hand-carrying member 550A is mainly described.

The first hand-carrying member 550A includes a curved region 560, one overlapping region 562 and other overlapping region 564 formed continuously to both ends of the curved region 560, bridging regions (one bridging region 566 and other bridging region 568) formed continuously to the overlapping regions (one overlapping region 562 and other overlapping region 564), and fixing regions (one fixing region 570 and other fixing region 572) formed continuously to the one bridging region 566 and the other bridging region 568 configuring the bridging regions.

The outer hand-carrying member 550 is curved in a substantially U shape in a front view in the shouldering region B1 at the top.

In the hand-carrying member 550, the one bridging region 566 and the one fixing region 570 and the other bridging region 568 and the other fixing region 572 in an extended region which extends from the curved region 560 as divided leftward and rightward are attached with an appropriate space to the outside of the bag main body 512.

The longitudinal band-shaped hand-carrying member 550 is a linear longitudinal band-shaped body made of leather or fabric, and is formed in an arch shape with a substantially C-shaped cross section by combining both longitudinal edges, that is, one longitudinal edge 552 and other longitudinal edge 554, together.

The hand-carrying member 550 has a curved region 560, the overlapping regions (one overlapping region 562 and other overlapping region 564), and portions nearby continued to the overlapping regions of the bridging regions (one bridging region 566 and other bridging region 568) formed in an arch shape with a substantially C-shaped cross section.

The hand-carrying member 550 is additionally provided with a longitudinal band-shaped elastic member 582 along an inner side surface.

The elastic member 582 is a linear longitudinal band-shaped body made of fabric having a substantially same width as that of the elastic member 582, and is formed in an arch shape with a substantially C-shaped cross section together with the hand-carrying member 550 inside the hand-carrying member 550, by combining both longitudinal edges, that is, one longitudinal edge 582*a* and other longitudinal edge 582*b*, together.

The elastic member 582 has a length corresponding to the curved region 560 of the hand-carrying member 550. Therefore, the elastic member 582 is additionally provided only to the curved region 560 of the hand-carrying member 550.

The hand-carrying member 550 has a support member 600 for each of the one bridging region 566 and the other bridging region 568, the support member 600 intervened between both longitudinal edges, that is, between the one longitudinal edge 552 and the other longitudinal edge 554, of the band-shaped body in the one bridging region 566 and the other bridging region 568.

The support members 600 are formed so as to extend along the one overlapping region 562 and the other overlapping region 564 of the hand-carrying member 550 in order to raise the hand-carrying member 550 upward from the bag main body 512.

The support member 600 is a linear longitudinal band-shaped body made of leather or fabric, including: an overlapping region 610 having at least its upper portion formed in an arch shape with a substantially C-shaped cross section by combining both longitudinal edges (one longitudinal edge 602 and other longitudinal edge 604), a support region 612 extending downward from the overlapping region 610, and a fixing region 614 formed below the support region 612.

The support member 600 has both longitudinal edges, that is, the one longitudinal edge 602 and the other longitudinal edge 604, of the overlapping region 610 intervened between both longitudinal edges, that is, the one longitudinal edge 552 and other longitudinal edge 554, of the hand-carrying member 550 formed in an arch shape with a substantially C-shaped cross section.

The support member 600 is coupled, with the overlapping region 610 of the support member 600 and the overlapping region (one overlapping region 562 and other overlapping region 564) of the hand-carrying member 550 sewed together so that a crest portion 650 of the support member 600 faces a crest portion 590 of the hand-carrying member 550 so as to be positioned oppositely thereto.

The support member 600 has the support region 612 formed in an arch shape with a substantially C-shaped cross section or a substantially U-shaped cross section at least near the overlapping region 610, and is fixed to the bag main body 512 in the fixing region 614 below the support region 612.

The support member 600 confronts the bag main body 512 to be fixed thereto in the fixing region 614, and is fastened with a rivet.

The hand-carrying member 550 extends downward from the fixing region 614 of the support member 600 fixed to the bag main body 512, and is fixed to the bag main body 512 in the fixing regions (one fixing region 570 and other fixing region 572) of the hand-carrying member 550.

The support member 600 has a plurality of band-shaped bodies 630 and band-shaped bodies 640 laminated, with the laminated band-shaped bodies 630 and band-shaped bodies 640 curved in their width to form the overlapping region 610 in an arch shape with a substantially C-shaped cross section.

The band-shaped bodies 630 and band-shaped bodies 640 are formed by folding portions near both band-shaped longitudinal edges made of leather or fabric inward and bonding folded portions together.

The band-shaped bodies 630 and band-shaped bodies 640 are configured so that the folded portions face each other to be laminated together to form one support member 600.

The support member 600 has formed therein: a closing portion 656 formed by curving the band-shaped bodies 630 and the band-shaped bodies 640 at the center in a width direction with the band-shaped bodies 640 placed inward, closing the one longitudinal edge 602 and the other longitudinal edge 604 together, and sewing the one longitudinal edge 602 and the other longitudinal edge 604 together so that an inner side of the one longitudinal edge 602 and the other longitudinal edge 604 is curved to swell to an outer direction, that is, a band-shaped bodies 630 side; a swelled portion 652 and a swelled portion 654 continued to the one longitudinal edge 602 and the other longitudinal edge 604; and the crest portion 650 of the support region 612 with the band-shaped bodies 630 and band-shaped bodies 640 curved at the center in the width direction.

The hand-carrying member 550 is formed by folding a band-shaped body 580 made of leather or fabric inward so that portions near both longitudinal edges made of band-shaped leather or fabric overlap each other, and bonding folded portions together. The elastic member 582 is formed by folding and overlapping portions near both longitudinal edges inward together with the band-shaped body 580, and bonding folded portions together.

The band-shaped body 580 is configured so that the folded portions face each other to be laminated together to form one hand-carrying member 550.

The hand-carrying member 550 has formed therein: a closing portion 596 formed by curving the band-shaped body 580 at the center in a width direction with the folded portions placed inward, closing the one longitudinal edge 552 and the other longitudinal edge 554 together, and sewing the one longitudinal edge 552 and the other longitudinal edge 554 together so that an inner side of the one longitudinal edge 552 and the other longitudinal edge 554 is curved to swell to an outer direction, that is, oppositely to the folded portions; a swelled portion 592 and a swelled portion 594 continuing to the one longitudinal edge 552 and the other longitudinal edge 554; and the crest portion 590.

The outer hand-carrying member 550 and the inner support member 600 have different lengths, and the outer hand-carrying member 550 is longer than the inner support member 600.

The hand-carrying member 550 and the inner support member 600 have a substantially same width.

The outer hand-carrying member 550 is curved at a portion near the center in the width direction of the band-shaped body 580 in the overlapping regions, that is, the one overlapping region 562 and the other overlapping region 564 of the hand-carrying member 550 and the overlapping regions 610 of the support members 600.

The one overlapping region 562 and the other overlapping region 564 of the outer hand-carrying member 550 swell toward outside of the bag main body 512.

The support members 600 are curved at portions near the center in the width direction of the band-shaped bodies 630 in the overlapping regions, that is, the one overlapping region 562 and the other overlapping region 564 of the hand-carrying member 550 and the overlapping regions 610 of the support members 600.

The overlapping regions 610 of the support members 600 swell toward a bag main body 512 side.

In the support member 600, the closing portion 656 of the band-shaped bodies 630 and band-shaped bodies 640 in the overlapping region 610 is inserted from a space between the one longitudinal edge 552 and the other longitudinal edge 554 in the one overlapping region 562 (and other overlapping region 564) of the hand-carrying member 550 toward the inside of the crest portion 590 of the hand-carrying member 550, and the overlapping region 610 of the support member 600 and the one overlapping region 562 (and other overlapping region 564) of the hand-carrying member 550 are overlapped each other.

The one longitudinal edge 552 and the other longitudinal edge 554 in the one overlapping region 562 (and other overlapping region 564) of the hand-carrying member 550 reach near the crest portion 650 in the overlapping region 610 of the support member 600.

In the outer hand-carrying member 550 and the inner support member 600, in a region where the closing portion 596 of the band-shaped body 580 and the crest portion 650 of the band-shaped bodies 630 and band-shaped bodies 640 are overlapped each other, a portion near the longitudinal edges (one longitudinal edge 552 and other longitudinal edge 554) of the outer hand-carrying member 550 and a portion near the crest portion 650 of the inner one support member 600 are sewed together to form a sewing portion 660.

In the sewing portion 660, in an overlapping region between the one overlapping region 562 of the hand-carrying member 550 and the overlapping region 610 of the support member 600 and an overlapping region between the other overlapping region 564 of the hand-carrying member 550 and the overlapping region 610 of the support member 600 extending from the shouldering region B1, a portion near the one longitudinal edge 552 and the other overlapping region 564 of the hand-carrying member 550 and the crest portion 650 of the support member 600 are sewed together along the one longitudinal edge 552 and the other longitudinal edge 554 of the hand-carrying member 550.

The support region 612 of the support member 600 is located between the overlapping region 610 and the fixing region 614 where the inner support member 600 is attached to the surface of the bag main body 512. The support region 612 is formed with the band-shaped bodies 630 and band-shaped bodies 640 curved at the center in the width direction, without the support region 612 portion being sewed.

The inner support members 600 have the overlapping regions 610 at one end attached to the one overlapping region 562 and the other overlapping region 564 of the hand-carrying member 550, and have the fixing region 614 at the other end attached to the outer surface of the bag main body 512.

In this embodiment, the inner support members 600 have the overlapping regions 610 at one end sewed to the one overlapping region 562 and the other overlapping region 564 of the hand-carrying member 550 near the left side gore portion 524A (right side gore portion 524B) configuring the gore portion 224 near the opening 528 of the front body portion 520, and also have the fixing regions 614 at the other end sewed to portions near the right side gore portion 524B configuring the gore portion 524 near the opening 528 of the front body portion 520.

In a flat state of long band-shaped bodies (band-shaped bodies 630 and band-shaped bodies 640) configuring the inner support member 600, a back surface side of the fixing region 614 is made in contact with and sewed to the outer surface of the bag main body 512.

In the inner support member 600, the support region 612, which is a non-joining region B4 not in contact with the outer hand-carrying member 550 and the bag main body 512, is formed between the overlapping region 610 and the one overlapping region 562 and the other overlapping region 564 of the outer hand-carrying member 550.

The inner support member 600 is in a mode of the band-shaped bodies 630 and band-shaped bodies 640 in which the long band-shaped bodies configuring the inner support member 600 are in a flat state on a side near the fixing region 614 in a non-sewing region B2 not sewed to the outer hand-carrying member 550.

The outer hand-carrying member 550 is curved in a U shape in a front view in the shouldering region B1.

The outer hand-carrying member 550 is attached to the outside of the bag main body 512 with an appropriate space from the outer surface of the bag main body 512 in an extended region extending from the one overlapping region 562 and the other overlapping region 564 overlapped with the inner support member 600 to a bottom direction of the bag main body 512.

In the outer hand-carrying member 550, in the one bridging region 566 and the other bridging region 658, which are extended regions extending from the one overlapping region 562 and the other overlapping region 564 in a joining region B3 joined to the inner support members 600, the non-sewing region B2 not sewed to the support member 600 and the bag main body 512 is formed to a position joined to the bag main body 512.

The outer hand-carrying member 550 is in a mode of a band-shaped body in which the long band-shaped body 580 configuring the outer hand-carrying member 550 is in a flat state at a part (a portion on one end and the other end sides below the one overlapping region 562 and the other overlapping region 564) of the non-sewing region B2 not sewed to the inner support member 600.

The one fixing region 570 and the other fixing region 572 in the extended region of the outer hand-carrying member 550 are inserted between the bottom member 532 and the bag main body 512 from an edge of a joining region of the bottom member 532 joined to the bag main body 512, and are attached to the outer surface of the bag main body 512 and/or the inner surface of the bag main body 512.

In this embodiment, the outer hand-carrying member 550 has the one fixing region 570 at one end sewed over the front body portion 520 and the bottom member 532 in the bottom member joining region 534 between the bottom member 532 and the front body portion 520 near the left side gore portion 524A.

Specifically, when the bottom member 532 and the front body portion 520 are sewed together in the bottom member joining region 534, the one fixing region 570 at one end of the outer hand-carrying member 550 interposed between the front body portion 520 and the bottom member 532 is attached by sewing.

Furthermore, the other fixing region 572 at the other end is sewed over the front body portion 520 and the bottom member 532 in the bottom member joining region 534 between the bottom member 532 and the front body portion 520 near the right side gore portion 524B.

Specifically, when the bottom member 532 and the front body portion 520 are sewed together in the bottom member joining region 534, the other fixing region 572 at the other end of the outer hand-carrying member 550 interposed between the front body portion 520 and the bottom member 532 is attached by sewing.

The outer hand-carrying member 550 has a region configuring the one fixing region 570 and the other fixing region 572 sewed with a back surface side of the long band-shaped member 580 configuring the outer hand-carrying member 550 in a flat state in contact with the outer surface of the bag main body 512.

In the outer hand-carrying member 550, in a extended region of the outer hand-carrying member 550 extending from the one overlapping region 562 and the other overlapping region 564 in the sewed joining region B3, a non-joining region B4 not joined to the one fixing region 570 and the other fixing region 572 of the inner hand-carrying member 550 is formed.

The outer hand-carrying member 550 is in a mode of a band-shaped body in which the long band-shaped body 580 configuring the outer hand-carrying member 550 is in a flat state in the non-joining region B4 not sewed to the inner support members 600 and the bag main body 512.

In the non-joining region B4, which is an extended region of the outer hand-carrying member 550, the one bridging region 566 and the other bridging region 568 are formed for nipping an article in a space between their inner side and the outer surface of the bag main body 512.

Next, a structure is described in which the first hand-carrying member 550A on one side (that is, on a front side) attached to the front body portion 520 side and the second hand-carrying member 550A on the other side (that is, on an opposite side) attached to the back body portion 522 side are overlapped and affixed together in the curved region 560 configuring the shouldering region B1 at the top representing each top.

For example, when a hand-carrying bag 510 is put on the left shoulder, with the back body portion 522 put on the chest side of the body and the front body potion 520 put on the opposite side, the second hand-carrying member 550B attached to the back body portion 522 is first put on a shoulder side, that is, a lower side, and the first hand-carrying member 550A attached to the front body portion 520 is put on the shoulder over the second hand-carrying member 550B first put on the shoulder. The swelled portion 594 and the closing portion 596 on a lower side of the first hand-carrying member 550A and the swelled portion 592 and the closing portion 596 on an upper side of the hand-carrying member 550B are overlapped each other.

In the shouldering region B1 at the top where the first hand-carrying member 550A and the second hand-carrying member 550B are overlapped each other in a vertical direction, a permanent magnet piece 680 for affixing the first hand-carrying member 550A and the second hand-carrying member 550B together and a ferromagnetic substance piece 690 to be affixed to the permanent magnet piece 680 are disposed.

The magnet piece 680 and the magnetic substance piece 690 are disk-shaped bodies, and are internally provided so as to be incorporated in the inside of the band-shaped body 580 configuring the first hand-carrying member 550A and the second hand-carrying member 550B, the inside formed in an arch shape with a substantially C-shaped cross section.

The magnet piece 680 and the magnetic substance piece 690 are nipped in the band-shaped body 580 configuring the hand-carrying member 550.

The magnet piece 680 internally provided in the curved region 560 of the first hand-carrying member 550A is made by forming a permanent magnet such as an alnico magnet, ferrite magnet, neodymium magnet, or samarium-cobalt magnet in a disk shape, and has a size suitable for shouldering the first hand-carrying member 550A. Specifically, the magnet piece 680 has a diameter of 15 mm to 25 mm and a thickness of 2 mm to 3 mm.

The magnetic substance piece 690 internally provided in the curved region 560 of the second hand-carrying member 550B is made by forming a magnetic substance such as iron, cobalt, or nickel in a disk shape, and has a size suitable for shouldering the second hand-carrying member 550B. Specifically, the magnetic substance piece 690 has a diameter of 15 mm to 25 mm and a thickness of 2 mm to 3 mm.

A flat surface of the magnet piece 680 internally provided to the first hand-carrying member 550A and a flat surface of the magnetic substance piece 690 internally provided to the second hand-carrying member 550B are configured to face each other so that the first hand-carrying member 550A and the second hand-carrying member 550B are easily affixed together.

The magnet piece 680 of the first hand-carrying member 550A and the magnetic substance piece 690 of the second hand-carrying member 550B are each intervened between the one swelled portion 592 and the other swelled portion 594 facing each other so that a radial direction of the magnet piece 680 and the magnetic substance piece 690 extends between the crest portion 590 and the one longitudinal edge 552 and the other longitudinal edge 554. A thickness direction of the magnet piece 680 and the magnetic substance piece 690 extends in a direction in which the one swelled portion 592 and the other swelled portion 594 face each other.

In this manner, in the magnet piece 680 of the first hand-carrying member 550A and the magnetic substance piece 690 of the second hand-carrying member 550B, when the first hand-carrying member 550A and the second hand-carrying member 550B are overlapped each other, the flat surface portion of the magnet piece 680 and the flat surface portion of the magnetic substance piece 690 are substantially parallel with other other.

Next, a method of internally providing the magnet piece 680 and the magnetic substance piece 690 in the first hand-carrying member 550A is described.

The longitudinal band-shaped body 580 made of leather or fabric and the elastic member 582 made of fabric or the like with elasticity to form the longitudinal band-shaped hand-carrying member 550 are prepared, and also the magnet piece 680 and the magnetic substance piece 690 are prepared.

The elastic member 582 is overlapped with an inner side surface of the band-shaped body 580.

The hand-carrying member 550 is formed by folding the band-shaped body 580 made of leather or fabric so that portions near both longitudinal edges made of band-shaped leather or fabric overlap each other inward, and bonding or sewing folded portions together.

The band-shaped body 580 is configured so that the folded portions face each other to be laminated to form one hand-carrying member 550.

The band-shaped body 580 is formed in an arch shape with a substantially C-shaped cross section by combining both of the longitudinal edges, that is, the one longitudinal edge 552 and the other longitudinal edge 554, together.

The hand-carrying member 550 has the curved region 560, the overlapping regions (the one overlapping region 562 and the other overlapping region 564), and portions nearby continued to the overlapping regions of the bridging regions (one bridging region 566 and the other bridging region 568) formed in an arch shape with a substantially C-shaped cross section. Prior to that, the magnet piece 680 is disposed between the swelled portion 592 and the swelled portion 594 in the curved region 560.

Similarly, the magnetic substance piece 690 is also disposed between the swelled portion 592 and the swelled portion 594 in the curved region 560 of the band-shaped body 580 configuring the second hand-carrying member 550B.

Here, the magnet piece 680 is disposed inside the elastic member 582 overlapped with the band-shaped body 580. The magnet piece 680 may be disposed between the band-shaped body 580 and the elastic member 582.

On the other hand, the magnetic substance piece 690 is disposed inside the elastic member 582 overlapped with the band-shaped body 580. The magnetic substance piece 690 may be disposed between the band-shaped body 580 and the elastic member 582.

Next, the curved region 560 and the other overlapping region 564 are sewed together near the one longitudinal edge 552 and the other longitudinal edge 554.

The hand-carrying member 550 has formed therein: the closing portion 596 formed by curving the band-shaped body 580 at the center in the width direction with the folded portions placed inward, closing the one longitudinal edge 552 and the other longitudinal edge 554 together, and sewing the one longitudinal edge 552 and the other longitudinal edge 554 together so that an inner side of the one longitudinal edge 552 and the other longitudinal edge 554 is curved to swell to an outer direction, that is, oppositely to the folded portions; the swelled portion 592 and the swelled portion 594 continued to the one longitudinal edge 552 and the other longitudinal edge 554; and the crest portion 590.

The bag main body 512 is provided inside the hand-carrying member 550 with an opening of a pocket (not shown) provided inside the bag main body 512. A pocket opening 670 is provided with a pocket zipper 672. The pocket opening 670 and the pocket zipper 672 are covered with the hand-carrying member 550 for protection.

Next, a method of attaching the hand-carrying portion of the bag is described mainly based on FIG. 33 to FIG. 37.

The longitudinal band-shaped body 580 made of leather or fabric to form the longitudinal band-shaped hand-carrying member 550 is prepared.

The hand-carrying member 550 is formed by folding the band-shaped body 580 made of leather or fabric so that portions near both longitudinal edges made of band-shaped leather or fabric overlap each other inward, and bonding folded portions together.

The band-shaped body 580 is configured so that the folded portions face each other to be laminated to form one hand-carrying member 550.

The band-shaped body 580 is formed in an arch shape with a substantially C-shaped cross section by combining both of the longitudinal edges, that is, the one longitudinal edge 552 and the other longitudinal edge 554, together.

The hand-carrying member 550 has the curved region 560, the overlapping regions (the one overlapping region 562 and the other overlapping region 564), and portions nearby continued to the overlapping regions of the bridging regions (one bridging region 566 and the other bridging region 568) formed in an arch shape with a substantially C-shaped cross section.

The curved region 560 and the other overlapping region 564 are sewed together near the one longitudinal edge 552 and the other longitudinal edge 554.

The hand-carrying member 550 has formed therein: the closing portion 596 formed by curving the band-shaped body 580 at the center in the width direction with the folded portions placed inward, closing the one longitudinal edge 552 and the other longitudinal edge 554 together, and sewing the one longitudinal edge 552 and the other longitudinal edge 554 together so that an inner side of the one longitudinal edge 552 and the other longitudinal edge 554 is curved to swell to an outer direction, that is, oppositely to the folded portions; the swelled portion 592 and the swelled portion 594 continued to the one longitudinal edge 552 and the other longitudinal edge 554; and the crest portion 590 (hand-carrying member forming step).

Next, the support member 600 is intervened for each of the one bridging region 566 and the other bridging region 568 in each of both longitudinal edges, that is, the one longitudinal edge 552 and the other longitudinal edge 554, of the band-shaped body in the one bridging region 566 and the other bridging region 568 of the hand-carrying member 550.

The support members 600 are intervened in the one overlapping region 562 and the other overlapping region 564 along the one overlapping region 562 and the other overlapping region 564 of the hand-carrying member 550 in order to raise the hand-carrying member 550 upward from the bag main body 512 (support member intervening step).

The longitudinal band-shaped bodies 630 and 640 made of leather or fabric forming the support members 600 include the overlapping region 610 having at least an upper portion formed in an arch shape with a substantially C-shaped cross section by combining both longitudinal edges (one longitudinal edge 602 and other longitudinal edge 604) together, the support region 612 extending downward from the overlapping region 610, and the fixing region 614 formed below the support region 612.

In the support members 600, both longitudinal edges, that is, the one longitudinal edge 602 and the other longitudinal edge 604, of the overlapping region 610, are intervened in both longitudinal edges, that is, the one longitudinal edge 552 and the other longitudinal edge 554, of the hand-carrying member 550 formed in an arch shape with a substantially C-shaped cross section.

The overlapping region 610 of the support member 600 and the overlapping region (one overlapping region 562 and other overlapping region 564) of the hand-carrying member 550 are sewed together so that the crest portion 650 of the support member 600 faces the crest portion 590 of the hand-carrying member 550 so as to be positioned oppositely thereto, thereby coupling the support member 600 to the hand-carrying member 550 (support member coupling step).

The band-shaped bodies 630 and band-shaped bodies 640 are formed by folding portions near both band-shape longitudinal edges made of leather or fabric inward and bonding folded portion together.

The band-shaped bodies 630 and band-shaped bodies 640 are configured so that the folded portions face each other to be laminated together to form one support member 600.

The support member 600 has formed therein: the closing portion 656 formed by curving the band-shaped bodies 630 and band-shaped bodies 640 at the center in the width direction with the band-shaped bodies 640 placed inward, closing the one longitudinal edge 602 and the other longitudinal edge 604 together, and sewing the one longitudinal edge 602 and the other longitudinal edge 604 together so that an inner side of the one longitudinal edge 602 and the other longitudinal edge 604 is curved to swell to the outer direction, that is, to the band-shaped bodies 630 side; the swelled portion 652 and the swelled portion 654 continued to the one longitudinal edge 602 and the other longitudinal edge 604; and the crest portion 650 of the support region 612 with the band-shaped bodies 630 and band-shaped bodies 640 curved at the center in the width direction (support member forming step).

For the outer hand-carrying member 550 and the inner support member 600, in a region where the closing portion 596 of the band-shaped body 580 and the crest portion 650 of band-shaped bodies 630 and band-shaped bodies 640 are overlapped each other, a portion near the longitudinal edge (one longitudinal edge 552 and other longitudinal edge 554) of the outer hand-carrying member 550 and a portion near the crest portion 650 of the inner one support member 600 are sewed together to form the sewing portion 660.

In an overlapping region between the one overlapping region 562 of the hand-carrying member 550 and the overlapping region 610 of the support member 600 and an overlapping region between the other overlapping region 564 of the hand-carrying member 550 and the overlapping region 610 of the support member 600 extending from the shouldering region B1, a portion near the one longitudinal edge 552 and the other overlapping region 564 of the hand-carrying member 550 and the crest portion 650 of the support member 600 are sewed together along the one longitudinal edge 552 and the other longitudinal edge 554 of the hand-carrying member 550 to form the sewing portion 660.

Next, the support member 600 is formed so that the support region 612 has an arch shape with a substantially C-shaped or substantially U-shaped cross section at least near the overlapping region 610, and the fixing region 614 below the support region 612 is fixed to the bag main body 512 (support member fixing step).

Next, the hand-carrying member 550 extends downward from the fixing region 614 of the support members 600 fixed to the bag main body 512, and is fixed to the bag main body 512 in the fixing regions (one fixing region 570 and other fixing region 572) of the hand-carrying member 550 (hand-carrying member fixing step).

The support region 612 of the support member 600 is located between the overlapping region 610 and the fixing region 614 where the inner support member 600 is attached to the surface of the bag main body 512. The support region 612 is formed with the band-shaped bodies 630 and band-shaped-bodies 640 curved at the center in the width direction, without the support region 612 portion being sewed.

The overlapping regions 610 at one end of the inner support members 600 are attached to the one overlapping region 562 and the other overlapping region 564 of the hand-carrying members 550, and the fixing regions 614 at the other end are attached to the outer surface of the back main body 512.

In this embodiment, the overlapping regions 610 at one end of the inner support members 600 are sewed to the one overlapping region 562 and the other overlapping region 564 of the hand-carrying member 550 near the left side gore portion 524A (right side gore portion 524B) configuring the gore portion 524 near the opening 528 of the front body portion 520, and also the fixing regions 614 at the other end are sewed to portions near the right side gore portion 524B configuring the gore portion 524 near the opening 528 of the front body portion 520.

The back surface side of the fixing regions 614 in a flat state of the long band-shaped bodies (band-shaped bodies 630 and band-shaped bodies 640) configuring the inner support member 600 is made in contact with and sewed to the outer surface of the bag main body 512.

In this manner, the bag including the structure which supports the hand-carrying member 550 of the hand-carrying portion 514 of the present invention can be formed.

The structural modes of the above-described embodiments are not cited as restricting the present invention, and can be changed based on the idea of the present invention. The present invention includes such changes.

DESCRIPTION OF SYMBOLS

10, 210 hand-carrying bag
12, 212 bag main body
14, 214 hand-carrying portion
20, 220 front body portion
22, 222 back body portion
24, 224 gore portion
24A, 224A left side gore portion
24B, 224B right side gore portion
26, 226 bottom portion
28, 228 opening
30, 230 zipper
32, 232 bottom member
34, 234 bottom member joining region
50, 250 hand-carrying member
50A first hand-carrying member
50B second hand-carrying member
52, 252, 102, 302 one longitudinal edge
54, 254, 104, 304 other longitudinal edge
60, 260 curved region
62, 262 one overlapping region
64, 264 other overlapping region
66, 266 one bridging region
68, 268 other bridging region
70, 270 one fixing region
72, 272 other fixing region
80, 280 band-shaped body

92, 94, 152, 154, 292, 294, 352, 354 swelled portion
90, 150, 290, 350 crest portion
96, 156, 296, 356 closing portion
100, 300 support member
110, 310 overlapping region
112, 312 support region
114, 314 fixing region
130, 140, 330, 340 band-shaped body
160, 360 sewing portion
510 hand-carrying bag
512 bag main body
514 hand-carrying portion
520 front body portion
522 back body portion
524 gore portion
524A left side gore portion
524B right side gore portion
526 bottom portion
528 opening
530 zipper
532 bottom member
534 bottom member joining region
550 hand-carrying member
550A first hand-carrying member
550B second hand-carrying member
552 one longitudinal edge
554 other longitudinal edge
560 curved region
562 one overlapping region
564 other overlapping region
566 one bridging region
568 other bridging region
570 one fixing region
572 other fixing region
580 band-shaped body
582 elastic member
582*a* one longitudinal edge
582*b* other longitudinal edge
592, 594, 652, 654 swelled portion
590, 650 crest portion
596, 656 closing portion
600 support member
602 one longitudinal edge
604 other longitudinal edge
610 overlapping region
612 support region
614 fixing region
630, 640 band-shaped body
660 sewing portion
670 pocket opening
672 pocket zipper
680 magnet piece
690 magnetic substance piece
A1 hand-carrying region
A2 non-sewing region
A3 joining region
A4 non-joining region
B1 shouldering region
B2 non-sewing region
B3 joining region
B4 non-joining region

The invention claimed is:

1. A structure of a hand-carrying portion which is attached to a bag main body and supports a hand-carrying member, wherein the longitudinal hand-carrying member in a band shape is formed in an arch shape with a substantially C-shaped cross section by combining both longitudinal edges together, the hand-carrying member has a support member intervened between both of the longitudinal edges to raise the hand-carrying member upward from the bag main body, the support member is a longitudinal band-shaped body, and includes an overlapping region having at least an upper portion formed in an arch shape with a substantially C-shaped cross section by combining both longitudinal edges together, a support region extending downward from the overlapping region, and a fixing region formed below the support region, the support member has both of the longitudinal edges of the overlapping region intervened between both longitudinal edges of the hand-carrying member formed in the arch shape with the substantially C-shaped cross section, the support member is coupled, with the overlapping region of the support member and an overlapping region of the hand-carrying member sewed together so that a crest portion of the support member faces a crest portion of the hand-carrying member so as to be positioned oppositely thereto, the support member has the support region formed in an arch shape with a substantially C-shaped cross section or a substantially U-shaped cross section at least near the overlapping region, and is fixed to the bag main body in the fixing region below the support region, and the hand-carrying member extends downward from the fixing region of the support member fixed to the bag main body, and is fixed to the bag main body in the fixing region of the hand-carrying member.

2. The structure of the hand-carrying portion of the bag according to claim 1, wherein the support member has a plurality of band-shaped bodies laminated, with the band-shaped bodies curved in width to form the overlapping region in the arch shape with the substantially C-shaped cross section.

3. The structure of the hand-carrying portion of the bag according to claim 2, wherein the hand-carrying member includes a curved region, each overlapping region formed continuously to both ends of the curved region, bridging regions formed continuously to the overlapping regions, and fixing regions formed continuously to the bridging regions, and the curved region, the overlapping regions, and nearby portions of the bridging regions continued to the overlapping regions are formed in an arch shape with a substantially C-shaped cross section.

4. The structure of the hand-carrying portion of the bag according to claim 1, wherein the hand-carrying member includes a curved region, each overlapping region formed continuously to both ends of the curved region, bridging regions formed continuously to the overlapping regions, and fixing regions formed continuously to the bridging regions, and the curved region, the overlapping regions, and nearby portions of the bridging regions continued to the overlapping regions are formed in an arch shape with a substantially C-shaped cross section.

5. A structure of a hand-carrying portion which is attached to a bag main body and supports a hand-carrying member, wherein the longitudinal hand-carrying member in a band shape is formed in an arch shape with a substantially C-shaped cross section by combining both longitudinal edges together, the hand-carrying member has a support member intervened between both of the longitudinal edges to raise the hand-carrying member upward from the bag main body, the support member is a longitudinal band-shaped body, and includes an overlapping region having at least an upper portion formed in an arch shape with a substantially C-shaped cross section by combining both longitudinal edges together, a support region extending downward from the overlapping region, and a fixing region formed below the support region, the support member has both of the longitudinal edges of the overlapping region intervened between both longitudinal edges of the hand-carrying member formed in the arch shape with the substantially C-shaped cross section, the support member is coupled, with the overlapping region of the support member and an overlapping region of the hand-carrying member sewed together so that a crest portion of the support member faces a crest portion of the hand-carrying member so as to be positioned oppositely thereto, the support member has the support region formed in an arch shape with a substantially C-shaped cross section or a substantially U-shaped cross section at least near the overlapping region, and is fixed to the bag main body in the fixing region below the support region, and the hand-carrying member extends downward from the overlapping region, and is fixed to the bag main body in the fixing region of the hand-carrying member of a portion extending downward.

6. The structure of the hand-carrying portion of the bag according to claim 5, wherein the support member has a plurality of band-shaped bodies laminated, with the band-shaped bodies curved in width to form the overlapping region in the arch shape with the substantially C-shaped cross section.

7. The structure of the hand-carrying portion of the bag according to claim 6, wherein the support member includes the overlapping region, the support region formed continuously to the overlapping region, and the fixing region formed continuously to the support region, and the overlapping region and nearby portion of the support region continued to the overlapping region are formed in an arch shape with a substantially C-shaped cross section.

8. The structure of the hand-carrying portion of the bag according to claim 6, wherein the support member includes the overlapping region, the support region formed continuously to the overlapping region, and the fixing region formed continuously to the support region, and the overlapping region and nearby portion of the support region continued to the overlapping region are formed in an arch shape with a substantially C-shaped cross section.

9. The structure of the hand-carrying portion of the bag according to claim 5, wherein the support member includes the overlapping region, the support region formed continuously to the overlapping region, and the fixing region formed continuously to the support region, and the overlapping region and nearby portion of the support region continued to the overlapping region are formed in an arch shape with a substantially C-shaped cross section.

10. A method of attaching a hand-carrying portion of a bag, comprising:

a hand-carrying member forming step of forming a hand-carrying member by forming a curved region, one overlapping region and other overlapping region, and nearby portions of one bridging region and other bridging region continued to the overlapping regions in an arch shape with a substantially C-shaped cross section, and forming: a closing portion by curving band-shaped bodies at center in a width direction with folded portions placed inward, closing one longitudinal edge and other longitudinal edge together, and sewing the one longitudinal edge and the other longitudinal edge together so that an inner side of the one longitudinal edge and the other longitudinal edge is curved to swell to an outer direction, that is, oppositely to the folded portions; one swelled portion continued to the one longitudinal edge and other swelled portion continued to the other longitudinal edge; and a crest portion;

a support member forming step of forming a support member by forming: a closing portion by curving band-shaped bodies at center in a width direction with the band-shaped bodies placed inward, closing one longitudinal edge and other longitudinal edge together, and sewing the one longitudinal edge and the other longitudinal edge together so that an inner side of the one longitudinal edge and the other longitudinal edge is curved to swell to an outer direction, that is, to a band-shaped bodies side; one swelled portion continued to the one longitudinal edge and other swelled portion continued to the other longitudinal edge; and a crest portion of the support region with the band-shaped bodies curved at the center in the width direction;

a support member intervening step of intervening both longitudinal edges, that is, one longitudinal edge and other longitudinal edge, of the support member in the overlapping region between both of the longitudinal edges, that is, the one longitudinal edge and the other longitudinal edge, of the band-shaped bodies of the hand-carrying member in the one bridging region and the other bridging region along the one overlapping region and the other overlapping region of the support member between the one overlapping region and the other overlapping region to raise the hand-carrying member upward from the bag main body;

a support member coupling step of coupling the support member to the hand-carrying member by sewing the overlapping region of the support member and the one overlapping region and the other overlapping region of the hand-carrying member together so that the crest portion of the support member faces the crest portion of the hand-carrying member so as to be positioned oppositely thereto;

a support member fixing step of forming the support member having the support region formed in an arch shape with a substantially C-shaped cross section or a substantially U-shaped cross section at least near the over lapping region, and fixing the support member to the bag main body in a fixing region below the support region; and a hand-carrying member fixing step of extending the hand-carrying member downward from the fixing region of the support member fixed to the bag main body, and fixing the hand-carrying member to the bag main body in one fixing region and other fixing region of the hand-carrying member.

* * * * *